US011807282B2

(12) United States Patent
Hematian et al.

(10) Patent No.: US 11,807,282 B2
(45) Date of Patent: Nov. 7, 2023

(54) RAILROAD CAR TRUCK DAMPER WEDGE FITTINGS

(71) Applicant: NATIONAL STEEL CAR LIMITED, Hamilton (CA)

(72) Inventors: Jamal Hematian, Burlington (CA); Kenneth Wayne Black, Hamilton (CA)

(73) Assignee: National Steel Car Limited, Hamilton (CA)

( * ) Notice: Subject to any disclaimer, the term of this patent is extended or adjusted under 35 U.S.C. 154(b) by 324 days.

(21) Appl. No.: 17/092,771

(22) Filed: Nov. 9, 2020

(65) Prior Publication Data

US 2022/0144321 A1 May 12, 2022

(51) Int. Cl.

| | |
|---|---|
| ***B61F 5/12*** | (2006.01) |
| ***B61F 3/02*** | (2006.01) |
| ***B61F 5/06*** | (2006.01) |

(52) U.S. Cl.

CPC ..... *B61F 5/122* (2013.01); *B61F 3/02* (2013.01); *B61F 5/06* (2013.01)

(58) Field of Classification Search

CPC .. B61F 5/305; B61F 5/14; B61F 5/148; B61F 5/142; B61F 5/308; B61F 5/122; B61F 3/02; B61F 5/06; B61F 5/12

See application file for complete search history.

(56) References Cited

U.S. PATENT DOCUMENTS

| | | | |
|---|---|---|---|
| 2,053,990 | A | 9/1936 | Goodwin |
| 2,129,408 | A | 9/1938 | Davidson |
| 2,257,109 | A | 9/1941 | Davidson |
| 2,324,267 | A | 7/1943 | Oelkers |
| 2,333,921 | A | 11/1943 | Flesch |
| 2,352,693 | A | 7/1944 | Davidson |
| 2,404,278 | A | 7/1946 | Dath |
| 2,408,866 | A | 10/1946 | Marquardt |

(Continued)

FOREIGN PATENT DOCUMENTS

| | | | |
|---|---|---|---|
| CA | 714822 | A1 | 8/1965 |
| CA | 2153137 | A1 | 1/1996 |

(Continued)

OTHER PUBLICATIONS

International Search Report & Written Report in PCT/CA2020/051576 dated Aug. 5, 2021.

*Primary Examiner* — Mark T Le

(74) *Attorney, Agent, or Firm* — Nathan B. Webb; Hahn Loeser & Parks LLP

(57) ABSTRACT

There is a damper wedge for a railroad car truck. It has a removable and replaceable friction element that reciprocates on the wear plate of the side frame column of the railroad car truck. It has a non-metallic wear surface; a spring seat that, in use, engages a spring of the railroad car truck; and an inclined damper wedge surface having a primary angle, alpha, and a secondary angle, beta. The inclined damper wedge surface has a curvature. The curvature has a working point. The working point is located in a central region of a contact patch, or working surface patch. The nonmetallic wear surface material is mounted to a carrier that mounts removably to the damper wedge body. The carrier has fingers that span the wedge and that transfer shear and resist torsion, the fingers preventing the non-metallic member from migrating out of position.

20 Claims, 25 Drawing Sheets

(56) References Cited

U.S. PATENT DOCUMENTS

| | | | | | |
|---|---|---|---|---|---|
| 2,424,936 | A | | 7/1947 | Light | |
| 2,434,583 | A | | 1/1948 | Pierce | |
| 2,446,506 | A | | 8/1948 | Barrett | |
| 2,456,635 | A | | 12/1948 | Heater | |
| 2,458,210 | A | | 1/1949 | Schlegel | |
| 2,497,460 | A | | 2/1950 | Leese | |
| 2,528,473 | A | | 10/1950 | Kowalik | |
| 2,650,550 | A | | 9/1953 | Pierce | |
| 2,727,472 | A | | 12/1955 | Forssell | |
| 2,751,856 | A | | 6/1956 | Maatman | |
| 2,777,400 | A | | 1/1957 | Forssell | |
| 2,827,987 | A | | 3/1958 | Williams | |
| 2,853,958 | A | | 9/1958 | Neumann | |
| 2,883,944 | A | | 4/1959 | Couch | |
| 2,911,923 | A | | 11/1959 | Bachman | |
| 3,024,743 | A | | 3/1962 | Williams | |
| 3,026,819 | A | | 3/1962 | Cope | |
| 3,218,990 | A | | 11/1965 | Weber | |
| 3,285,197 | A | | 11/1966 | Tack | |
| 3,358,614 | A | | 12/1967 | Barber | |
| 3,461,815 | A | | 8/1969 | Gedris | |
| 3,559,589 | A | | 2/1971 | Williams | |
| 3,575,117 | A | | 4/1971 | Tack | |
| 3,670,660 | A | | 6/1972 | Weber | |
| 3,714,905 | A | | 2/1973 | Barber | |
| 3,802,353 | A | | 4/1974 | Korpics | |
| 3,855,942 | A | | 12/1974 | Mulcahy | |
| 3,901,163 | A | | 8/1975 | Neumann | |
| 3,977,332 | A | | 8/1976 | Bullock | |
| 4,003,318 | A | | 1/1977 | Bullock | |
| 4,084,514 | A | | 4/1978 | Bullock | |
| 4,109,585 | A | | 4/1978 | Brose | |
| 4,103,623 | A | | 8/1978 | Radwill | |
| 4,167,907 | A | | 9/1979 | Mulcahy | |
| 4,179,995 | A | | 12/1979 | Day | |
| 4,203,371 | A | * | 5/1980 | Tack | B61F 5/32 105/225 |
| 4,230,047 | A | | 10/1980 | Wiebe | |
| 4,254,713 | A | | 3/1981 | Clafford | |
| 4,256,041 | A | | 3/1981 | Kemper | |
| 4,274,340 | A | | 6/1981 | Neumann | |
| 4,276,833 | A | | 7/1981 | Bullock | |
| 4,295,429 | A | | 10/1981 | Wiebe | |
| 4,357,880 | A | | 11/1982 | Weber | |
| 4,370,933 | A | | 2/1983 | Mulcahy | |
| 4,426,934 | A | | 1/1984 | Geyer | |
| 4,483,253 | A | | 11/1984 | List | |
| 4,491,075 | A | | 1/1985 | Neumann | |
| 4,574,408 | A | | 3/1986 | Dentler | |
| 4,637,319 | A | | 1/1987 | Moehling | |
| 4,825,775 | A | | 5/1989 | Stein | |
| 4,825,776 | A | | 5/1989 | Spencer | |
| 4,915,031 | A | | 4/1990 | Wiebe | |
| 4,953,471 | A | | 9/1990 | Wronkiewicz | |
| 4,974,521 | A | | 12/1990 | Eungard | |
| 4,986,192 | A | | 1/1991 | Wiebe | |
| 5,086,708 | A | | 2/1992 | Mckeown, Jr. | |
| 5,095,823 | A | | 3/1992 | Mckeown, Jr. | |
| 5,176,083 | A | | 1/1993 | Bullock | |
| 5,239,932 | A | | 8/1993 | Weber | |
| 5,331,902 | A | | 7/1994 | Hawthorne | |
| 5,425,312 | A | * | 6/1995 | Tack, Jr. | B61F 5/32 105/225 |
| 5,452,665 | A | | 9/1995 | Wronkiewicz | |
| 5,511,489 | A | | 4/1996 | Bullock | |
| 5,524,551 | A | | 6/1996 | Hawthorne | |
| 5,555,817 | A | | 9/1996 | Tailon | |
| 5,555,818 | A | | 9/1996 | Bullock | |
| 5,850,795 | A | | 12/1998 | Taillon | |
| 5,875,721 | A | | 3/1999 | Wright | |
| 5,921,186 | A | | 7/1999 | Hawthorne | |
| 5,924,366 | A | * | 7/1999 | Trainer | B61F 5/32 105/206.1 |
| 5,943,961 | A | | 8/1999 | Rudibaugh | |
| 6,173,655 | B1 | | 1/2001 | Hawthorne | |
| 6,186,075 | B1 | | 2/2001 | Spencer | |
| 6,227,122 | B1 | | 5/2001 | Spencer | |
| 6,276,283 | B1 | | 8/2001 | Weber | |
| 6,374,749 | B1 | * | 4/2002 | Duncan | B61F 5/122 105/198.5 |
| 6,425,334 | B1 | | 7/2002 | Wronkiewicz | |
| 6,691,625 | B2 | | 2/2004 | Duncan | |
| 6,701,850 | B2 | | 3/2004 | Mccabe | |
| 6,734,749 | B2 | | 5/2004 | Mattisson | |
| 6,971,319 | B2 | | 12/2005 | Bowden | |
| 7,143,700 | B2 | | 12/2006 | Forbes | |
| 8,136,456 | B2 | | 3/2012 | Sammartino | |
| 11,104,359 | B2 | | 8/2021 | Golembiewski | |
| 11,414,107 | B2 | | 8/2022 | Hematian | |
| 2002/0079279 | A1 | | 6/2002 | Duncan | |
| 2003/0024429 | A1 | | 2/2003 | Forbes | |
| 2003/0037696 | A1 | | 2/2003 | Forbes | |
| 2003/0041772 | A1 | | 3/2003 | Forbes | |
| 2003/0129037 | A1 | | 7/2003 | Forbes | |
| 2012/0234202 | A1 | * | 9/2012 | Tavares | B61F 5/00 105/225 |
| 2020/0207380 | A1 | | 7/2020 | Smerecky | |

FOREIGN PATENT DOCUMENTS

| | | | |
|---|---|---|---|
| EP | 1053925 | A1 | 4/2003 |
| GB | 377395 | A1 | 7/1932 |
| WO | 2005005219 | | 1/2005 |

* cited by examiner

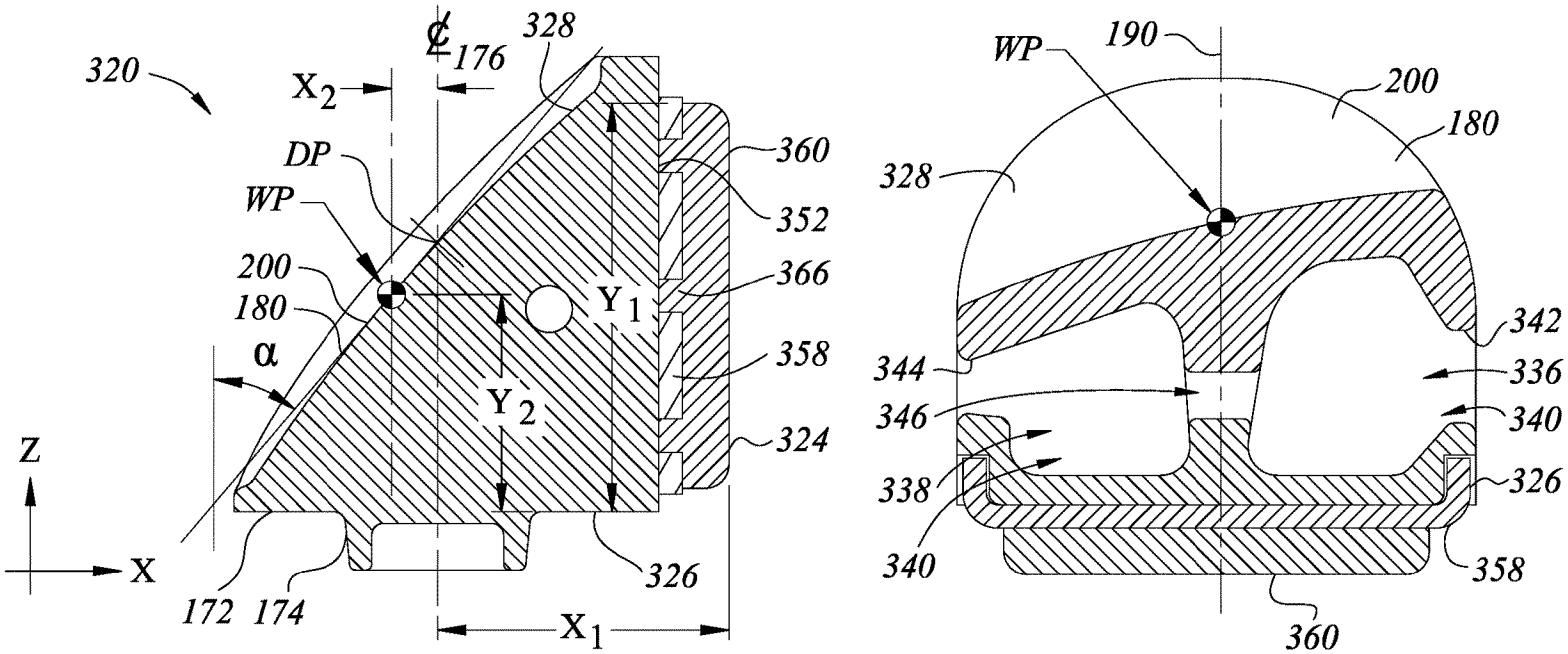
FIG. 8g
FIG. 8f
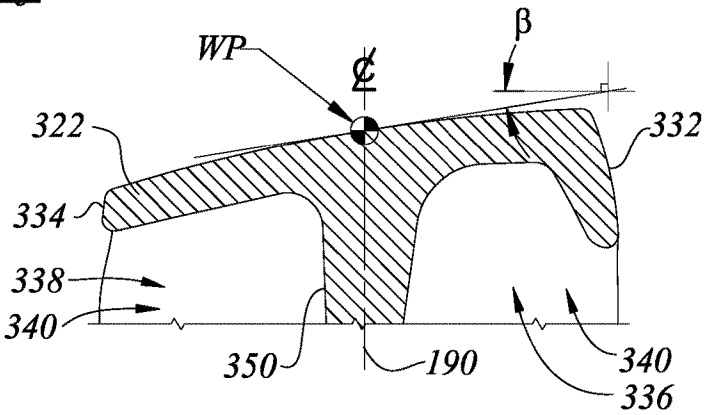
FIG. 8h

RAILROAD CAR TRUCK DAMPER WEDGE FITTINGS

FIELD OF THE INVENTION

This invention relates to the field of damper fittings for bolsters of railroad car trucks.

BACKGROUND

The problem of the ride quality of railroad freight car trucks has endured for many years. Previous attempts to address this problem are seen in WO 2005 005219 of Forbes and Hematian. As explained in that application, ride quality tends to involve the often subtle inter-relationship of dynamic responses in multiple degrees of freedom at multiple reaction interfaces.

The relationship between self-steering at the interface between the bearing adapters and the side frame pedestals, and the coincident lateral swinging motion at the same interface; and the response at the interface between the truck bolster and the side frames both contribute to overall ride quality, with friction dampers providing damping of these motions. The dampers are often triangular wedges mounted to work between the bolster and the side frame columns. The type of friction interface affects performance. That is, friction used to be provided by the sliding engagement of steel (or cast iron) on steel. More recently, damper wedges have been used with non-metallic working surfaces, or pads, that bear on the side frame column wear plates.

It had been assumed the normal force to the friction face of the damper wedge could be approximated by a point load through the center, or by a distributed load either of uniform magnitude across the friction face, or as a distribution having its center in the middle of the friction face. More recent observations have been that this may not be correct. Pads tend to wear mainly on the top edge during upward motion of the bolster, and on the bottom edge during downward motion of the bolster. If the slope face of the wedge is flat, then the distribution of force is almost uniform. However, when the slope face has a curvature, such as a spherical shape, then the distribution of forces on the front face of the wedge where the friction pad is seated will be almost always non-uniform. Whereas it had been assumed that the distribution of forces would be roughly the same from damper wedge to damper wedge, actual observation indicates that force distribution on the front face of the friction damper wedge is surprisingly sensitive to manufacturing tolerances and variations on the rear face of the damper wedge.

Where the edge of the non-metallic friction pad is worn off, the underlying metallic parts may then have a tendency to score and gouge each other. This will most probably affect the performance of the truck, which is not desirable.

Given the inconvenience of changing friction damper wedges undesirably frequently, or at unexpected intervals, the variability between damper wedge parts, the variability in ride performance, and the variability in wear pad life consequent on such variability present a challenge. Furthermore, it may be helpful to be able to replace the damper friction pads. There are, however, a number of considerations. The friction pads may be thought of a being of the same, or similar, nature to brake linings, or to clutch linings. When used in railroad car truck friction dampers, these friction materials, or brake linings, or friction pads, however they may be termed, are required to operate anywhere in North America, at any time of year, at any level of humidity, or when wet, when exposed to a salt air environment or to desert conditions, from sea level to the elevation of the highest mountain pass traversed by rails, and they must do so with relatively infrequent inspection or maintenance.

The Applicant is aware of earlier attempts in this area in U.S. Pat. No. 6,734,749 of Duncan et al., and U.S. Pat. No. 6,701,850 of McCabe et al. Where a blank of friction material is mounted to the front face of the damper wedge using a two-sided adhesive, the adhesive must withstand both the heating of the pad in use and the shear force being transmitted from the friction material to the damper body. Conversely, the friction material may be bonded to the friction damper body in such a manner that, when rotated out due to wear, it is difficult, or impossible at reasonable cost to remove the remaining old friction material and replace it with new material. Where the friction material is formed in a pocket, and the pocket has a peripheral retaining lip, or tabs, the portion of the friction material that lies shy of the retaining lip or tabs can never be used in service—i.e., the retaining lip would contact (and gouge) the bearing surface first. As the friction materials tend to be relatively expensive, the issue of renewal and reconditioning at reasonable economic cost is not a trivial concern. To avoid waste, it is generally desirable for a high percentage of the friction material to stand proud of the underlying structure to which it is mounted. It has also been observed that the shear forces involved, and the tendency of the damper wedges to squirm in the damper pockets, imposes non-trivial loading on the parts.

SUMMARY OF THE INVENTION

The invention relates to a friction damper wedge design having a non-metallic friction face that slidingly engages the side frame column wear plate. The friction damper wedge has an inclined curved surface that has a working point at a specific location which co-operates with a corresponding bolster pocket. The location of the working point is such that when it engages the bolster pocket it will result in a more uniformly distributed load on the friction face.

In an aspect of the invention there is a friction wear assembly removably mounted to a friction damper wedge body that seats in a bolster pocket of a truck bolster of a railroad car truck, and, that in use forms the face that slides against a side frame column wear plate. It has a carrier and a friction element secured to the carrier. The carrier is formed of a plate having a first face and a second face. The first face is opposed to the second face. The first face defines a datum surface. The friction element is mounted to the first face of the carrier, and lies forwardly of the datum surface. The friction element has a set of mechanical interlinks that mate with corresponding mechanical interlinks of the carrier rearwardly of the datum surface. The second face of the plate defines a force transfer interface that, in use, abuts the friction damper wedge body. The plate has first and second side margins. The plate has first and second fingers formed to extend rearwardly from the first and second side margins respectively. The fingers define shear force and moment couple transfer interfaces.

In a feature of that aspect, the assembly is free of any material other than the friction element forward of the datum surface. In another feature, the fingers have a root width, w, and a rearward reach distance, x; and w is at least twice as great as x. In still another feature, the second face of the carrier is free of rearwardly protruding obstructions. In a further feature, the datum surface is planar. In another feature, the set of mechanical interlinks of the carrier includes an array of holes formed in the carrier rearwardly of the datum surface. In another feature, the fingers are formed to span the damper wedge body and to lie within the dynamic profile of the damper wedge body. In still another feature, the fingers are formed to clip to the damper wedge body in a sprung pre-load interference fit. In yet another feature, the friction element is a non-metallic friction lining. In still yet another feature, the friction wear assembly is molded to the carrier. The mechanical interlinks of the plate include holes. The mechanical interlinks of the friction element include molded studs that form anchors within the mechanical interlink holes of the plate.

In another feature, there is a damper wedge assembly for a railroad car truck. It includes the friction wear assembly noted above, and the friction damper wedge body to which it is mounted. The friction element is made of a non-metallic friction pad mounted to a forward face of the carrier and, in use, movably engages a wear surface of a side frame column of the railroad car truck. The damper wedge body has a spring seat, a rear face removably engaged in the bolster pocket, and a forwardly oriented wear member seat. The first and second fingers of the carrier extend rearwardly from the friction element and define respective engagement fittings matable with the damper wedge body. The damper wedge body has at least first and second accommodations, the first and second accommodations being formed in opposed margins of the damper wedge body. The first and second fingers are removably engageable in the first and second accommodations of the damper wedge body. When seated in the accommodations, the first and second fingers and the first and second accommodations are in a vertical shear force transfer relationship. The carrier is removably engaged with the damper wedge body.

In an additional feature of that feature, the rear face of the damper wedge body has a primary angle, alpha, and a transverse secondary angle, beta. The damper wedge assembly is provided as a matching pair of such assemblies of which a first member of the pair has a right-handed beta angle, and a second member of the pair has a left-handed beta angle. In another feature, the damper wedge body has a diagonal face formed on a curvature, and the curvature has a working point in rocking contact with a slope face of the bolster pocket of the bolster of the railroad car truck. In another feature, as installed the damper wedge body is in rolling contact with the bolster pocket at a working point. In an additional feature, the damper wedge body is hollow; the damper wedge body has an internal web extending forwardly of the working point between the spring seat, the rear face, and the wear member seat.

In another feature, the wear member seat includes at least first and second accommodations. The first and second accommodations are spaced apart spanwise. The engagement fittings of the wear plate include at least a first engagement fitting and a second engagement fitting, the first and second engagement fittings being opposed and spaced apart to span the carrier. The first engagement fitting of the wear plate removably engages the first accommodation of the damper wedge body. The second engagement fitting of the wear plate removably engages the second accommodation of the damper wedge body. The plate of the carrier is free of any material other than the friction element forward of the datum surface. The second face of the carrier is free of rearwardly protruding obstructions. The datum surface is planar. The set of mechanical interlinks of the carrier includes an array of holes formed in the carrier rearwardly of the datum surface;

In another feature, the fingers are formed to span the damper wedge body and to lie within the dynamic profile of the damper wedge body. The fingers are formed to clip to the damper wedge body in a sprung pre-load interference fit. In still another feature, the friction element is a non-metallic friction lining; the friction wear assembly is molded to the carrier; the mechanical interlinks of the plate include holes; and the mechanical interlinks of the friction element include molded studs that form anchors within the mechanical interlink holes of the plate. In another feature, the fingers of the carrier plate have a root width, w, and a rearward reach distance, x; and w is at least twice as great as x.

In another aspect there is a friction element assembly that engages a seat of a friction damper wedge body that mounts in a bolster pocket of a truck bolster of a railroad car truck. The friction element assembly has a retainer and a mating friction element that engages the retainer. The retainer has a first interface that engages the friction element. The retainer has a second interface that engages the seat of the friction damper wedge. The retainer is releasable from the seat of the friction damper wedge to permit replacement of the friction element assembly. The friction element is releasable from the retainer. When the friction element is engaged with the retainer, and the retainer is engaged with the seat, the retainer is deflected by such engagement.

In a feature of that aspect, engagement of the friction element with the retainer imposes a first friction fit. Engagement of the retainer with the seat imposes a second interference fit. Mating the retainer with the seat tightens the first friction fit. In another feature, mating engagement of the friction element with the retainer imposes a spring pre-load on the retainer and mating of the retainer with the seat increases that spring pre-load. In another feature, the friction element has a first characteristic dimension. The seat has a second characteristic dimension. There is a dimension delta that is the difference between the first and second characteristic dimensions the retainer includes a spring. The spring is deflected to conform to the first characteristic dimension and to the second characteristic dimension. When so deflected, the spring acts to retain the friction element in position relative to the seat. In another feature, the seat of the damper wedge defines a socket, the friction element is sized to seat within the socket with a clearance, the retainer occupies the clearance. When the retainer is seated in the clearance the retainer is resiliently loaded between the seat of the damper wedge and the friction member.

In another feature the retainer has a spider and an array of fingers spaced peripherally around the spider. The fingers define springs that are engaged when the friction element is installed. In another feature, the springs collectively define a compression spring that, on installation, works between, and against, the friction element and the friction damper wedge body. In a further feature, the springs have a dog-legged form in which one part of the dog-leg bears against the friction element and another part of the dog-leg engages the damper wedge body. The installation of the friction element results in deflection of the dog-leg between the friction damper body and the friction element. In still another feature, the dog-leg has a fulcrum, and the fulcrum bears against the friction element. In still another feature, the friction element is four sided and at least one of said springs bears on each of the four sides.

In another aspect there is a retainer. The retainer is operable to work between a friction element and a seat of a friction damper wedge body that mounts in a bolster pocket of a truck bolster of a railroad car truck. The retainer has a first interface at which the retainer engages the friction element. There is a second interface at which the retainer engages the seat of the friction damper wedge. The retainer is releasable from the seat of the friction damper wedge to permit replacement of the friction element. The friction element is releasable from the retainer. When the friction element is engaged with the retainer, and the retainer is engaged with the seat, the retainer is deflected by such engagement.

In a feature of that aspect the retainer is sized such that when the friction element is mounted in the retainer the first interface is in a friction fit with the friction element. In another feature, the retainer is sized such that when the retainer engages the seat of the friction damper wedge body, the second interface of the retainer is in a friction fit. In a further feature, the retainer is sized such that when the friction element is engaged by the first interface. The retainer has a resilient spring loading. In another feature, the retainer is sized such that when the seat of the damper wedge body is engaged by the second interface, the retainer is resiliently spring loaded by that engagement.

In another feature, the retainer is sized such that at least two of: (a) when the friction element mounts to the retainer the first interface is in a first friction fit with the friction element; (b) when the retainer engages the seat of the friction damper wedge body, the second interface of the retainer is in a second friction fit; and (c) when the friction element is engaged by the first interface, and the seat of the damper wedge body is engaged by the second interface, the retainer is resiliently spring loaded between the friction element and the seat of the damper wedge body.

In still another feature, the retainer has at least a first finger. The finger locates between the friction element and the seat of the damper wedge body on installation. The first finger defines at least a portion of the first interface of the retainer at which the finger engages the friction element. The first finger defines at least a portion of the second interface of the retainer at which the first finger engages the seat of the friction damper wedge. The first finger defines a spring that is deflected on installation. In yet another feature, the retainer has a spider, and a set of fingers arrayed peripherally relative to the spider the set of fingers defines at least a portion of the first interface, at which the set of fingers engages the friction element. The set of fingers defines at least a portion of the second interface, at which the set of fingers engages the seat of the friction damper wedge in use the set of fingers is resiliently spring loaded between the friction element and the seat of the friction damper wedge.

In another feature, the friction element is a non-metallic friction lining that has a front face for engaging a friction wear plate of a side frame column of a railroad car truck side frame, a rear face for orientation facing the damper wedge, and side edges extending between the front and rear faces in which the seat of the friction damper wedge body is a socket, the socket is sized to accommodate the friction element. On installation the spider of the retainer locates in the socket behind the rear face of the friction element and is trapped between the rear face of the friction element and the seat of the friction damper wedge body. The set of fingers grasps respective ones of the side edges of the friction element, the set of fingers is spring-loaded thereby. The set of fingers fits within the socket, and is further spring-loaded thereby. Spring loading of the retainer between the friction element and the socket discourages dislodgement of the friction element from the socket.

In a further feature, there is a friction damper wedge assembly that includes the friction element retainer, the friction damper wedge, and the friction element. The friction element is a non-metallic friction lining has a front face for engaging a friction wear plate of a side frame column of a railroad car truck side frame, a rear face for orientation facing the damper wedge, and side edges extending between the front and rear faces. The seat of the friction damper wedge body is a socket, the socket is sized to accommodate the friction element when the friction element is mated to the retainer. The retainer has a spider, and a set of fingers arrayed peripherally relative to the spider. The spider defines a frame setting in which the friction element locates. The spider of the retainer locates in the socket behind the rear face of the friction element and is trapped between the rear face of the friction element and the seat of the friction damper wedge body. The set of fingers extends forwardly away from the spider. The set of fingers defines at least a portion of the first interface, at which the set of fingers engages the friction element. The set of fingers defines at least a portion of the second interface, at which the set of fingers engages the seat of the friction damper wedge. In use the set of fingers is resiliently spring loaded between the friction element and the seat of the friction damper wedge. The fingers grasp respective ones of the side edges of the friction element. The set of fingers is spring-loaded thereby. The set of fingers fits within the socket, and is further spring-loaded thereby. Spring loading of the retainer between the friction element and the socket discourages dislodgement of the friction element from the socket.

These and other aspects and features of the invention may be understood with reference to the description that follows, and with the aid of the illustrations.

BRIEF DESCRIPTION OF THE FIGURES

The principles of the invention may better be understood with reference to the accompanying figures provided by way of illustration of an exemplary embodiment, or embodiments, incorporating principles and aspects of the present invention, and in which:

FIG. 8*f* is a sectional view on the spring seat vertical central plane indicated by section '8*f*-8*f*' in FIG. 8*a;*

FIG. 8*g* is a sectional view in the horizontal plane indicated by section '8*g*-8*g*' in FIG. 8*a;*

FIG. 8*h* is a sectional plane taken on the spherical radius through the working point as indicated by section '8*h*-8*h*' of FIG. 3*c;*

DETAILED DESCRIPTION

Figure 1A:
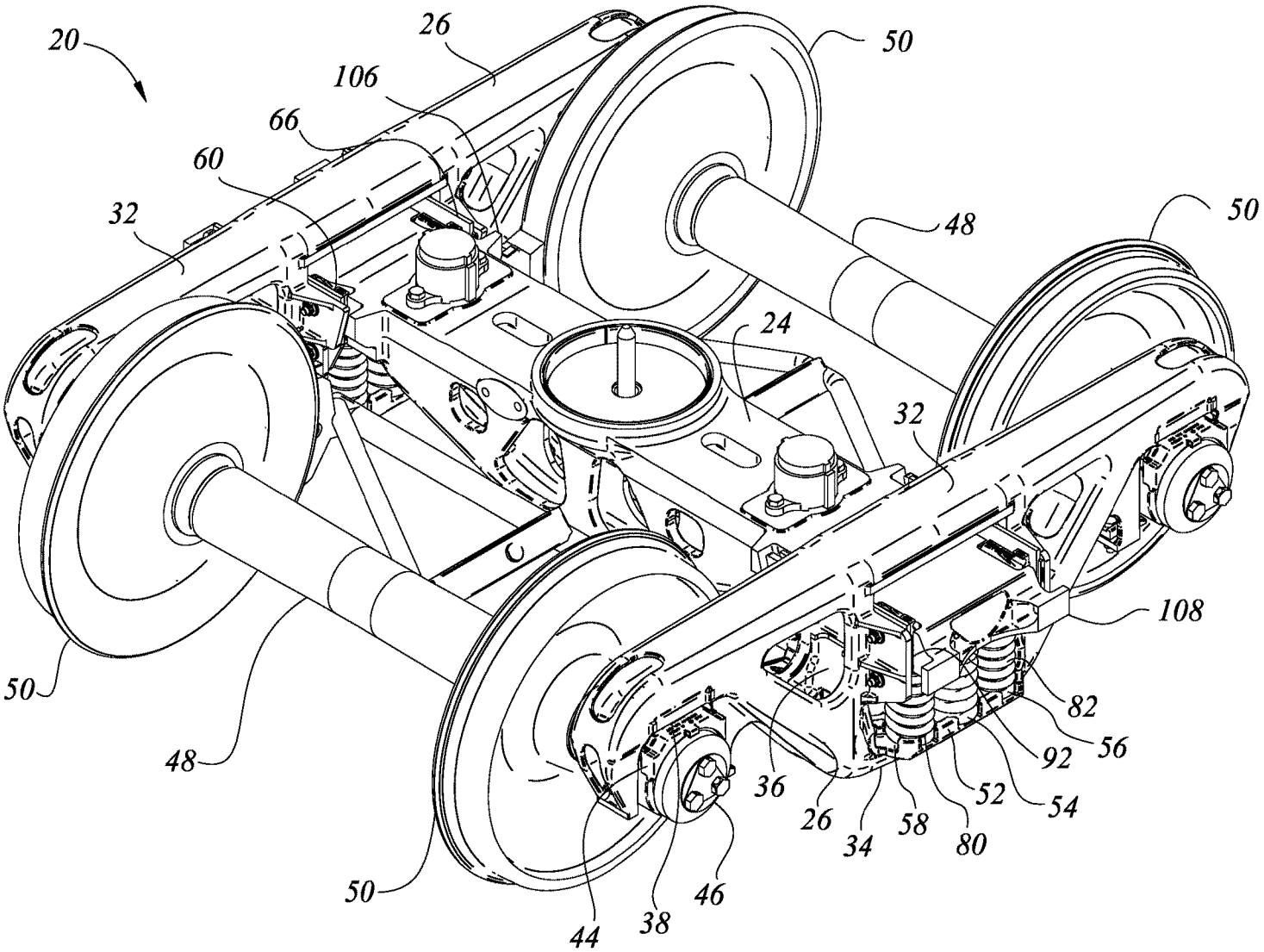
FIG. 1*a* shows an isometric view of an example of an embodiment of a railroad car truck according to an aspect of the present invention.
Figure 1B:
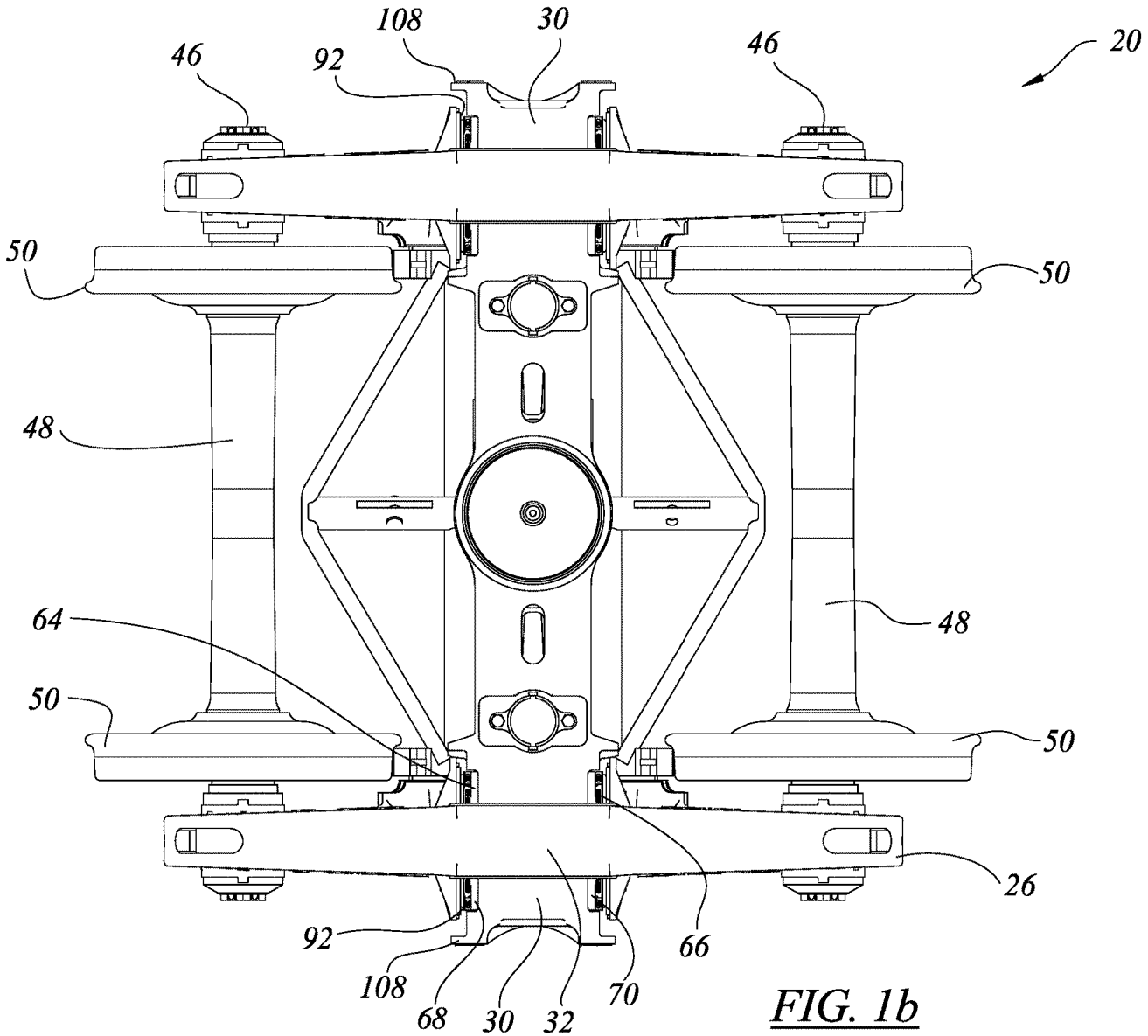
FIG. 1*b* shows a top view of the railroad car truck of FIG. 1*a;*
Figure 1C:
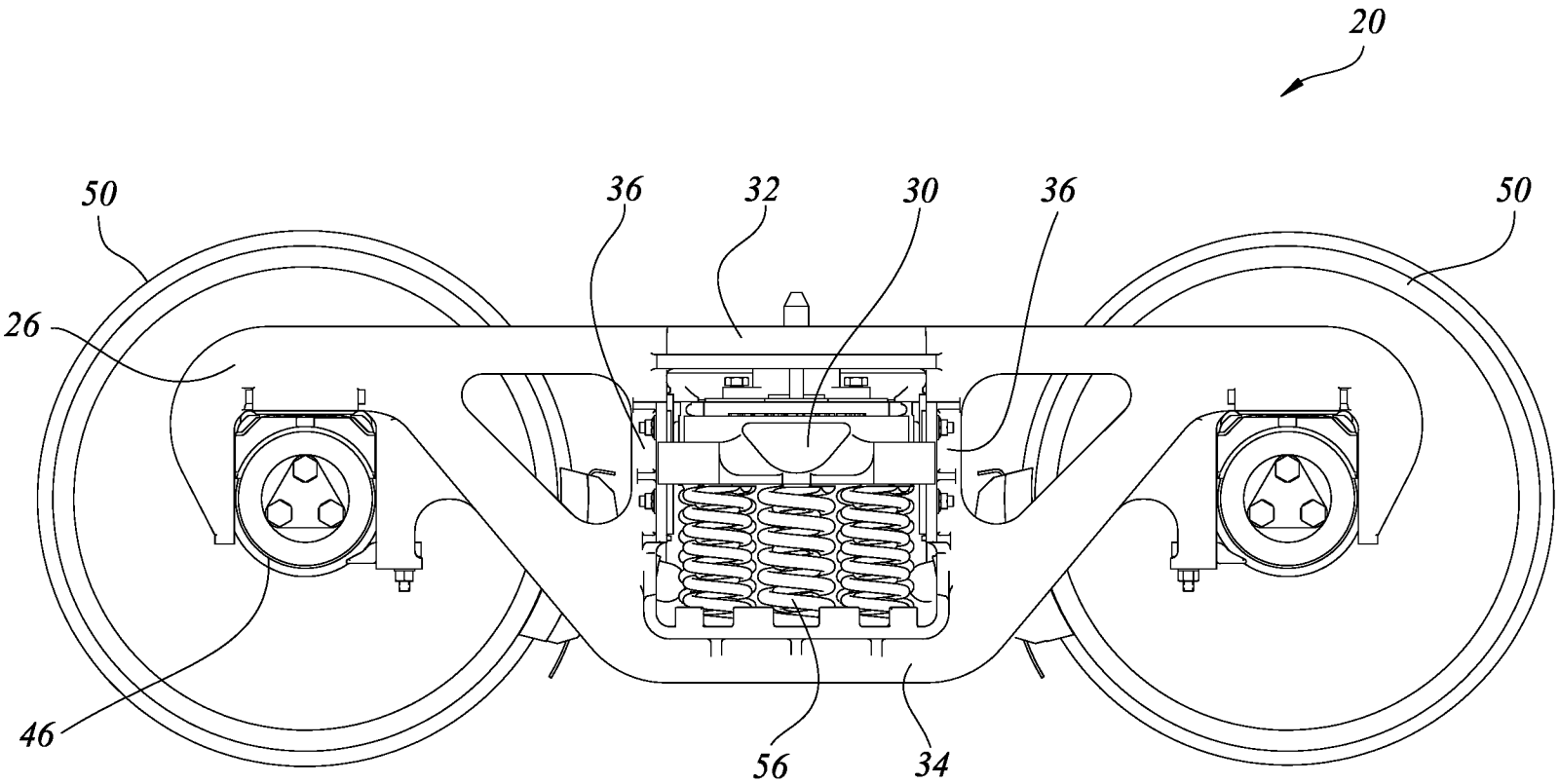
FIG. 1*c* shows a side view of the railroad car truck of FIG. 1*a;*
Figure 1D:
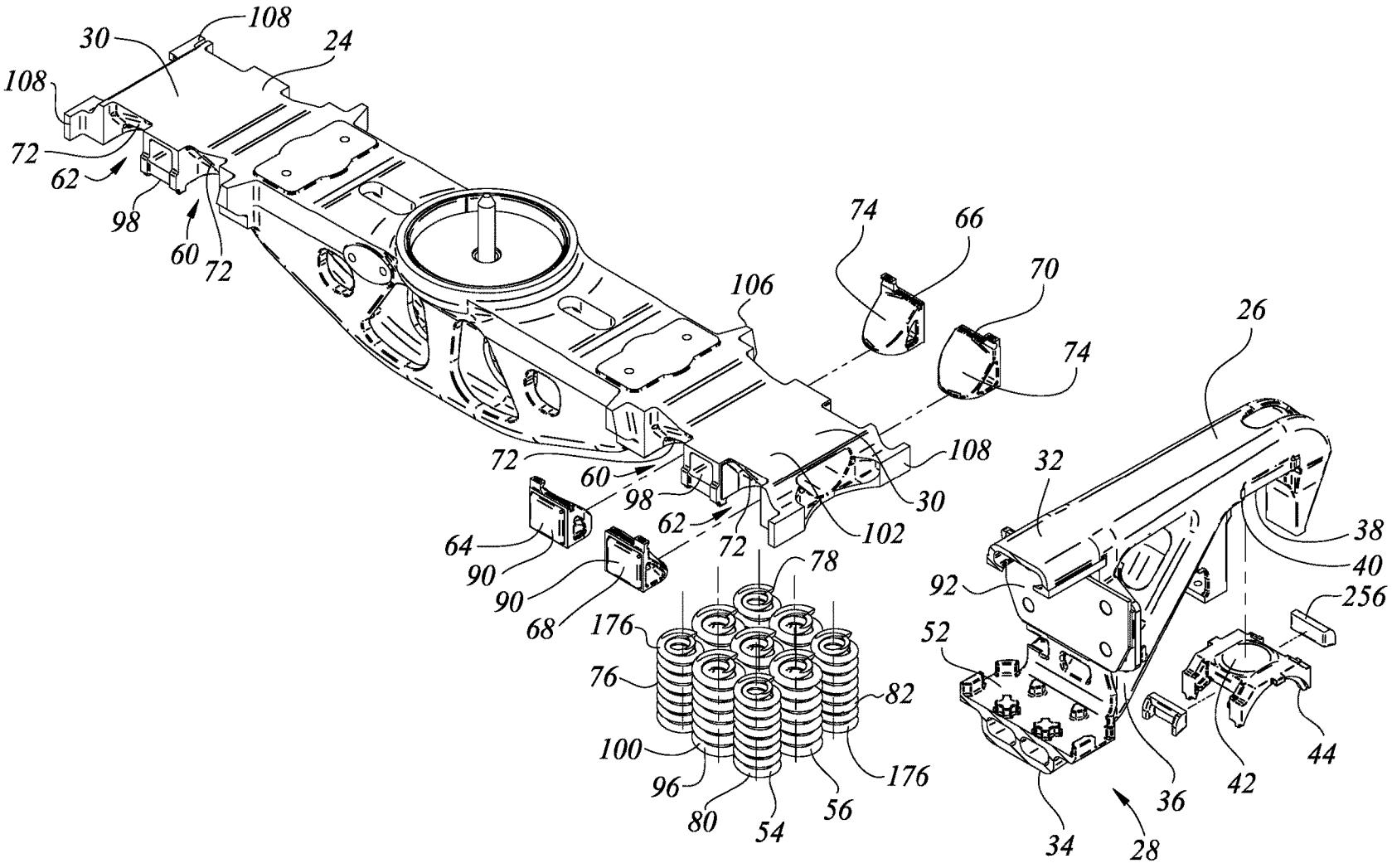
FIG. 1*d* shows an exploded view of a portion of the truck of FIG. 1*a;*
Figure 2A:
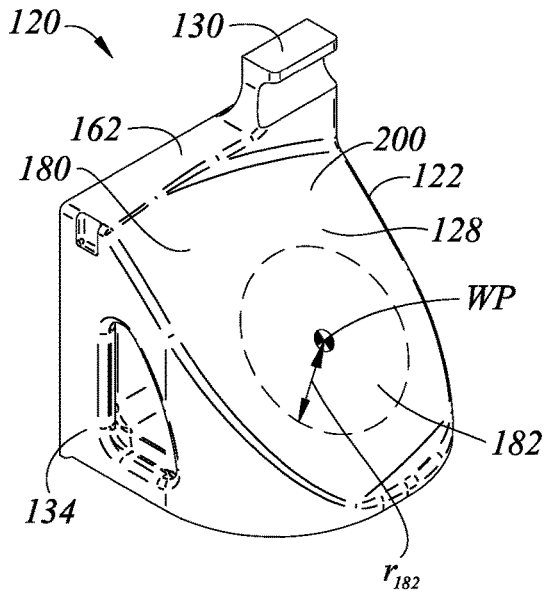
FIG. 2*a* is an isometric view from behind and above of a damper wedge used in the truck of FIG. 1*a;*
Figure 2B:
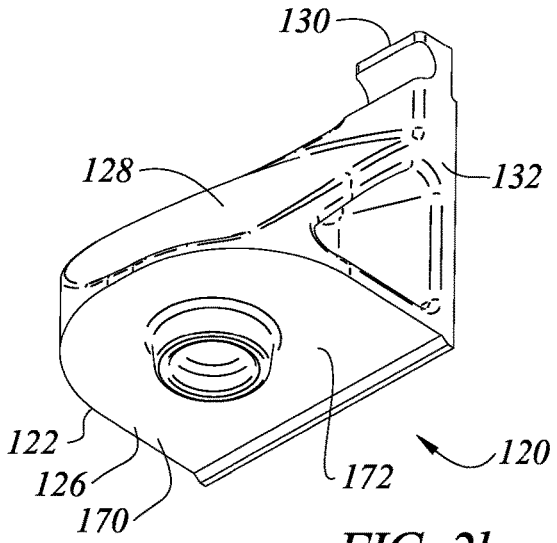
FIG. 2*b* is a view, from below and behind of the damper wedge of FIG. 2*a;*
Figure 2C:
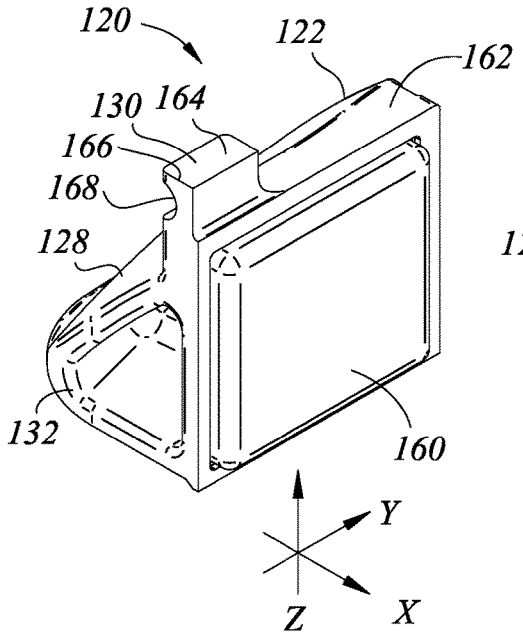
FIG. 2*c* is a view of the damper wedge of FIG. 2*a* from in front and above.
Figure 2D:
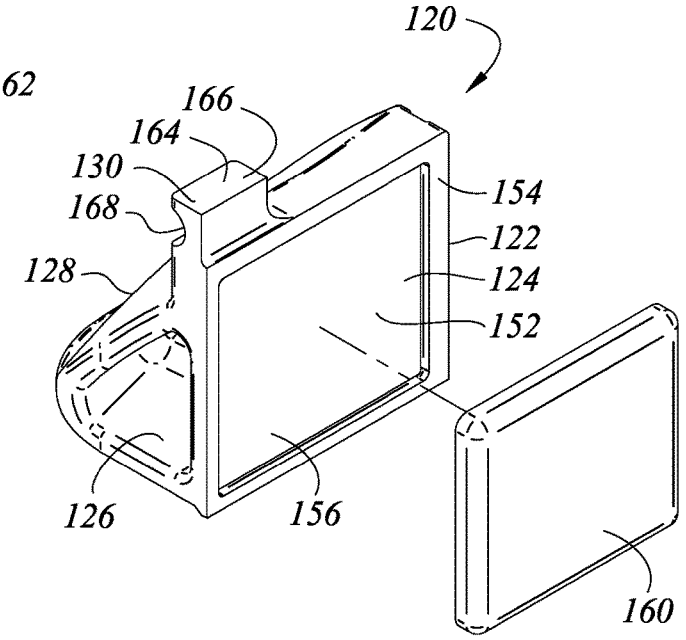
FIG. 2*d* is an exploded view of the damper wedge of FIG. 2*c* with the wear pad out prior to installation.

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology used in this specification is thought to be consistent with the customary and ordinary meanings of those terms as understood by a person of ordinary skill in the railroad industry in North America. In that regard, the Applicant incorporates by reference the Rules and Standards of the Association of American Railroads (AAR), a private body that establishes rules for interchange operation of railroad rolling stock in North America. Furthermore, this specification frequently recites multiple synonyms for a single object. The intention is that any of those synonyms, or any other synonym, may be used in respect of the same item shown in the illustrations, whether or not provided with an annotation number. The recitation of multiple synonyms is intended to convey that any synonym may be used for a given part, whether or not that synonym is used in the disclosure as filed, provided that it conforms to the meaning of the concept, function, or object conveyed on a fair reading of the disclosure, or that is fairly shown in the illustrative figures, or both.

For railroad car trucks described herein the longitudinal direction is defined as coincident with the rolling direction of the railroad car, or railroad car unit, when on tangent (that is, straight) track. In a Cartesian frame of reference, this may be defined as the x-axis, or x-direction. For a railroad car having a center sill, be it a stub sill or a straight-through center sill, the longitudinal direction is parallel to the center sill and to the top chords and side sills. Unless otherwise noted, vertical, or upward and downward, are terms that use top of rail, TOR, as a datum. In a Cartesian frame of reference, this may be defined as the z-axis, or z-direction. In the context of the railroad car truck as a whole, the term lateral, or laterally outboard, or transverse, or transversely outboard refer to a distance or orientation relative to the longitudinal centerline of the railroad car truck, or of the centerline of a centerplate at a truck center. In a Cartesian frame of reference this may be referred to as the y-axis or y-direction. Since a railroad car truck may tend to have both longitudinal and transverse axes of symmetry, a description of one half may generally also describe the other half as well, allowing for differences between right and left hand parts. Pitching is angular motion about a horizontal axis perpendicular to the longitudinal direction (i.e., rotation about an axis in the y-direction). Yawing is angular motion about a vertical or z-axis. Roll is angular motion about the longitudinal, or x-axis. In this description, the abbreviation kpsi, if used, stands for thousands of pounds per square inch. To the extent that this specification or the accompanying illustrations may refer to standards of the Association of American Railroads (AAR), such as to AAR plate sizes, those references are to be understood as at the earliest date of priority to which this application is entitled. Unless otherwise noted, it may be understood that the railroad cars described herein are of welded steel construction.

This description relates to rail car trucks and truck components. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GWR) of 142,000 lbs. Similarly, "50 Ton" corresponds to 177,000 lbs., "70 Ton" corresponds to 220,000 lbs., "100 Ton" corresponds to 263,000 lbs., and "125 Ton" corresponds to 315,000 lbs. In each case the load limit per truck is then half the maximum gross car weight on rail. Two other types of truck are the "110 Ton" truck for railcars having a 286,000 lbs. GWR and the "70 Ton Special" low profile truck sometimes used for autorack cars. In the context of trucks, a "wheelset" includes an axle and a pair of steel wheels mounted to the axle.

This application refers to friction dampers, or damper wedges, for railroad car trucks, and multiple friction damper systems. There are several types of damper arrangements, some being shown at pp. 715-716 of the 1997 *Car and Locomotive Cyclopedia*, those pages being incorporated herein by reference. Double damper arrangements are shown and described US Patent Application Publication No. US 2003/0041772 A1, Mar. 6, 2003, entitled "Railroad Freight Car With Damped Suspension", and also incorporated herein by reference. Each of the arrangements of dampers shown at pp. 715 to 716 of the 1997 *Car and Locomotive Cyclopedia* can be modified to employ a four cornered, double damper arrangement of inner and outer dampers in conformity with the principles, aspects an feature of the present invention.

In terms of general nomenclature, the damper wedges discussed herein tend to be mounted within an angled "bolster pocket" formed in an end of the truck bolster. In cross-section, each damper wedge may then have a generally triangular shape, one side of the triangle being, or having, a bearing face; a second side which might be termed the bottom, or base, forming a spring seat; and the third side being a sloped side or hypotenuse between the other two sides. The first side may tend to have a substantially planar bearing face for vertical sliding engagement against an opposed bearing face of one of the side frame columns. The second face may not be a face, as such, but rather may have the form of a socket for receiving the upper end of one of the springs of a spring group. Although the third face, or hypotenuse, may appear to be generally planar, it may tend to have a slight crown, having a radius of curvature of perhaps 60". The crown may extend along the slope and may also extend across the slope. The side faces of the damper wedges may be generally flat, and may have a coating, surface treatment, shim, or low friction pad to give a smooth sliding engagement with the sides of the bolster pocket.

During railcar operation, the side frame may tend to rotate, or pivot, through a small range of angular deflection about the end of the truck bolster to yield wheel load equalisation. The slight crown on the slope face of the damper may tend to accommodate this pivoting motion by allowing the damper to rock somewhat relative to the generally inclined face of the bolster pocket while the planar bearing face remains in planar contact with the wear plate of the side frame column. Although the slope face may have a slight crown, for the purposes of this description it will be described as the slope face or as the hypotenuse, and will be considered to be a substantially flat face as a general approximation.

In the terminology herein, damper wedges have a primary angle $\alpha$, being the included angle between (a) the sloped damper pocket face mounted to the truck bolster, and (b) the side frame column face, as seen looking from the end of the bolster toward the truck center. In some embodiments, a secondary angle $\beta$ is be defined in the plane of angle $\alpha$, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper. The secondary angle $\beta$ is defined as the lateral rake angle seen when looking at the damper wedge parallel to the plane of angle $\alpha$. As the suspension works in response to track perturbations, the forces acting on the secondary angle $\beta$ may tend to urge the damper wedge either inboard or outboard according to the angle chosen. The damper wedges are driven, or energized, by corner springs, or "side springs" of the spring groups. In terminology herein, the spring groups include corner springs (or snubber springs, wedge springs, or side springs) and main springs. The main springs seat under the bolster ends. The "main spring group" is accordingly a subset of the spring group that includes those springs seated under the bolster as opposed to those springs that seat under the damper wedges.

General Description of Truck Features

This description is made in the context and environment of railroad car trucks. To establish that context, FIG. 1*a* shows an example of a truck 20. Truck 20 of FIGS. 1*a* to 1*d* is intended to be generic, and may have different pendulum lengths, spring stiffnesses, spring arrangements, wheelbase, and window width and height, and so on. That is, truck 20 may tend to have a wheelbase in the range of 60 inches to 75 inches. As discussed below, it has a spring group having a vertical spring rate, and a four cornered damper group that has primary and secondary angles on the damper wedges. Truck 20 may have a 3×3 spring group arrangement, a 5×3 spring group arrangement, a 3:2:3 spring group arrangement, a 2×4 spring group arrangement, or such other as may be. While either truck may be suitable for a variety of general purpose uses, truck 20 may be optimized for carrying relatively low density, high value lading, such as automobiles or consumer products, for example, for carrying denser semi-finished industrial goods, such as might be carried in railroad freight cars for transporting rolls of paper; or for carrying dense liquid or aggregate materials such as coal, ballast, grains, flour, potash, liquid petro-chemicals, and so on. Truck 20 is thus intended to be symbolic of a wide range of truck types. Truck 20 is symmetrical about its longitudinal (x-z plane) and transverse, or lateral (y-z plane) centerline planes. Where reference is made to a side frame, it will be understood that the truck has first and second side frames, first and second spring groups, and so on.

Truck 20 has a truck bolster 24 and side frames 26. Each side frame 26 has a generally rectangular side frame window 28 that accommodates one of the ends 30 of the bolster 24. The upper boundary of window 28 is defined by the side frame arch, or compression member identified as top chord member 32, and the bottom of window 28 is defined by a tension member identified as bottom chord 34. The fore and aft vertical sides of window 28 are defined by side frame columns 36. The ends of the tension member sweep up to meet the compression member. At each of the swept-up ends of side frame 26 there are side frame pedestal fittings, or pedestal seats 38. Each pedestal seat 38 accommodates an upper fitting. The upper fitting may be a flat plate seat, or it may have a curvature. The fitting may be termed a rocker or a seat, depending on context, as described and discussed below. This upper fitting, whichever it may be, is indicated generically as 40. Fitting 40 which may be called the "seat", engages, or is engaged by, a mating fitting 42 of the upper surface of a bearing adapter 44. Fitting 42 may be the rocker that engages the "seat" of fitting 40, or the roles of seat and rocker may be reversed. Bearing adapter 44 engages, i.e., sits on, a bearing 46 mounted on one of the ends of one of the axles 48 of the truck adjacent one of the wheels 50. The wheelset includes axle 48 and wheels 50 mounted at either end thereof. Bearing 46 may be, and as shown is, a sealed roller bearing. Sealed roller bearings of standard sizes are widely used in North American practice. A fitting 40 is located in each of the fore and aft pedestal fittings 38, the fittings 40 being longitudinally aligned so side frame 26 can swing sideways relative to the truck's rolling direction.

The relationship of the mating fittings 40 and 42 is described below in relation to the illustrations of FIGS. 4*a*-4*e*. The relationship of these fittings determines part of the overall relationship between an end of one of the axles 48 of one of the wheelsets and the side frame pedestal. That is, in determining the overall response, the degrees of freedom of the mounting of the axle end in the side frame pedestal involve a dynamic interface across an assembly of parts, such as may be termed a wheelset to side frame interface assembly, that may include the bearing, the bearing adapter, an elastomeric pad, if used, a rocker if used, and the pedestal seat mounted in the roof of the side frame pedestal, whether cast, machined, or fabricated and installed as a separate part. Several different embodiments of this wheelset to side frame interface assembly are possible. To the extent that bearing 46 has a single degree of freedom, namely rotation about the wheel shaft axis, analysis of the assembly can be focused on the bearing to pedestal seat interface assembly, or on the bearing adapter to pedestal seat interface assembly. For the purposes of this description, items 40 and 42 are intended generically to represent the combination of features of a bearing adapter and pedestal seat assembly defining the interface between the roof of the side frame pedestal and the bearing adapter, and the six degrees of freedom of motion at that interface, namely vertical, longitudinal and transverse translation (i.e., translation in the z, x, and y directions) and pitching, rolling, and yawing (i.e., rotational motion about the y, x, and z axes respectively) in response to dynamic inputs.

The bottom chord or tension member of side frame 26 may have a basket plate, or lower spring seat 52 rigidly mounted thereto. Although truck 20 may be free of unsprung lateral cross-bracing, whether in the nature of a transom or lateral rods, in the event that truck 20 is taken to represent a "swing motion" truck with a transom or other cross bracing, the lower rocker platform of spring seat 52 may be mounted on a rocker, to permit lateral rocking relative to side frame 26. Spring seat 52 may have retainers for engaging the springs of a spring set, or spring group 54, sometimes referred to as the "main spring group", 56, whether internal bosses or a peripheral lip, for discouraging the escape of the bottom ends of the springs. The spring group 56, is captured between the distal end 30 of bolster 24 and spring seat 52, being placed under compression by the weight of the rail car body and lading that bears upon bolster 24 from above.

Bolster 24 has double, inboard and outboard, bolster pockets 60, 62 on each face of the bolster at the outboard end (i.e., for a total of 8 bolster pockets per bolster, 4 at each end). Bolster 24 is symmetrical about the central longitudinal vertical plane of the bolster (i.e., cross-wise relative to the truck generally) and symmetrical about the vertical mid-span section of the bolster (i.e., the longitudinal plane of symmetry of the truck generally, coinciding with the railcar longitudinal center line). Each face of each end 30 of bolster 24 has accommodations or sockets, shown as a pair of spaced apart bolster pockets 60, 62, that receive dampers in the form of damper wedges 64, 66, 68, 70, respectively. Damper wedges 64, 66, 68 and 70 may also, or alternatively, be referred to as dampers, or friction wedges, or friction dampers, or friction damper wedges, the terminology being interchangeable. Bolster pocket 60 is laterally inboard of bolster pocket 62 relative to side frame 26 of truck 20 more generally. Optionally, wear inserts, e.g., of specially hardened, machined material, may be mounted in pockets 60, 62 along the angled damper wedge faces.

As can be seen, and as is discussed in greater detail below, damper wedges 64, 66, 68, 70 have a primary angle, $\alpha$ as measured between vertical and the angled trailing vertex of the larger face. For the embodiments discussed herein, primary angle $\alpha$ may tend to lie in the range of 30-50 degrees, possibly about 40-45 degrees. This same angle $\alpha$ is matched by the facing surface of the bolster pocket, be it 60 or 62. A secondary angle $\beta$ gives the inboard, (or outboard), rake of the sloped surface of the damper wedge. The true rake angle can be seen by sighting along plane of the sloped face and measuring the angle between the sloped face and the planar outboard face. The rake angle is the complement of the angle so measured. The rake angle may tend to be greater than 5 degrees, may lie in the range of 5 to 20 degrees, and is preferably about 10 to 15 degrees. A modest rake angle may be desirable.

When the truck suspension works in response to track perturbations, the damper wedges may tend to work in their pockets. The rake angles yield a component of force tending to bias the inboard face of outboard damper wedge 68 (or 70) inboard against the opposing inboard face of bolster pocket 62. Similarly, the outboard face of damper wedge 64 (or 66) may tend to be biased toward the outboard planar face of inboard bolster pocket 60. These inboard and outboard faces of the bolster pockets may be lined with a low friction surface pad, or may be left as a metal surface, as shown. The left hand and right hand biases of the damper wedges may tend to keep them closer together, and, by keeping them against the planar facing walls, may tend to aid in discouraging twisting of the dampers in the respective pockets.

Bolster 24 includes a middle land 98 between pockets 60, 62, against which spring 96 works. Middle land 98 is such as might be found in a spring group that is three (or more) coils wide. However, whether two, three, or more coils wide, and whether employing a central land or no central land, bolster pockets can have both primary and secondary angles as illustrated, with or without wear inserts. Where a central land, e.g., land 98, separates two damper pockets, the opposing side frame column wear plates, such as indicated a friction wear plate 92, discussed below, need not be monolithic. That is, each of the side frame column wear plates 92 could have the form of two wear plate regions such as could be provided, one opposite each of the inboard and outboard damper wedges, presenting planar surfaces against which the front face of the damper wedges can bear. The normal vectors of those regions may be parallel, the surfaces may be co-planar and perpendicular to the long axis of the side frame, and may present a clear, un-interrupted surface to the friction faces of the dampers.

As noted above, bolster pockets 60, 62 accommodate fore and aft pairs of first and second, laterally inboard and laterally outboard friction damper wedges 64, 66 and 68, 70, respectively. Each bolster pocket 60, 62 has an inclined face, or damper seat 72, that mates with a similarly inclined hypotenuse face 74 of the damper wedge, 64, 66, 68 and 70. Damper wedges 64, 66 each sit over a first, inboard corner spring 76, 78, and damper wedges 68, 70 each sit over a second, outboard corner spring 80, 82. Angled faces 74 of damper wedges 64, 66 and 68, 70 (discussed in greater detail below) ride against the angled faces of respective seats 72. Middle end spring 96 bears on the underside of a land 98 located intermediate bolster pockets 60 and 62. The top ends of the central row of springs, 100, seat under the main central portion 102 of the end of bolster 24. In this four corner arrangement, each damper is individually sprung by one or another of the springs in the spring group.

The static compression of the springs under the weight of the car body and lading tends to act as a spring loading to bias the damper to act along the slope of the bolster pocket to force the friction surface against the side frame. Friction damping is provided when the vertical sliding faces 90 of the damper wedges 64, 66 and 68, 70 ride up and down on friction wear plates 92 mounted to the inwardly facing surfaces of side frame columns 36. Friction wear plates 92 are accordingly also equivalently referred to as the side frame column wear plates 92. In this way the kinetic energy of the motion is, in some measure, converted through friction to heat. This friction may tend to damp out the motion of the bolster relative to the side frames. When a lateral perturbation is passed to wheels 50 by the rails, rigid axles 48 may tend to cause both side frames 26 to deflect in the same direction. The reaction of side frames 26 is to swing, like pendula, on the upper rockers. The weight of the pendulum and the reactive force arising from the twisting of the springs may then tend to urge the side frames back to their initial position. The tendency to oscillate harmonically due to track perturbations may tend to be damped out by the friction of the dampers on wear plates 92.

As compared to a bolster with single dampers, such as may have single damper wedges mounted on the side frame centerline, the use of doubled dampers such as spaced apart pairs of damper wedges 64, 68 may tend to give a larger moment arm, for resisting parallelogram deformation of truck 20 more generally. Use of doubled dampers yields a greater restorative "squaring" force to allow the truck to flex, i.e., deflect, in response to perturbations, but then to return the truck resiliently to a square orientation than for a single damper alone with the restorative bias, namely the squaring force, increasing with increasing deflection. That is, in parallelogram deformation, or lozenging, the differential compression of one diagonal pair of springs (e.g., inboard spring 76 and outboard spring 82 may be more pronouncedly compressed) relative to the other diagonal pair of springs (e.g., inboard spring 78 and outboard spring 80 may be less pronouncedly compressed than springs 76 and 82) tends to yield a restorative moment couple acting on the side frame wear plates. This moment couple tends to rotate the side frame in a direction to square the truck, (that is, in a position in which the bolster is perpendicular, or "square", to the side frames). As such, the truck is able to flex, and when it flexes the dampers co-operate in acting as biased members working between the bolster and the side frames to resist parallelogram, or lozenging, deformation of the side frame relative to the truck bolster and to urge the truck back to the non-deflected position.

The foregoing explanation is made in the context of truck 20 which has a spring group 54 that has three rows facing side frame columns 36. The restoring moment in such a case would be $M_R$, the moment couple of one pair of diagonally opposed damper springs at the corner of the spring group, minus the moment couple of the other diagonally opposed pair, and, given the sloped back of the damper wedges, the restorative moment is a function of $k_c$, the vertical spring constant of the coil upon which the damper sits and is biased.

Although the embodiment shown is 3×3, there are various possible arrangements of spring groups 2×4, 3×3, 3:2:3 or 3×5 group. As shown dampers may be mounted over each of four corner positions. The coil groups can be of unequal stiffness if inner coils are used in some springs and not in others, or if springs of differing spring constant are used. Moreover, the damper springs may have a different undeflected length than the main spring coils. That is, the damper springs may be longer than the main spring coils. Thus, the pre-load deflection of the damper springs will be greater than the pre-load deflection of the main springs. This will be true in both the light car (i.e., empty) and fully laded car conditions. Accordingly, the proportionate difference (i.e., the percentage change) in energizing spring force in the damper springs will have a correspondingly smaller proportionate variation between the top and bottom of the stroke of the friction wedge over its full amplitude as compared to the main springs. In the example, the free height of corner springs 76, 78, 80 and 82 is 11" whereas the main springs are AAR standard D5 springs having a free height of 10.25".

An enhanced tendency to encourage flexibly restorative squareness at the bolster to side frame interface (i.e., through the use of four cornered damper groups) tends to reduce reliance on squareness at the pedestal to wheelset axle interface. This, in turn, may tend to provide an opportunity to employ a torsionally compliant (about the vertical axis) axle to pedestal interface assembly, and to permit a measure of self steering.

The bearing plate, namely side frame column wear plate 92 (FIG. 1*a*) is significantly wider than the through thickness of the side frames more generally, as measured, for example, at the pedestals, and may tend to be wider than has been conventionally common. This additional width corresponds to the additional overall damper span width measured fully across the damper pairs, plus lateral travel as noted above, typically allowing 1½ (+/−) inches of lateral travel of the bolster relative to the side frame to either side of the undeflected central position. That is, rather than having the width of one coil, plus allowance for travel, wear plate 92 may have the width of three coils, plus allowance to accommodate 1½ (+/−) inches of travel to either side for a total, double amplitude travel of 3" (+/−). Bolster 24 has inboard and outboard gibs 106, 108 respectively, that bound the lateral motion of bolster 24 relative to side frame columns 36. This motion allowance may be in the range of +/−1⅛ to 1¾ in., and may be in the range of 1³⁄₁₆ to 1⁹⁄₁₆ in., and can be set, for example, at 1½ in. or 1¼ in. of lateral travel to either side of a neutral, or centered, position when the side frame is undeflected.

The lower ends of the springs of the entire spring group, identified generally as 58, seat in lower spring seat 52. Lower spring seat 52 may be laid out as a tray with an upturned rectangular peripheral lip. Although truck 20 employs a spring group in a 3×3 arrangement, this is intended to be generic, and to represent a range of variations. They may represent 3×5, 2×4, 3:2:3 or 2:3:2 arrangement, or some other, and may include a hydraulic snubber, or such other arrangement of springs may be appropriate for the given service for the railcar for which the truck is intended.

Damper Wedges

The inventor has noted that how the friction pads interact with the side frame column wear plates changes the ride quality of the truck. To obtain the designed-for ride quality, it is helpful if the non-metallic wear surfaces of the non-metallic wear pads wear relatively evenly, rather than wearing disproportionately along one edge.

This wear is sensitive to the location of the contact point on the sloped side of the damper wedge to the inclined face of the bolster pocket. During operation, the damper wedges tend to move slightly in the pockets, as when the side frames yaw, pitch, and roll relative to the bolster. These deflections may appear to be small. In existing trucks the crown radius on the back of the damper is very slight. It may have an effective radius on the order of 60 inches. In one type of truck it is known to be about 40 inches, and is cylindrical to produce line contact, rather than point contact. Considering, by contrast, point contact, the crown radius allows the damper wedge to find its own fit in the damper pocket, and to tolerate relative motion of the side frame in yaw, pitch, and roll with less tendency toward jamming or binding. The use of a 60 inch radius curvature was formerly considered acceptable for this purpose of allowing the damper wedge to find its own equilibrium position. Over time, in use a wear patch, which may also be called a contact patch, 182 may form, where the back of the damper wedge has repeatedly contacted the face of the bolster pocket. This contact patch tends to wear as the faces are repeatedly placed in compression against each other. The contact patch reflects the two degrees of freedom of the rocking surface. That is, the contact patch has an extent along the primary angle slope of the back of the damper wedge and also transversely along the secondary angle bias. There will be a similar wear patch in the bolster pocket. The wear of the non-metallic wear surface of the friction pad may tend to be influenced by the forces it sees, and the forces experienced by the non-metallic wear surface of the friction pad appear to correlate to the location and size of this 2 degree of freedom contact patch.

FIGS. 2*a* to 2*d* and FIGS. 3*a*-3*i*

For the purpose of describing any of damper wedges 64, 66, 68 or 70, a representative damper wedge is indicated as 120. Although a right-hand damper wedge is shown, a left-hand damper wedge is of the same structure, and is a mirror image of the right hand damper wedge. Accordingly, the description of the right hand damper wedge will be understood to describe both parts, allowing for opposite-handedness. In that regard, damper wedge 120 is intended to be a generic representation of left hand and right hand damper wedges 64 and 68.

Figure 3B:
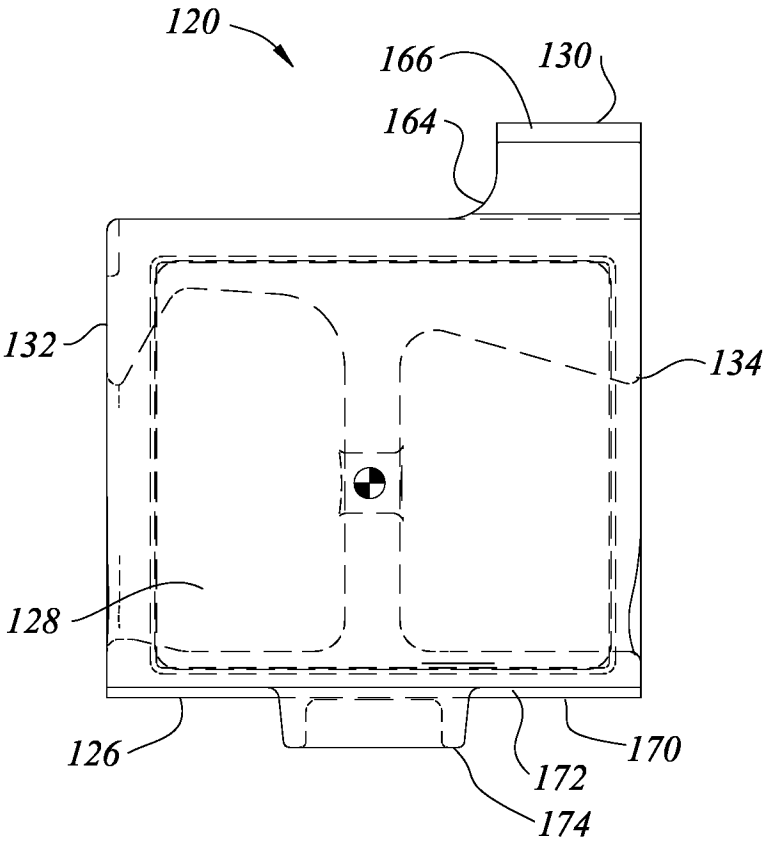
FIG. 3*b* is a rear view of the damper wedge of FIG. 3*a;*
Figure 3A:
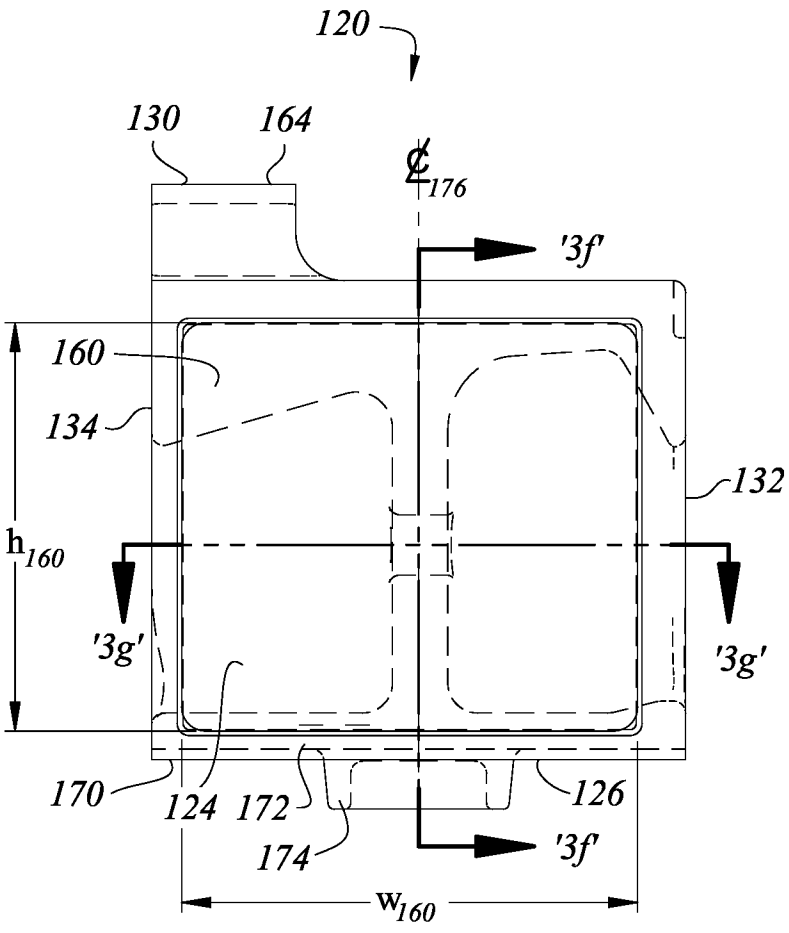
FIG. 3*a* is a front view of the damper wedge of FIG. 2*a;*
Figures 3C, 3D, 3E:
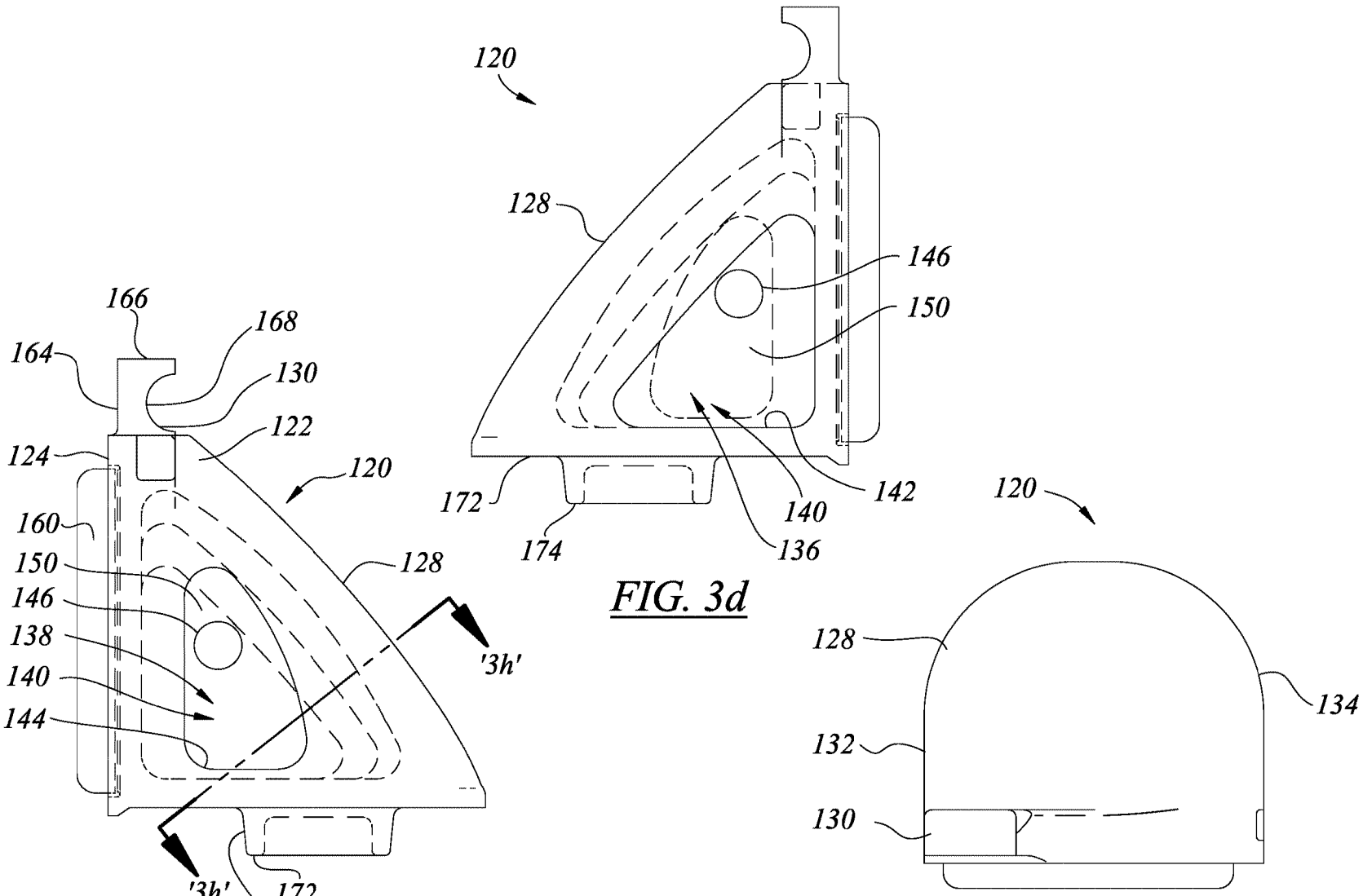
FIG. 3*c* is a large side view of the damper wedge of FIG. 3*a;*
FIG. 3*d* is a small side view of the damper wedge of FIG. 3*a;*
FIG. 3*e* is a top view of the damper wedge of FIG. 3*a;*
Figure 3G:
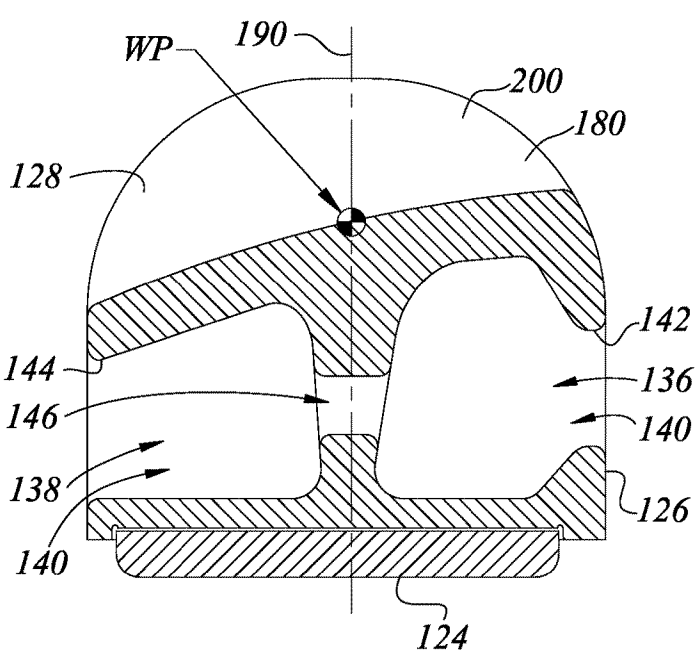
FIG. 3*g* is a sectional view in the horizontal plane indicated by section '3*g*-3*g*' in FIG. 3*a;*
Figure 3F:
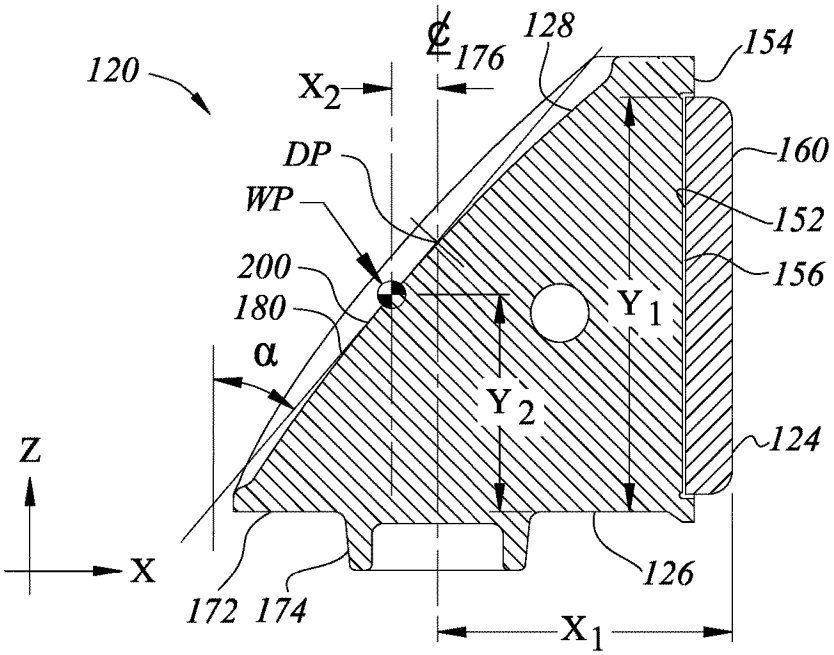
FIG. 3*f* is a sectional view on the spring seat vertical central plane indicated by section '3*f*-3*f*' in FIG. 3*a;*
Figure 3H:
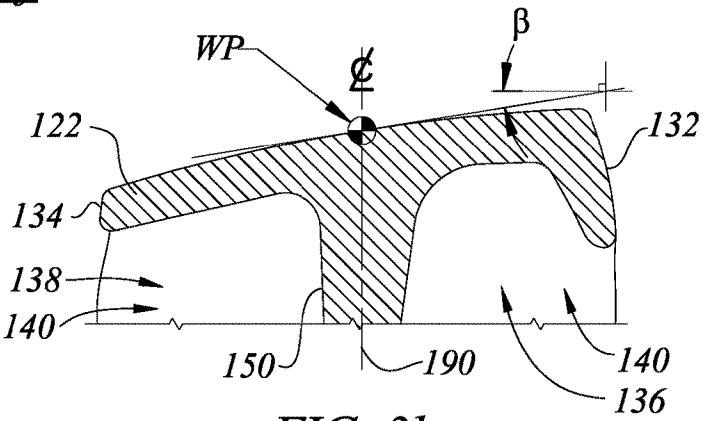
FIG. 3*h* is a sectional plane taken on the spherical radius through the working point as indicated by section '3*h*-3*h*' of FIG. 3*c;*

Damper wedge 120 has a body 122. Body 122 may be made from a common material, such as cast steel, or cast iron. As seen in side view, it is generally triangular. A first face or portion or member 124, extends vertically; a second face or member, or portion 126 extends horizontally, and a third member or face or portion 128 extends generally on a slope, and may be thought of as the hypotenuse member between member 124 and 126, the three parts thereby combining to form the generally triangular shape noted. Damper wedge 120 also has a first end face or end wall 132 and a second end face of end wall 134. In this instance, the first end face 132 is the larger end face (i.e., FIG. 3*d*) and the second end face 134 is the smaller end face (FIG. 3*c*). Damper wedge 120 has a primary angle, α, (alpha) seen in side view in FIG. 3*c*. In the embodiment illustrated, angle α is the same angle α as that of the matching, or corresponding, or associated surface of the sloped face 74 of the bolster pocket, be it 60 or 62. It is possible that the two planes need not be exactly parallel, but it is convenient both for conceptual understanding and for manufacture that they be made the same. Angle α defines the primary angle of the bolster relative to the vertical plane when the damper wedge is seen in side view. Damper wedge 120 also has a secondary damper angle, β (beta). In the example illustrated, the secondary angle of damper wedge 120 is the same as the secondary angle β of the inclined surface of the bolster pocket, be it 60 or 62. It runs transversely, and defines the lateral bias of damper wedge 120 in the pocket. The true view of secondary angle β is seen by sighting along the back of damper wedge 120 in the inclined plane of primary damper angle α. This is the view seen in FIG. 3*h*. Angle beta is the angle of the tangent plane at the point of contact, identified as the Working Point, WP, discussed below, relative to the perpendicular to end walls or end faces 132, 134 in the plane of angle α. Although angle β may be slightly different from that of the corresponding or associated bolster pocket, for ease of conceptual understanding and ease of manufacture, they may generally be assumed to be the same.

Given secondary angle β, end wall or end face 132 is larger than end wall or end face 134, and damper wedge 120 is asymmetric as viewed from behind or from above. Damper wedge 120 also has a grip or hold, or lifting member, or retainer 130 that extends upwardly from first portion or first member 124, and whose form and purpose is as described below.

Damper wedge 120 may be made as a solid casting. Alternatively, damper wedge 120 may be hollow, as shown. That is, body 122 has an internal cavity 140 bounded by items 124, 126, 128, 132 and 134. Internal cavity 140 may be, and as illustrated is, divided into two sub-compartments or chambers 136, 138 by a gusset, or partition, or web 150. Web 150 may have a central opening or hole 146. Each of end faces 132 and 134 may have a triangular, or generally triangular opening, 142, 144 respectively.

Looking at these items, the front face member, or first member 124 is planar, or generally planar, and has a rectangular or generally rectangular rim 154 that extends peripherally around a panel or web or plate or wall 152. Plate or wall 152 extends from side to side laterally between end walls 132, 134, and up and down between the forward margin of second member 126 and the forward and upward margin of third member 128. Rim 154 and wall 152 co-operate to form a socket 156 into which is mounted a wear element or wear pad or wear member 160. Any of the names "wear element", "wear pad", or "wear member" may be used interchangeably herein. This may be expressed differently, namely that a relief or rebate, or cavity, or accommodation is formed in first member 124 to define socket 156, with wall 152 forming the base or back of socket 156, and rim 154 forming the lip or retainer of the accommodation so formed. Wear member 160 may be, and in this instance is, a non-metallic friction pad. The non-metallic pad is the "friction element" of the damper wedge assembly. It has a non-metallic wear surface, that, in use, slides upward and downward in friction contact against side frame column wear plate 92. Wear member 160 is shaped to conform to, i.e., seat within the outline of, peripheral retaining rim 154. As shown, this shape is generally square or rectangular. Wear member 160 may typically be molded in place or held in place with an epoxy or other bonding method. Wear member 160 has a vertical height $h_{160}$ (in the z-direction) and a transverse width $w_{160}$ (in the y-direction). It may be taken that the half height and half width locations are coincident with the half height and half width locations of socket 156.

Lifting member 130 is formed on, and protrudes or extends upwardly from, one side of the upper edge or margin 162 of rim 154. It has the shape of an upwardly extending member 164 in which a rearwardly extending finger 166 is formed by making a semi-circular accommodation or rebate 168. The installation of damper wedges in the bolster pocket can take a bit of finesse. To facilitate this process, lifting member 130 is sized to stand forwardly of the bolster pocket and upwardly proud of the outboard gib. The end of the bolster is positioned between the side frame column wear plates, when the bolster is in position a jig tool can be used to grab and lift the damper wedge in the bolster pocket while the springs are installed. The jig tool is them removed to release the lifting member, and the damper wedge sits on the springs.

Second member 126 may be, but need not necessarily be, in the form of a plate or wall 170 that has a spring seat 172 mounted to it. In the example shown, spring seat 172 is, or includes, a boss or downward protrusion 174 that is sized to sit closely within the inner diameter of the corner spring coil, or damper spring 176 of the spring group. In this discussion the annotation 176 is intended to be a generic representation. That is, damper spring 176 can be any of corner springs 76, 78, 80 or 82 identified above. For the purpose of this discussion, although damper spring 176 is referred to as a single spring, it will be understood that it could be, and in this case it is, a double coil that has both an inner coil and an outer coil. Protrusion 174 locates the spring coil axially. That portion of plate or wall 170 that extends radially away from protrusion 174 acts as an abutment or stop determining the end of travel of the upper end of the spring, and its vertical position depending on the dynamic vertical loading condition. Protrusion 174 may be understood as a cylindrical boss having a vertical centerline that, as installed, is the same as the vertical centerline of damper spring 176, indicated as $CL_{176}$. As may be implicit, second member 126 is square to (i.e., perpendicular to) first member 124.

Third member 128 is the sloped member. It is nominally on the slope according to primary angle alpha, but it has a crown. The location of the tangent point of that crown that is the neutral contact point when the car is at rest is defined as the Working Point, WP. The formed steel wall whose outer surface defines the working surface 200 of third portion 128 is identified as 180. Inside body 122, the internal web 150 extends from front wall 152 to rear wall 180, and from both of them to bottom plate or bottom wall 170. In this position internal web 150 reinforces all three members. Web 150 is taken as having a web thickness $t_{150}$, indicated in FIG. 3*a*. In the embodiment shown, wall 180 lies above centerline $CL_{176}$ and in the same vertical plane as the Working Point, WP. That plane, notionally indicated as 190, is defined as the plane in which lies the spring centerline $CL_{176}$, and a normal vector to the friction surface of the non-metallic friction member or friction element, namely pad 160, i.e., a vector normal to wall 152. That is, the plane is square to the friction element. It is referred to as the "datum plane". In the particular example shown, the datum plane may also be the plane mid-way between the first and second end faces of body 122. For the purposes of this description, there are three ranges to be considered. There is a broad range, such as might be termed a central region, or central zone of surface 200 adjacent to and containing plane 190 which would include material lying in plane 190 and in the region of surface 200 that is within two web thicknesses $t_{150}$ of web centerline $CL_{176}$ in the cross-wise or y-direction. There is a narrower range, which lies within the projected thickness of web 150. Finally there is a narrow range, in which the rolling contact point lies in plane 190, or within ⅛ inch to either side thereof, or such that the contact surface of the male and female members in rolling point contact under load lies on, or over, plane 190. In such circumstances, a person of skill would reasonably describe Working Point WP as lying in, or lying approximately in, plane 190. The Working Point, WP lies in the tangent plane of inclined surface 200. That is, assuming that Working Point, WP, is in the Datum Plane, and assuming that the curvature of surface 200 is spherical for simplicity, the tangent plane is constructed to passes through Working Point WP inclined according to primary angle $\alpha$ and according to secondary angle $\beta$. In the embodiment illustrated that tangent plane would in the most conceptually simple example also be the plane of the sloped face of the bolster pocket. Inasmuch as this is a rolling point contact interface, the adjacent regions of surface 200 are located shy of that tangent plane, and the normal to the tangent plane at the point of contact defines a radius of the spherical surface. The center of curvature at the origin of that radius will lie to one side of datum plane 190, the radius being skewed therefrom by the $\beta$ angle as taken in the plane of the $\alpha$ angle. The location of WP may be taken as being within 1" radius of datum point DP as measured in surface 200. Expressed differently, in terms scaled to the size of damper wedge 120 itself, WP is within ¼ of the width of damper wedge 120 of DP; or, expressed differently again, WP is within ¼ of the height of non-metallic wear pad 160 of DP. In some embodiments when the parts are in rolling point contact under load, it is within the width of the contact point of datum plane 190.

In terms of physical operation, the forces applied to body 122 include the normal force to side frame column wear plate 92, the friction force in the up or down direction in the plane of wear plate 92, the vertical reaction force in the spring seat, and the angled reaction force applied to sloped surface 200. When truck 20 is at rest, on level track, in equilibrium, the point of application of the reaction on the sloped surface is at the Working Point, WP. During dynamic operation, as the bolster moves up and down relative to the side frame column and as the side frame pitches, yaws, and sways, the actual instantaneous contact point diverges from nominal working point WP. The range of motion of the side frame in pitch is small, perhaps of the order of +/−2 degrees. The range of deflection in yaw is also small, being of the order of +/−3 degrees. The range of deflection in roll is also small, being, likewise of the order of +/−3 degrees. The squirming of damper wedge 120 during operation occurs within these ranges, and produces a "wear patch", which may also be called a "contact patch", 182 on the sloped surface 200 of damper wedge 120 where rolling contact actually occurs, and forms a worn area on both surface 200 and on the sloped contact surface of the bolster pocket. Contact within the wear patch varies in a random, or largely random, manner as the truck moves, the track perturbations being assumed to be an input white noise function over time. The contact patch is a feature of the two-degree of freedom contact relationship of damper wedge 120 and bolster pocket 60 (or 62, as may be) extends both along the curvature of the sloped surface in the up-slope and down-slope sense, but also in the left and right cross-wise, or transverse sense, and tends to have a circular or elliptic shape associate with rolling point contact.

For a given angular deflection of side frame 26 in yaw or pitch, excursion of the instantaneous rolling point contact from Working Point WP is a function of the curvature of the back of slope surface 200. If the curvature has a large radius, such as the default 60" radius found in some existing conventional dampers, the lateral excursion in the y-direction in yaw, or the arc-wise displacement excursion in the up-slope or down-slope direction in pitch will be relatively large. Where that radius is smaller, the excursion will be smaller. In this discussion, the curvature along the slope need not be the same as the curvature across the slope. They could be different, as in an ellipse. However, it may be convenient that it be the same, such that the sloped surface is a partial spherical section of a single radius. In any case, the inventor has found that the wear patch zone becomes smaller when the radius of curvature becomes smaller, and that the performance of the damper, and damper wear life, improves where the radius is less than 45 inches. The improvement is notably better where the radius is less than 40 inches. In the inventor's observation it is helpful for the radius to be in the range of 15 to 30 inches. To that end, the embodiment illustrated is intended to represent a 20" radius, or approximately a 20 inch radius, +/−½ inch or +/−1 inch, as may be. This can be expressed differently. In the embodiment shown, the radius, $r_{182}$, of wear patch 182 is 2 inches or less. Expressed in parametric terms, the radius of wear patch 182 is less than half the width of damper wedge 120. Alternatively, the radius of wear patch 182 is less than 10% of the radius of curvature of surface 200. In the event that the curvatures had different radii to produce an ellipse having a minor axis and a major axis, those axes would replace radius $r_{182}$.

As above, in the example shown, surface 200 is formed on a curvature. Looking at FIG. 3*f*, the vertical axis of damper spring 176 intersects surface 200 at a slope datum point DP. The location of WP relative to DP can vary, depending on the geometry of the curvature of surface 200. The point contact of WP may be placed in the range of ⅛ to ⅝ offset rearwardly away in the x-direction from non-metallic friction element 160. In this example, the term "rearwardly" from DP also means "downslope". This offset can also be expressed in terms of the arc-length distance along surface 200 from DP. It can also be expressed as a proportion of the offset distance from the contact plane of the friction element with the side frame column wear surface, i.e., that surface being in the same plane as the front face of the non-metallic wear member. In the examples shown, that parametric range may be roughly 1/32 to 5/32 of the overall height of the surface of non-metallic wear member 160.

In one embodiment, the working point WP is offset rearwardly (i.e., downslope) in the x-direction (away from the front face non-metallic friction pad) between about ¼" and about ⅝". In one particular embodiment it is offset about 0.56", or 9/16". In taking these distances in proportion to the offset of the front face of the friction pad, the front edge of rim 154 is offset forwardly about 2⅝". Looking at FIG. 3*f*, in another embodiment, the non-metallic surface if offset from said axial centerline by a first distance, $x_1$; the Working Point is offset from said centerline by a second distance $x_2$; and a ratio of $x_1$:$x_2$ is in the range of one of (a) 21:2 to 21:8; and (b) 10:3 to 40:3. In one embodiment that ratio is about 5:1. In another way of expressing this, the non-metallic wear surface has an overall height $y_{160}$. In one embodiment, Working Point WP lies in the range of ⅜ to ⅝ of $y_{160}$ up the height of said non-metallic wear surface.

In the mechanical system described above, there is a single point rolling contact relationship established between the damper wedge sloped surface and the corresponding mating sloped surface of the bolster pocket. That same relationship can also be established by inverting the relationship such that the planar surface is the sloped surface of damper wedge 120 and the surface of curvature is the surface of the bolster pocket. That is, in a mathematical sense, it is to some extent arbitrary which surface is the male surface, and which surface is the female surface. In the further alternative, both surfaces may be formed on a curve, and one of the surfaces could be cylindrical rather than spherical. However, in the embodiments shown the mating surfaces are machined surfaces, and practicality of manufacture may lead to the flat, planar surface being formed in the bolster pocket, and the surface of curvature being formed on the smaller, lighter, less cumbersome, more easily machined damper wedge. Nonetheless, this specification is intended to encompass both possibilities as equivalents under the doctrine of equivalents.

Damper wedge 120 may provide friction damping with little or no "stick-slip" behaviour, but rather friction damping for which the co-efficients of static and dynamic friction are equal, or only differ by a small (less than about 20%, perhaps less than 10%) difference. Wedge 120 may be used in truck 20 in conjunction with a bi-directional bearing adapter as shown in FIGS. 4*a*-4*e* described herein. Wedge 120 may also be used in a four cornered damper arrangement, as in truck 20, for example. The wear element, i.e., wear member 160 may be formed of a brake lining material, and side frame column wear plate 92 may be formed from high hardness steel.

Damper wedge 120 has a footprint having a vertical extent somewhat greater than the vertical extent of sloped seat of face 74. Sloped seat of face 74 is inclined at a primary angle α, and a secondary angle β. This allows for movement and wear. The lifting lug, of lifting member 130 is mounted on the upper margin, and is visible from above after installation.

The vertical face of first portion of first member 124 of friction damper wedge 120 has a bearing surface having a co-efficient of static friction, $\mu_s$, and a co-efficient of dynamic or kinetic friction, $\mu_k$, that may tend to exhibit little or no "stick-slip" behaviour when operating against the wear surface of wear plate 92. In one embodiment, the co-efficients of friction are within 10% of each other. In another embodiment the co-efficients of friction are substantially equal and may be substantially free of stick-slip behaviour. In one embodiment, when dry, the co-efficients of friction may be in the range of 0.10 to 0.45, may be in the narrower range of 0.15 to 0.35, and may be about 0.30. Friction damper wedge 120 may have a friction face coating, or may be a bonded pad, such as 160, having these friction properties. Bonded pad 160 may be a polymeric pad or coating. In another embodiment, the co-efficients of static and dynamic friction are substantially equal. The co-efficient of dynamic friction may be in the range of 0.10 to 0.30, and may be about 0.20.

FIGS. 4*a*-4*e*

The rocking interface surface of the bearing adapter might have a crown, or a concave curvature, like a swing motion truck, by which a rolling contact on the rocker permits lateral swinging of the side frame. The bearing adapter to pedestal seat interface might also have a fore-and-aft curvature, whether a crown or a depression, and that, for a given vertical load, this crown or depression might tend to present a more or less linear resistance to deflection in the longitudinal direction, much as a spring or elastomeric pad might do.

The pendulum stiffness is directly proportional to pendulum weight, and, for small angles of deflection, can be taken as proportional to the angular deflection, in a geometric relationship that approximates f=kx. A pendulum may tend to maintain a general proportionality between the weight borne by the wheel and the stiffness of the self-steering mechanism as the lading increases, and thereby tend to give proportionate steering whether the car is empty or fully laden. These stiffnesses are geometric stiffnesses, rather than spring stiffnesses.

FIGS. 4*a*-4*e* show a bearing adapter and pedestal seat assembly. Bearing adapter 44 has a lower portion 212 that seats on bearing 46 on axle 48. Bearing adapter 44 has an upper portion 214 that has a male bearing adapter interface portion 216. A mating female rocker seat interface portion 218 is mounted within the roof 220. Upper fitting, i.e., female portion 218 may be a flat planar surface. When the side frames are lowered over the wheel sets, the end reliefs, or channels 228 lying between the bearing adapter corner abutments 232 seat between the respective side frame pedestal jaws 230. With the side frames in place, bearing adapter 44 is thus captured in position with the male and female portions (216 and 218) of the adapter interface in mating engagement.

Bearing adapter 44 may have a central body portion 254 of the adapter has been trimmed to be shorter longitudinally, and the inside spacing between the corner abutment portions has been widened somewhat, to accommodate the installation of an auxiliary centering device, or centering member, or centrally biased restoring member in the nature of, for example, elastomeric bumper pads, such as those identified as resilient pads, or members 256. Members 256 may be considered a form of restorative centering element, and may also be termed "snubbers" or "bumper" pads.

Figure 5A:
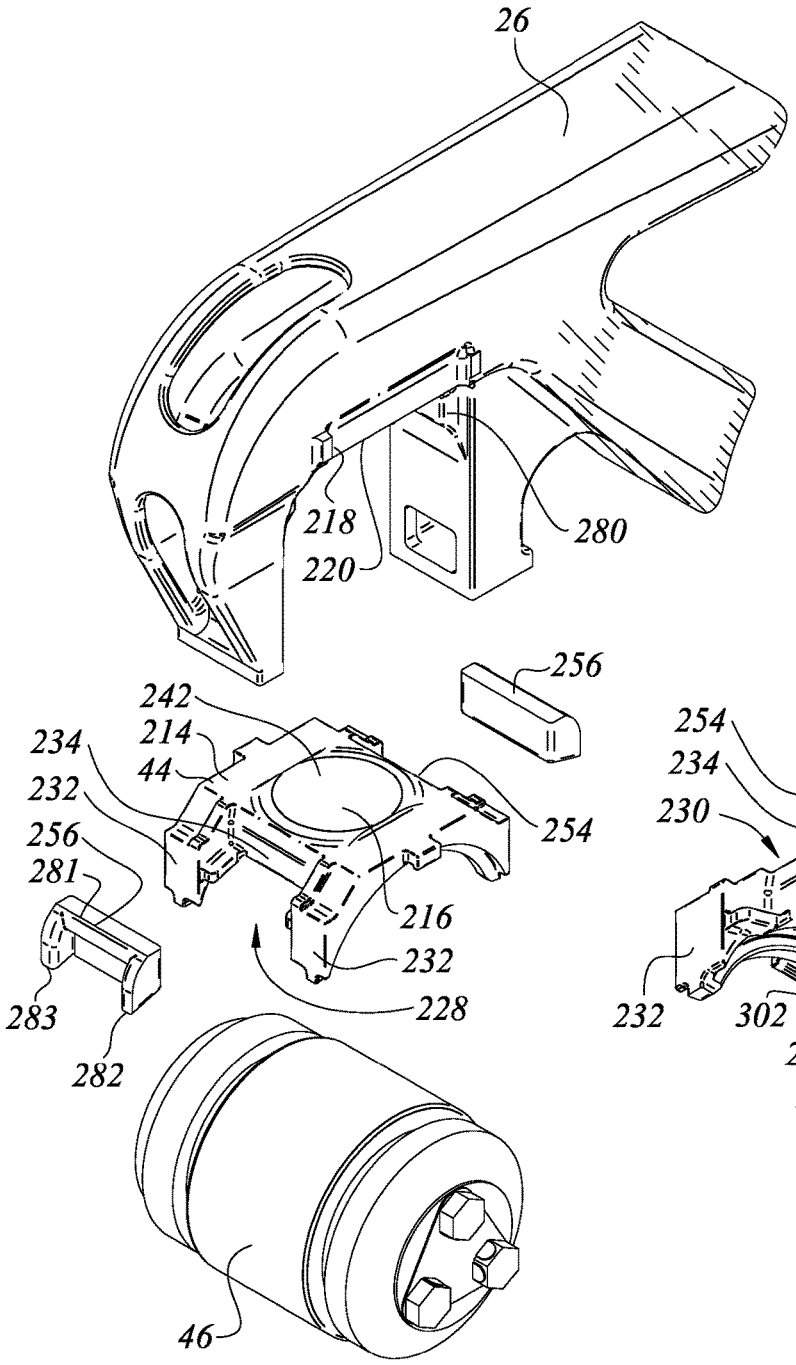
FIG. 5*a* shows an exploded isometric view of the side frame of FIG. 4*a* with the bearing, bearing adapter, and bearing adapter snubbers.
Figure 5B:
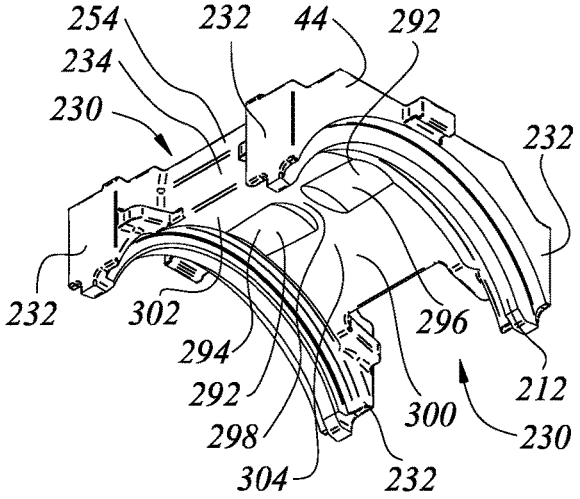
FIG. 5*b* shows the underside of the bearing adapter of FIG. 5*a;*
Figure 6A:
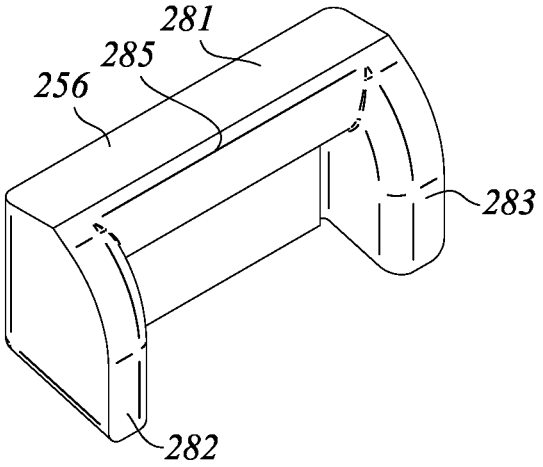
FIG. 6*a* shows an isometric view of one of the snubbers of FIG. 5*a;*
Figure 6B:
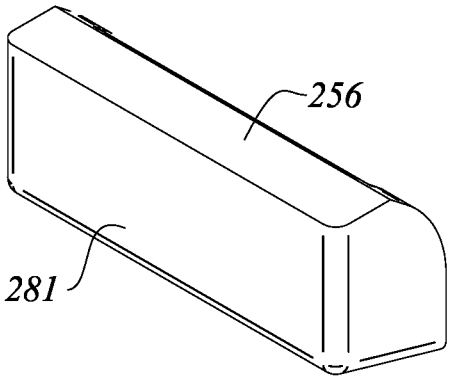
FIG. 6*b* shows an opposite isometric view of the snubber of FIG. 6*a;*
Figure 6C:
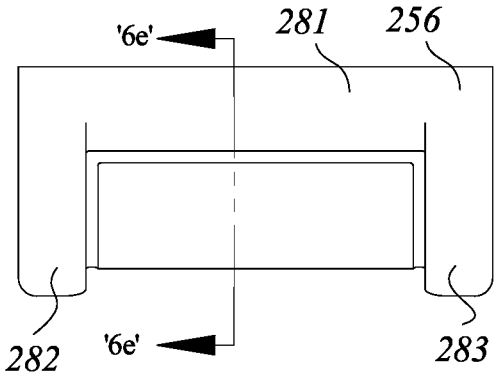
FIG. 6*c* shows a front view of the snubber of FIG. 6*a;*
Figure 6D:
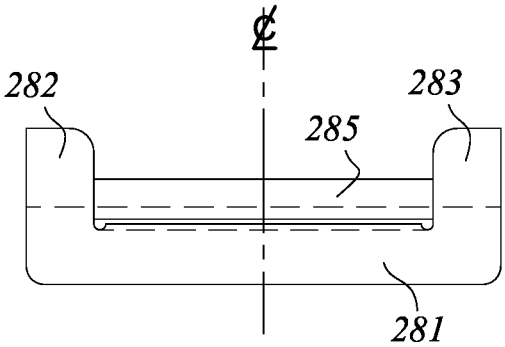
FIG. 6*d* shows a bottom view of the snubber of FIG. 6*a*.
Figure 6E:
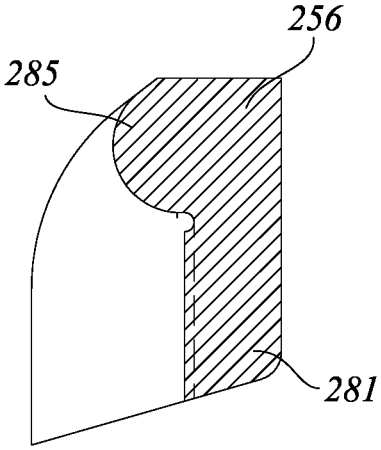
FIG. 6*e* shows the snubber of FIG. 6*c* taken on section '6*e*-6*e*' of FIG. 6*c;*
Figure 7A:
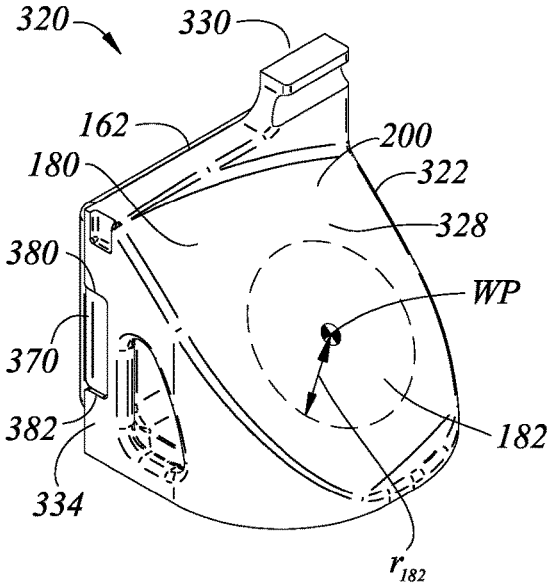
FIG. 7*a* is an isometric view from behind and above of an alternative damper wedge assembly to that of FIG. 2*a*, for use used in the truck of FIG. 1*a;*
Figure 7B:
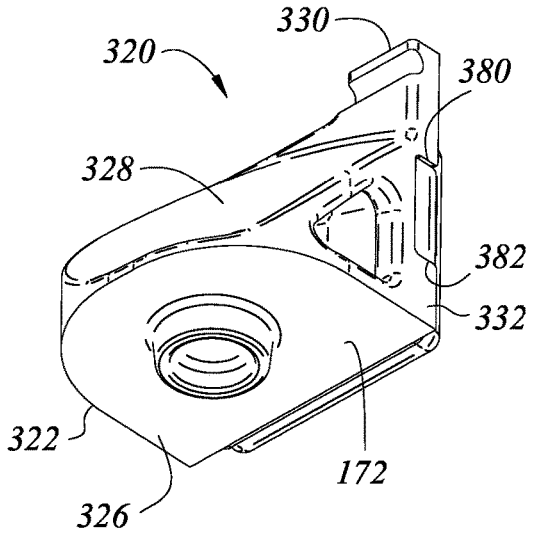
FIG. 7*b* is a view, from below and behind of the damper wedge assembly of FIG. 7*a;*
Figure 7C:
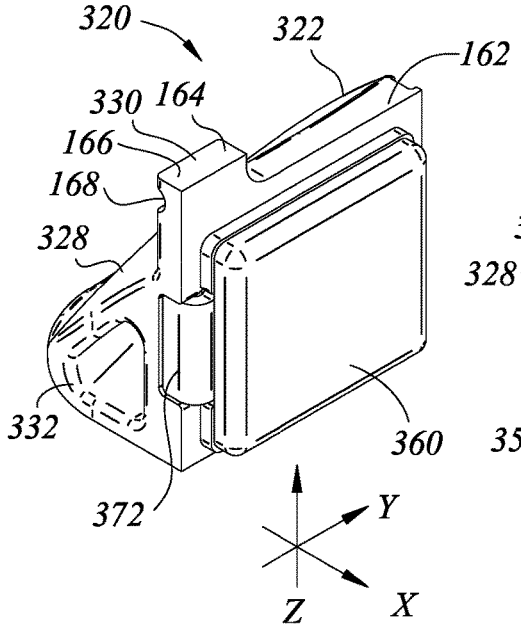
FIG. 7*c* is a view of the damper wedge assembly of FIG. 7*a* from in front and above.
Figure 7D:
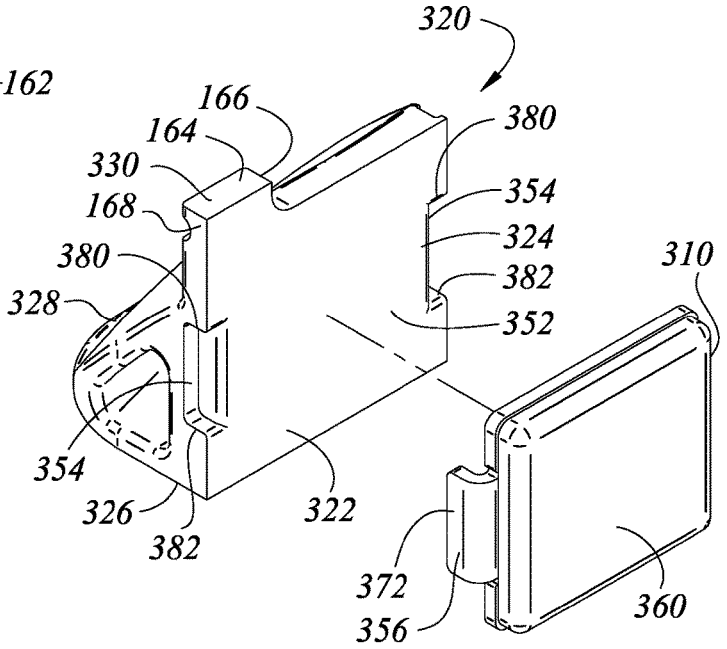
FIG. 7*d* is an exploded view of the damper wedge assembly of FIG. 7*c* with the wear pad out prior to installation.

As shown in FIGS. 6*a*-6*e*, resilient members 256 may have the general shape of a channel, having a central, or back, or transverse, or web portion 281, and a pair of left and right hand, flanking wing portions 282, 283. Wing portions 282 and 283 may tend to have downwardly and outwardly tending extremities that may tend to have an arcuate lower edge such as may seat over the bearing casing. The inside width of wing portions 282 and 283 may be such as to seat snugly about the sides of thrust blocks 280. A transversely extending lobate portion 285, running along the upper margin of web portion 281, may seat in a radiused rebate 284 between the upper margin of thrust blocks 280 and the end of pedestal seat fitting 40. The inner lateral edge of lobate portion 285 may tend to be chamfered, or relieved, to accommodate, and to seat next to, the end of pedestal seat 40. FIGS. 5*a* and 5*b* show views of bearing adapter 44, and elastomeric bumper pad members 256, as an assembly for insertion between bearing 46 and side frame 26.

Bearing adapter 44 may also have underside relief or grooving, 292 in the nature of a pair of laterally extending tapered lobate depressions, cavities, or reliefs 294, 296 separated by a central bridge region 298 having a deeper section and flanks that taper into reliefs 294, 296. Reliefs 294, 296 may have a major axis that runs laterally with respect to the bearing adapter itself, but, as installed, runs axially with respect to the axis of rotation of the underlying bearing. The absence of material at reliefs 294, 296 leaves a generally H-shaped footprint on the circumferential surface 300 that seats upon the outside of bearing 46, in which the two side regions, or legs, of the H form lands or pads 302, 304 joined by a relatively narrow waist, namely bridge region 298. To the extent that the undersurface of the lower portion of bearing adapter 44 conforms to an arcuate profile, such as may accommodate the bearing casing, reliefs 294, 296 may tend to run, or extend, predominantly along the apex of the profile, between the pads, or lands, that lie to either side. This configuration may tend to spread the rocker rolling contact point load into pads 302, 304 and thence into bearing 46. Bearing life may be a function of peak load in the rollers. By leaving a space between the underside of the bearing adapter and the top center of the bearing casing over the bearing races, reliefs 294, 296 may tend to prevent the vertical load being passed in a concentrated manner predominantly into the top rollers in the bearing. Instead, it may be advantageous to spread the load between several rollers in each race. This may tend to be encouraged by employing spaced apart pads or lands, such as pads 302, 304, that seat upon the bearing casing. Central bridge region 298 may seat above a section of the bearing casing under which there is no race, rather than directly over one of the races.

Male portion 216 has been formed to have a generally upwardly facing surface 242 that has both a first curvature $r_1$ to permit rocking in the longitudinal direction (FIGS. 4*d*, 4*e*), and a second curvature $r_2$ (FIGS. 4*b*, 4*c*) to permit rocking (i.e., swing motion of the side frame) in the transverse direction. Similarly, in the general case, female portion 218 has a surface having a first radius of curvature $R_1$ in the longitudinal direction, and a second radius of curvature $R_2$ in the transverse direction. The engagement of $r_1$ with $R_1$ permits longitudinal rocking motion, with resistance proportional to the weight on the wheel. That is to say, the resistance to angular deflection is proportional to weight rather than being a fixed spring constant. This may tend to yield passive self-steering in both the light car and fully laden conditions. This relationship is shown in FIGS. 4*d* and 4*e*. FIG. 4*d* shows the centered, or at rest, non-deflected position of the longitudinal rocking elements. FIG. 4*e* shows the rocking elements at their condition of maximum longitudinal deflection. FIG. 4*d* represents a local, minimum potential energy condition for the system. FIG. 4*e* represents a system in which the potential energy has been increased by virtue of the work done by force F acting longitudinally in the horizontal plane through the center of the axle and bearing, $C_B$, which will tend to yield an incremental increase in the height of the pedestal. Put differently, as the axle is urged to deflect by the force, the rocking motion may tend to raise the car, and thereby to increase its potential energy.

In general, the deflection may be measured either by the angular displacement of the axle centerline, $\theta_1$, or by the angular displacement of the rocker contact point on radius $r_1$, shown as $\theta_2$. End face 234 of bearing adapter 44 is inclined at an angle $\eta$ from the vertical. A typical range for $\eta$ might be about 3 degrees of arc. A typical maximum value of $\delta_{long}$ may be about +/−3/16" to either side of the vertical, at rest, center line.

Figure 4C:
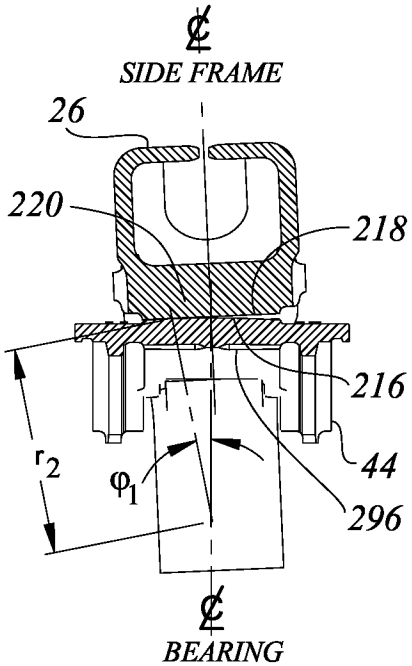
FIG. 4*c* shows the section of FIG. 4*b* as deflected laterally in a swinging motion.
Figure 4B:
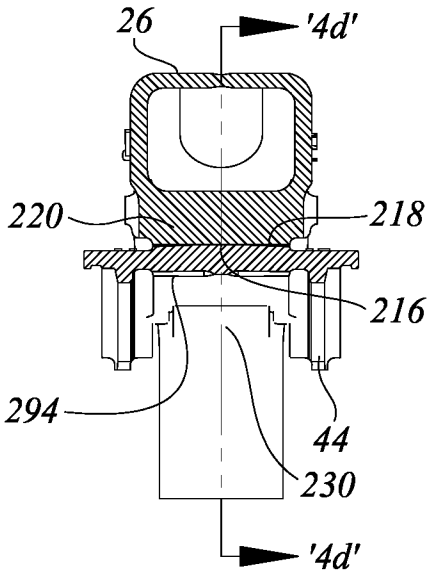
FIG. 4*b* is a sectional view through the side frame on section '4*b*-4*b*' of FIG. 4*a;*

Similarly, as shown in FIGS. 4*b* and 4*c*, in the transverse direction, the engagement of $r_2$ with $R_2$ may tend to permit lateral rocking motion, as may be in the manner of a swing motion truck. FIG. 4*b* shows a centered, at rest, minimum potential energy position of the lateral rocking system. FIG. 4*c* shows the same system in a laterally deflected condition. In this instance $\delta_2$ is roughly $(L_{pendulum}-r_2)\text{Sin}\,\varphi$, where, for small angles Sin $\varphi$ is approximately equal to $\varphi$. $L_{pendulum}$ may be taken as the at rest difference in height between the center of the bottom spring seat, 52, and the contact interface between the male and female portions 216 and 218.

This bearing adapter to pedestal seat interface assembly is biased by gravity acting on the pendulum toward a central, or "at rest" position, where there is a local minimum of the potential energy in the system. The fully deflected position shown in FIG. 4*c* may correspond to a deflection from vertical of the order of less than 10 degrees (and preferably less than 5 degrees) to either side of center, the actual maximum being determined by the spacing of gibs 106 and 108 relative to plate 92. Although in general $R_1$ and $R_2$ may differ, so the female surface is an outside section of a torus, it may be desirable, for $R_1$ and $R_2$ to be the same, i.e., so that the bearing surface of the female fitting is formed as a portion of a spherical surface, having neither a major nor a minor axis, but merely being formed on a spherical radius. $R_1$ and $R_2$ give a self-centering tendency. That tendency may be quite gentle. Although it is possible for $r_1$ and $r_2$ to be the same, such that the crowned surface of the bearing adapter (or the pedestal seat, if the relationship is inverted) is a portion of a spherical surface, in the general case $r_1$ and $r_2$ may be different. It may also be noted that, provided the system may tend to return to a local minimum energy state (i.e., that is self-restorative in normal operation) in the limit either or both of $R_1$ and $R_2$ may be infinitely large such that either a cylindrical section is formed or, when both are infinitely large, a planar surface may be formed. In the further alternative, it may be that $r_1=r_2$, and $R_1=R_2$. In one embodiment $r_1$ may be the same as $r_2$, and may be about 40 inches (+/−5") and $R_1$ may the same as $R_2$, and both may be infinite such that the female surface is planar.

The radius of curvature of the male longitudinal rocker, $r_1$, may be less than 60 inches, and may lie in the range of 5 to 50 inches, may lie in the range of about 40 inches. $R_1$ may be infinite, or may be less than 100 inches, and may be in the range of 25 to 60 inches, or in the narrower range of 30 to 40 inches, depending on the radius of $r_1$. The radius of curvature of the male lateral rocker, $r_2$, may be between 30 and 50 inches, and may be about 40 inches as in the embodiment shown. $R_2$ may be infinite, such that the plate is flat, or, alternatively it may be about 60 inches. Where a flat female rocker surface is used, and a male spherical surface is used, the male radius of curvature may be in the range of about 20 to about 50 in., and may lie in the narrower range of 30 to 40 in. Many combinations are possible, depending on loading, intended use, and rocker materials. In each case the mating male and female rocker surfaces may tend to be chosen to yield a physically reasonable pairing in terms of expected loading, anticipated load history, and operational life. These may vary.

The male and female surfaces may be inverted, such that the female engagement surface is formed on the bearing adapter, and the male engagement surface is formed on the pedestal seat. One of the mating parts or surfaces is part of the bearing adapter, and another is part of the pedestal.

The rocking assembly at the wheelset to side frame interface to tends to maintain itself in a centered condition. There is a spatial relationship of the assembly formed by (a) the bearing adapter, for example, bearing adapter 44; (b) the centering members, such as, for example, resilient members 256; and (c) the pedestal jaw thrust blocks, 280. When resilient member 256 is in place, bearing adapter 44; may tend to be centered relative to jaws or thrust blocks 280. As installed, the snubber (member 256) seats closely about the pedestal jaw thrust lug, and may seat next to the bearing adapter end wall and between the bearing adapter corner abutments in a slight interference fit. The snubber is sandwiched between, and establishes the spaced relative position of, the thrust lug and the bearing adapter; and provides an initial central positioning of the mating rocker elements as well as providing a restorative bias. Although bearing adapter 44 may still rock relative to side frame 26, such rocking may tend to deform (typically, locally to compress) a portion of member 256, and, being elastic, member 256 may tend to urge bearing adapter 44 toward a central position, whether there is much weight on the rocking elements or not. Resilient member 256 may have a restorative force-deflection characteristic in the longitudinal direction that is substantially less stiff than the force deflection characteristic of the fully loaded longitudinal rocker (perhaps one to two orders of magnitude less), such that, in a fully loaded car condition, member 256 may tend not significantly to alter the rocking behaviour. In one embodiment member 256 may be made of a polyurethane.

The rolling contact surface of the bearing has a local minimum energy condition when centered under the corresponding seat, and it is preferred that the mating rolling contact surface be given a radius that may tend to encourage self centering of the male rolling contact element.

In cylindrical polar co-ordinates, the long axis of the wheelset axle may be considered as the axial direction. There is a radial direction measured perpendicularly away from the axial direction, and there is an angular circumferential direction that is mutually perpendicular to both the axial direction, and the radial direction. There is a location on the rolling contact surface that is closer to the axis of rotation of the bearing than any other location. This defines the "rest" or local minimum potential energy equilibrium position. Since the radius of curvature of the rolling contact surface is greater than the radial length, L, between the axis of rotation of the bearing and the location of minimum radius, the radial distance, as a function of circumferential angle θ will increase to either side of the location of minimum radius (or, put alternatively, the location of minimum radial distance from the axis of rotation of the bearing lies between regions of greater radial distance). Thus the slope of the function r(θ), namely dr/dθ, is zero at the minimum point, and is such that r increases at an angular displacement away from the minimum point to either side of the location of minimum potential energy. Where the surface has compound curvature, both dr/dθ and dr/dL are zero at the minimum point, and are such that r increases to either side of the location of minimum energy to all sides of the location of minimum energy, and zero at that location. This may tend to be true whether the rolling contact surface on the bearing is a male surface or a female surface. The rolling contact surface has a radius of curvature, or radii of curvature, if a compound curvature is employed, that is, or are, larger than the distance from the location of minimum distance from the axis of rotation, and the rolling contact surfaces are not concentric with the axis of rotation of the bearing. Another way to express this is to note that there is a first location on the rolling contact surface of the bearing that lies radially closer to the axis of rotation of the bearing than any other location thereon. A first distance, L is defined between the axis of rotation, and that nearest location. The surface of the bearing and the surface of the pedestal seat each have a radius of curvature and mate in a male and female relationship, one radius of curvature being a male radius of curvature $r_1$, the other radius of curvature being a female radius of curvature, $R_2$, (whichever it may be). $r_1$ is greater than L, $R_2$ is greater than $r_1$, and L, $r_1$ and $R_2$ conform to the formula $L^{-1}-(r_1^{-1}-R_2^{-1})>0$, the rocker surfaces being co-operable to permit self steering.

Compound Pendulum Geometry

Figure 4A:
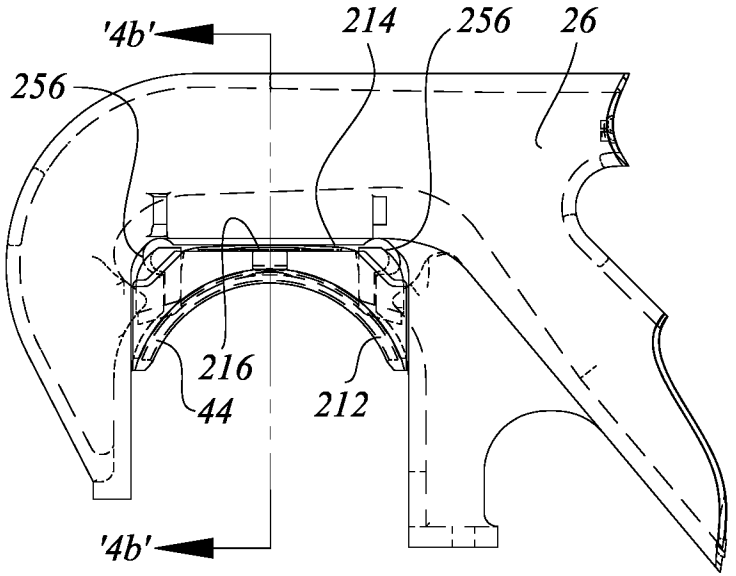
FIG. 4*a* is a side view in partial section of the end of a truck side frame of the railroad car truck of FIG. 1*a;*
Figure 4D:
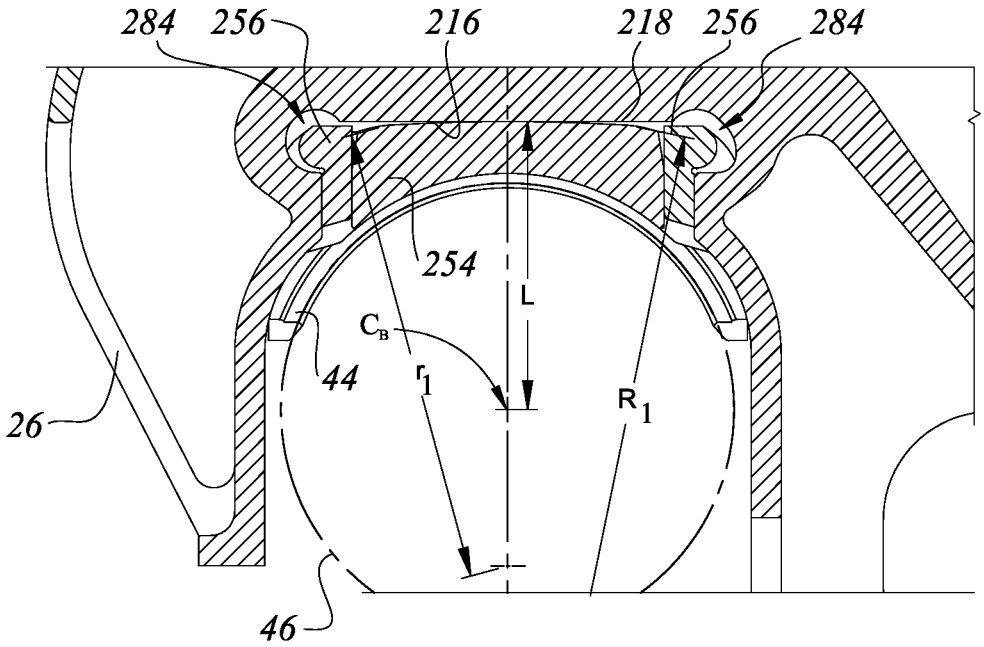
FIG. 4*d* shows a section in the longitudinal direction through the pedestal seat and bearing adapter assembly of the side frame of FIG. 4*a* on section '4*d*-4*d*' of FIG. 4*b;*
Figure 4E:
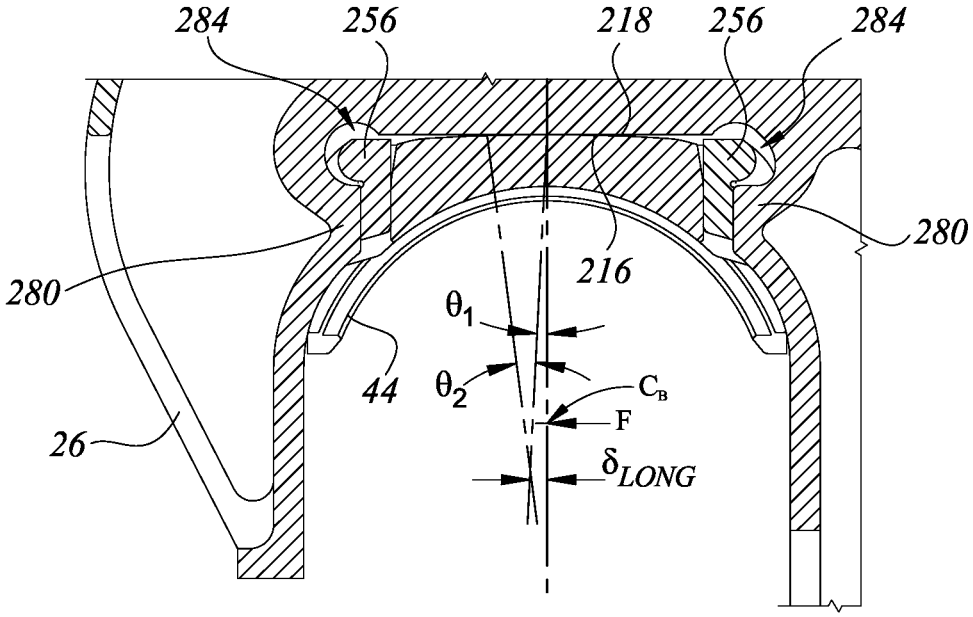
FIG. 4*e* shows the pedestal seat and bearing adapter assembly of FIG. 4*c* in a longitudinally deflected condition.

The rockers shown and described herein may employ rocking elements that define compound pendulums—that is, pendulums for which the male rocker radius is non-zero, and there is an assumption of rolling (as opposed to sliding) engagement with the female rocker. The embodiment of FIG. 4*a* shows a bi-directional compound pendulum. The performance of these pendulums may affect both lateral stiffness and self-steering on the longitudinal rocker.

The lateral stiffness of the suspension may tend to reflect the stiffness of (a) the side frame between (i) the bearing adapter and (ii) the bottom spring seat (that is, the side frames swing laterally); (b) the lateral deflection of the springs between (i) the lower spring seat and (ii) the upper spring seat mounting against the truck bolster, and (c) the moment between (i) the spring seat in the side frame and (ii) the upper spring mounting against the truck bolster. The lateral stiffness of the spring groups may be approximately ½ of the vertical spring stiffness.

A formula may be used for estimation of truck lateral stiffness:

$$k_{truck}=2\times[(k_{sideframe})^{-1}+(k_{spring\ shear})^{-1}]^{-1}$$

where $k_{sideframe}=[k_{pendulum}+k_{spring\ moment}]$ $k_{spring\ shear}$=The lateral spring constant for the spring group in shear.

$k_{pendulum}$=The force required to deflect the pendulum per unit of deflection, as measured at the center of the bottom spring seat.

$k_{spring\ moment}$=The force required to deflect the bottom spring seat per unit of sideways deflection against the twisting moment caused by the unequal compression of the inboard and outboard springs.

In a pendulum, the relationship of weight and deflection is roughly linear for small angles, analogous to F=kx, in a spring. A lateral constant can be defined as $k_{pendulum}=W/L$, where W is weight, and L is pendulum length. An approximate equivalent pendulum length can be defined as $L_{eq}=W/k_{pendulum}$. W is the sprung weight on the side frame. For a truck having L=15 and a 60" crown radius, $L_{eq}$ might be about 3 in. For a swing motion truck, $L_{eq}$ may be more than double this.

A formula for a longitudinal (i.e., self-steering) rocker as in FIG. 4*a*, may also be defined:

$$F/\delta_{long}=k_{long}=(W/L)[[(1/L)/(1/r_1-1/R_1)]-1]$$

Where:

$k_{long}$ is the longitudinal constant of proportionality between longitudinal force and longitudinal deflection for the rocker.

F is a unit of longitudinal force, applied at the centerline of the axle $\delta_{long}$ is a unit of longitudinal deflection of the centerline of the axle L is the distance from the centerline of the axle to the apex of male portion 216.

$R_1$ is the longitudinal radius of curvature of the female hollow in the pedestal seat 38.

$r_1$ is the longitudinal radius of curvature of the crown of the male portion 216 on the bearing adapter In this relationship, $R_1$ is greater than $r_1$, and (1/L) is greater than $[(1/r_1)-(1/R_1)]$, and, as shown in the illustrations, L is smaller than either $r_1$ or $R_1$. In some embodiments herein, the length L from the center of the axle to apex of the surface of the bearing adapter, at the central rest position may typically be about 5¾ to 6 inches (+/−), and may be in the range of 5-7 inches. Bearing adapters, pedestals, side frames, and bolsters are typically made from steel. The present inventor is of the view that the rolling contact surface may preferably be made of a tool steel, or a similar material.

In the lateral direction, an approximation for small angular deflections is:

$$k_{pendulum}=(F_2/\delta_2)=(W/L_{pend.})[[(1/L_{pend.})/((1/R_{Rocker})-(1/R_{Seat}))]+1]$$

where:

$k_{pendulum}$=the lateral stiffness of the pendulum $F_2$=the force per unit of lateral deflection applied at the bottom spring seat $\delta_2$=a unit of lateral deflection W=the weight borne by the pendulum $L_{pend.}$=the length of the pendulum, as undeflected, between the contact surface of the bearing adapter to the bottom of the pendulum at the spring seat $R_{Rocker}=r_2$=the lateral radius of curvature of the rocker surface $R_{Seat}=R_2$=the lateral radius of curvature of the rocker seat Where $R_{Seat}$ and $R_{Rocker}$ are of similar magnitude, and are not unduly small relative to L, the pendulum may tend to have a relatively large lateral deflection constant. Where $R_{Seat}$ is large compared to L or $R_{Rocker}$, or both, and can be approximated as infinite (i.e., a flat surface), this formula simplifies to:

$$k_{pendulum}=(F_{lateral}/\delta_{lateral})=(W/L_{pend.})[(R_{Rocker}/L_{pendulum})+1]$$

Using this number in the denominator, and the design weight in the numerator yields an equivalent pendulum length, $L_{eq.}=W/k_{pendulum}$ The truck may be free of lateral unsprung bracing, whether in terms of a transom, laterally extending parallel rods, or diagonally criss-crossing frame bracing or other unsprung stiffeners. In those embodiments the trucks may have four cornered damper groups driven by each spring group.

Friction Surfaces

As explained in WO 2005 005 219 dynamic response may be quite subtle. It may be desirable to supplant a physically locked relationship with a relationship that allows the truck to flex in a non-square manner, subject to a bias tending to return the truck to its squared position such as may be obtained by employing the larger resistive moment couple of doubled dampers as compared to single dampers. While use of laterally soft rockers, dampers with reduced stick slip behaviour, four-cornered damper arrangements, and self-steering may all be helpful in their own right, it appears that they may also be inter-related in a subtle and unexpected manner. Self steering may function better where there is a reduced tendency to stick slip behaviour in the dampers. Lateral rocking in the swing motion manner may also function better where the dampers have a reduced tendency to stick slip behaviour. Lateral rocking in the swing motion manner may tend to work better where the dampers are mounted in a four cornered arrangement. Counter-intuitively, truck hunting may not worsen significantly when the rigidly locked relationship of a transom or frame brace is replaced by four cornered dampers (apparently making the truck softer, rather than stiffer), and where the dampers are less prone to stick slip behaviour. The combined effect of these features may be surprisingly interlinked.

As described herein, there is a friction damping interface between the bolster and the side frames. Either the side frame columns or the damper (or both) may have a low or controlled friction bearing surface, that may include a hardened wear plate, that may be replaceable if worn or broken, or that may include a consumable coating or shoe, or pad. That bearing face of the motion calming, friction damping element may be obtained by treating the surface to yield desired co-efficients of static and dynamic friction whether by application of a surface coating, and insert, a pad, a brake shoe or brake lining, or other treatment. Such a shoe or lining may have a polymer based or composite matrix, loaded with a mixture of metal or other particles of materials to yield a specified friction performance.

That friction surface may, when employed in combination with the opposed bearing surface, have a co-efficient of static friction, $\mu_s$, and a co-efficient of dynamic or kinetic friction, $\mu_k$. The co-efficients may vary with environmental conditions. The friction co-efficients will be taken as being considered on a dry day condition at 70 F. In one embodiment, when dry, the co-efficients of friction may be in the range of 0.15 to 0.45, may be in the narrower range of 0.20 to 0.35, and, may be about 0.30. That coating, or pad, may, when employed in combination with the opposed bearing surface of the side frame column, result in co-efficients of static and dynamic friction at the friction interface that are within 20%, or, more narrowly, within 10% of each other. In another embodiment, the co-efficients of static and dynamic friction are substantially equal.

A damper may be provided with a friction specific treatment, whether by coating, pad or lining on the vertical friction face. In one embodiment it may be that the co-efficients of static and dynamic friction on the friction face may be about 0.3, and may be about equal to each other.

Spring Groups

The spring groups may have a variety of spring layouts. It may be helpful to have upward and downward damping forces that are not overly dissimilar, and that may in some cases tend to be roughly equal. Frictional forces at the dampers may differ depending on whether the damper is being loaded or unloaded. The angle of the damper wedge, the co-efficients of friction, and the springing under the damper wedges can be varied. A damper wedge is being "loaded" when the bolster is moving downward in the side frame window, since the spring force is increasing, and hence the force on the damper wedge is increasing. Similarly, a damper wedge is being "unloaded" when the bolster is moving upward toward the top of the side frame window, since the force in the springs is decreasing. The equations can be written as:

$$\text{While loading } F_d = \mu_c F_s \frac{(\text{Cot}(\Phi) - \mu_s)}{(1 + (\mu_s - \mu_c)\ \text{Cot}\ (\Phi) + \mu_s\ \mu_c)}$$

$$\text{While unloading } F_d = \mu_c F_s \frac{(\text{Cot}(\Phi) + \mu_s)}{(1 + (\mu_s - \mu_c)\ \text{Cot}\ (\Phi) + \mu_s\ \mu_c)}$$

Where: $F_d$=friction force on the side frame column $F_s$=force in the spring $\mu_s$=co-efficient of friction on the angled slope face on the bolster $\mu_c$=the co-efficient of friction against the side frame column $\phi$=the included angle between the angled face on the bolster and the friction face bearing against the column For a given angle, a friction load factor, $C_f$ can be determined as $C_f=F_d/F_s$. This load factor $C_f$ will tend to be different depending on whether the bolster is moving up or down.

In some embodiments, there may be different vertical spring rates in the empty and fully loaded conditions. To that end springs of different heights may be employed, for example, to yield two or more vertical spring rates for the entire spring group. In this way, the dynamic response in the light car condition may be different from the dynamic response in a fully loaded car, where two spring rates are used. Alternatively, if three (or more) spring rates (Outer, Inner, Inner-Inner) are used, there may be an intermediate dynamic response in a semi-loaded condition. In one embodiment, each spring group may have a first combination of springs that have a free length of at least a first height, and a second group of springs of which each spring has a free length that is less than a second height, the second height being less than the first height by a distance $\delta_1$, such that the first group of springs will have a range of compression between the first and second heights in which the spring rate of the group has a first value, namely the sum of the spring rates of the first group of springs, and a second range in which the spring rate of the group is greater, namely that of the first group plus the spring rate of at least one of the springs whose free height is less than the second height. The different spring rate regimes may yield corresponding different damping regimes.

For example, in one embodiment a car having a dead sprung weight (i.e., the weight of the car body with no lading excluding the unsprung weight below the main spring such as the side frames and wheelsets), of about 35,000 to about 55,000 lbs (+/−5000 lbs) may have spring groups of which a first portion of the springs have a free height in excess of a first height. The first height may, for example be in the range of about 9¾ to 10¼ inches. When the car sits, unladen, on its trucks, the springs compress to that first height. When the car is operated in the light car condition, that first portion of springs may tend to determine the dynamic response of the car in the vertical bounce, pitch-and-bounce, and side-to-side rocking, and may influence truck hunting behaviour. The spring rate in that first regime may be of the order of 12,000 to 22,000 lbs/in., and may be in the range of 15,000 to 20,000 lbs/in.

When the car is more heavily laden, as for example when the combination of dead and live sprung weight exceeds a threshold amount, which may correspond to a per car amount in the range of perhaps 60,000 to 100,000 lbs, (that is, 15,000 to 25,000 lbs per spring group for symmetrical loading, at rest) the springs may compress to, or past, a second height. That second height may be in the range of perhaps 8½ to 9¾ inches, for example. At this point, the sprung weight is sufficient to begin to deflect another portion of the springs in the overall spring group, which may be some or all of the remaining springs, and the spring rate constant of the combined group of the now compressed springs in this second regime may tend to be different, and larger than, the spring rate in the first regime. For example, this larger spring rate may be in the range of about 20,000-30,000 lbs/in., and may be intended to provide a dynamic response when the sum of the dead and live loads exceed the regime change threshold amount.

In various embodiments of trucks, such as truck 20, the resilient interface between each side frame and the end of the truck bolster associated therewith may include a four cornered damper wedge arrangement and a 3×3 spring group. Those groupings may have damper wedges having primary angles lying in the range of 30 to 60 degrees, or more narrowly in the range of 35 to 55 degrees, more narrowly still in the range 40 to 50 degrees, or may be chosen from the set of angles of 32, 36, 40 or 45 degrees. The damper wedges have friction modified surfaces, such as non-metallic surfaces.

The combination of damper wedges and side springs may be such as to give a spring rate under the side springs that is 20% or more of the total spring rate of the spring groups. It may be in the range of 20 to 30% of the total spring rate. In some embodiments the combination of wedges and side springs may be such as to give a total friction force for the dampers in the group, for a fully laden car, when the bolster is moving downward, that is less than 3000 lbs. In other embodiments the arithmetic sum of the upward and downward friction forces of the dampers in the group is less than 5500 lbs.

Combinations and Permutations

The features of the various figures may be mixed and matched, without departing from the spirit or scope of the invention. For the purpose of avoiding redundant description, it will be understood that the various damper wedge configurations can be used with spring groups of a 2×4, 3×3, 3:2:3, 2:3:2, 3×5 or other arrangement. Similarly, there are a large number of possible combinations and permutations of damper wedge arrangements and bearing adapter arrangements. In that light, it may be understood that the various features can be combined, without further multiplication of drawings and description.

In the trucks herein, the gibs may be shown mounted to the bolster inboard and outboard of the side frame column wear plates. In the embodiments shown herein, the clearance between the gibs and the side plates is desirably sufficient to permit a motion allowance of at least ¾" of lateral travel of the railroad car truck bolster relative to the wheels to either side of neutral, advantageously permits greater than 1 inch of travel to either side of neutral, and may permit travel in the range of about 1 or 1⅛" to about 1⅝ or 1 9/16" to either side of neutral.

In each of the trucks shown and described herein, the overall ride quality may depend on the inter-relation of the spring group layout and physical properties, or the damper layout and properties, or both, in combination with the dynamic properties of the bearing adapter to pedestal seat interface assembly. It may be helpful for the lateral stiffness of the side frame acting as a pendulum to be less than the lateral stiffness of the spring group in shear.

The embodiments of trucks shown and described herein may vary in their suitability for different types of service. Truck performance can vary based on expectedly loading, wheelbase, spring stiffnesses, spring layout, pendulum geometry, damper layout and damper geometry.

FIGS. 7*a*-7*d* and 8*a*-8*h*—Damper Wedge Assembly

In FIGS. 7*a* to 7*d* and 8*a* to 8*h* there is a damper wedge assembly 320 that could be used as damper wedge 64, 66, 68 or 70. In terms of functional geometry and issues pertaining to the working point, it may be understood to be the same as the damper wedge assembly shown in FIGS. 2*a* to 2*d* and 3*a* to 3*g* described above. To the extent they are the same, description of those features is not repeated.

Damper wedge assembly 320 differs from damper wedge 120, above, insofar as the friction element is mounted on a carrier that is itself mounted to the body of the friction wedge. The carrier is removable from the friction wedge body for replacement when worn. Rather than being mounted in a depressed pocket, the friction material is mounted to the plate, or carrier, that is carried on the front face of the wedge body. The carrier can also be referred to by several different names as an intermediate member, or an intermediate medium, or an adapter, or a coupling, or a mounting, between the friction element and the body of the damper wedge. There is a first engagement interface between the friction element and the intermediate member; there is a second engagement interface between the intermediate member and the damper wedge body. The second engagement interface is disengageable to permit the friction member to be removed from the damper wedge body, e.g., when worn, and replaced by a new replacement friction member.

In this example, the mounting is free of an external peripheral lip, such that the friction material stands forward of the carrier, so that a higher proportion of the friction material is potentially available to wear before removal, i.e., as compared to having as much as about ⅓ or more sunken in the depressed pocket. Moreover, the carrier is removable, so that renewal of the damper wedge body does not require an expensive or difficult removal of leftover clutch lining material before reconditioning can occur. Further still, the footprint of the carrier is broad, so that the mating fittings, or fingers, that locate it on the damper wedge body have a large moment arm, so resist rotational squirming of the pad, and the cross-section of the tabs is substantial to enhance resistance to the shear loads placed upon the fingers in use. The carrier does not rely on an adhesive bond with the damper wedge body, such as might fail over time due to heating.

The damper wedge assembly is shown as 320. Although a right-hand damper wedge is shown, a left-hand damper wedge is a mirror image of the right hand damper wedge. The description of the right hand damper wedge will be understood to describe both parts, allowing for opposite-handedness. In that regard, as above, damper wedge assembly 320 is intended to be a generic representation of left hand and right hand damper wedges 64 and 68.

Figure 8B:
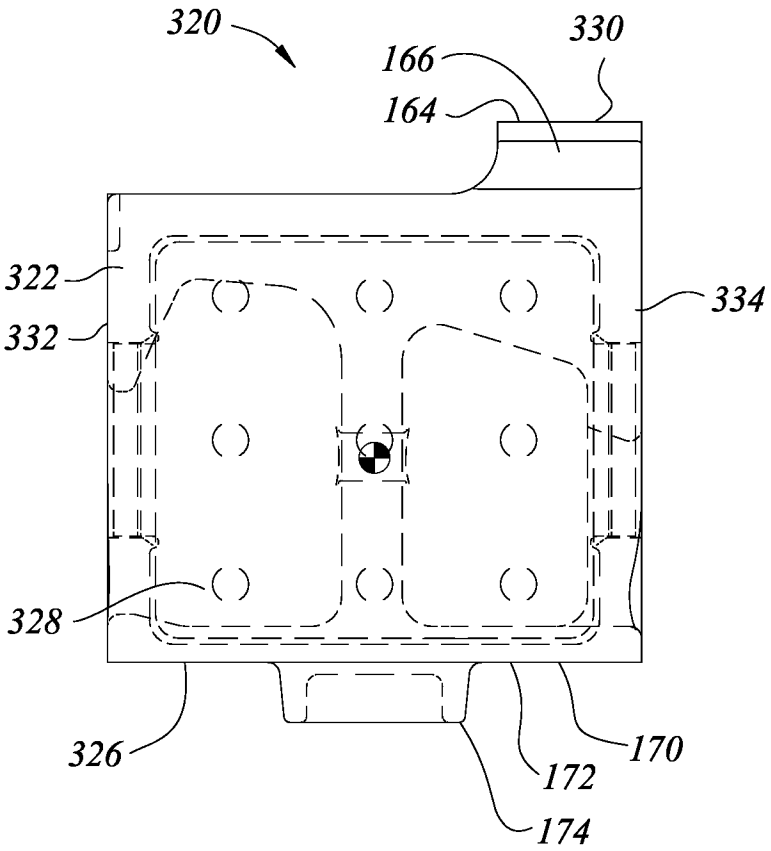
FIG. 8*b* is a rear view of the damper wedge assembly of FIG. 8*a;*
Figure 8A:
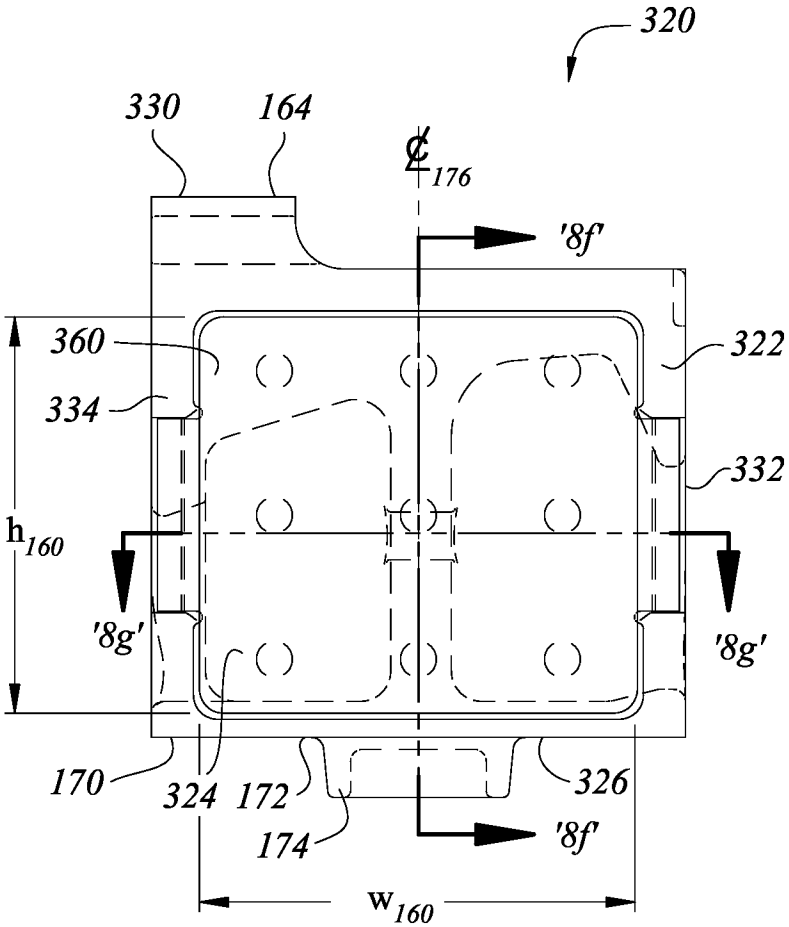
FIG. 8*a* is a front view of the damper wedge assembly of FIG. 7*a;*
Figures 8C, 8D, 8E:
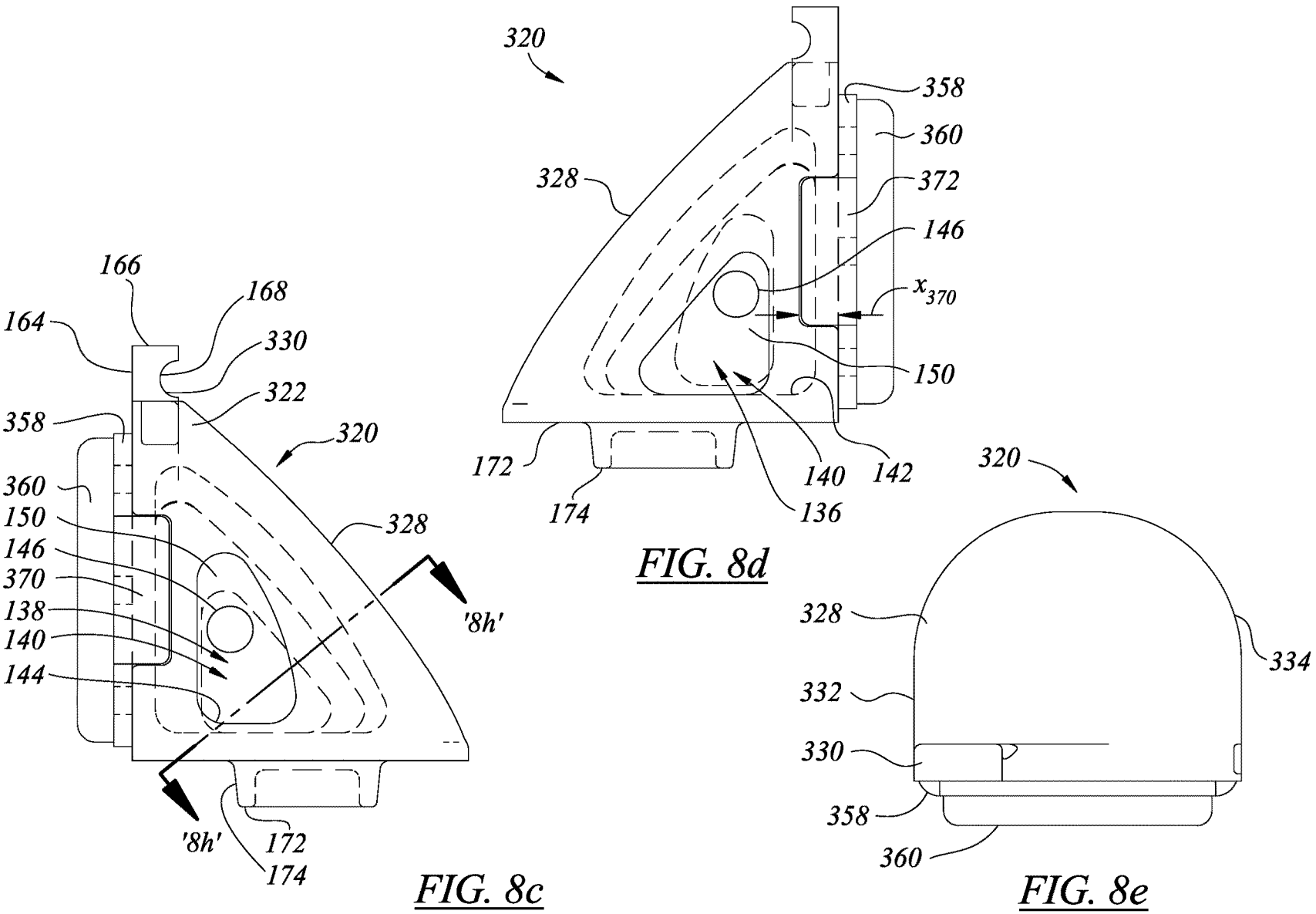
FIG. 8*c* is a large side view of the damper wedge assembly of FIG. 8*a;*
FIG. 8*d* is a small side view of the damper wedge assembly of FIG. 8*a;*
FIG. 8*e* is a top view of the damper wedge assembly of FIG. 8*a;*
Figure 9A:
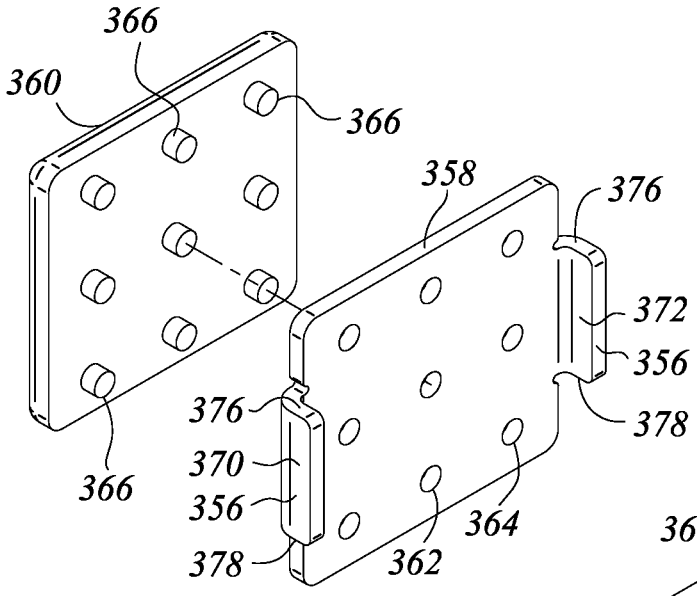
FIG. 9*a* is an exploded isometric view of a wear pad assembly of the damper wedge assembly of FIG. 7*a* from behind, above and to the left.
Figure 9B:
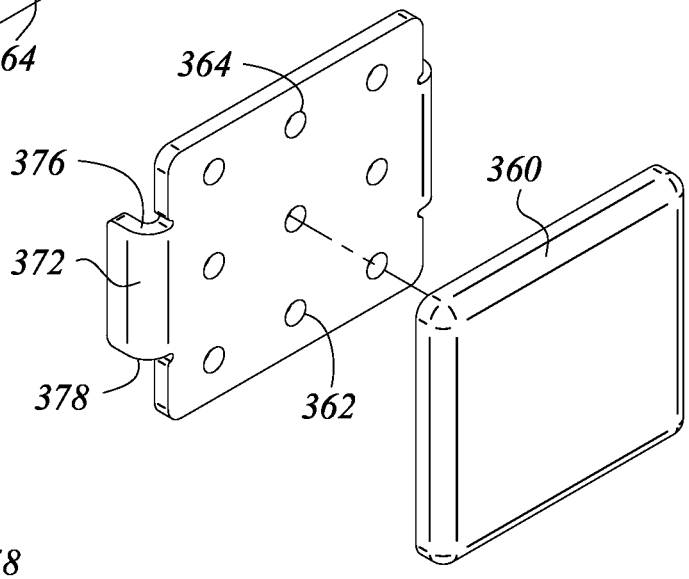
FIG. 9*b* is an opposite view to that of FIG. 9*a* from in front, above and to the left.
Figure 9C:
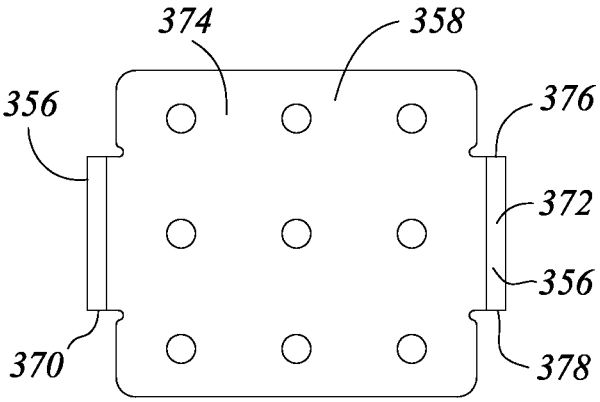
FIG. 9*c* is a rear elevation of the carrier plate of the wear pad assembly of FIG. 9*a;*
Figure 10A:
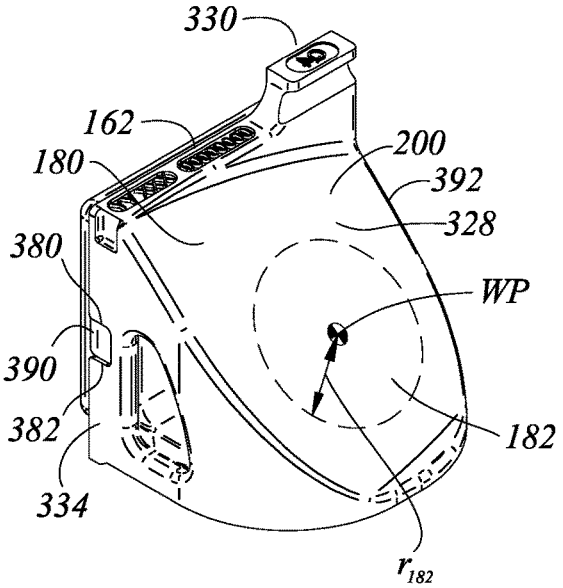
FIG. 10*a* is an isometric view from behind and above of an alternative damper wedge assembly to that of FIG. 7*a*, for use used in the truck of FIG. 1*a;*
Figure 10B:
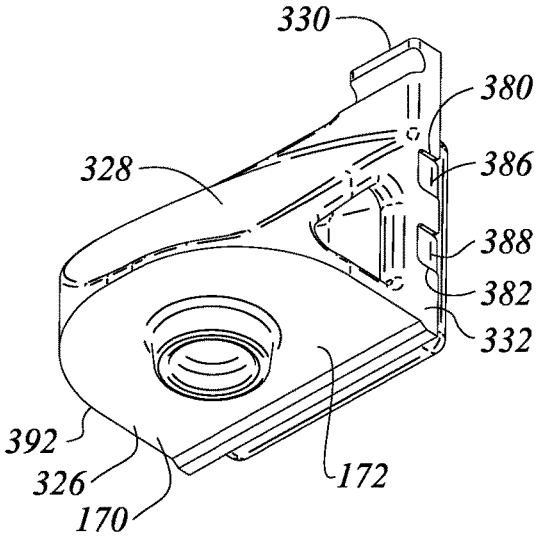
FIG. 10*b* is a view, from below and behind of the assembly of FIG. 10*a;*
Figure 10C:
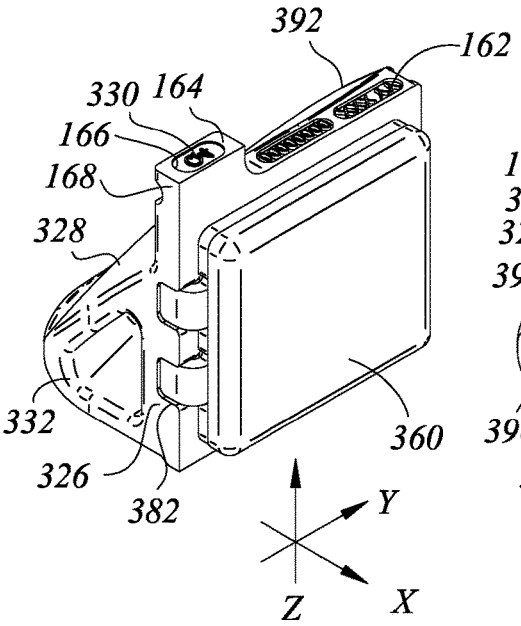
FIG. 10*c* is a view of the assembly of FIG. 10*a* from in front and above.
Figure 10D:
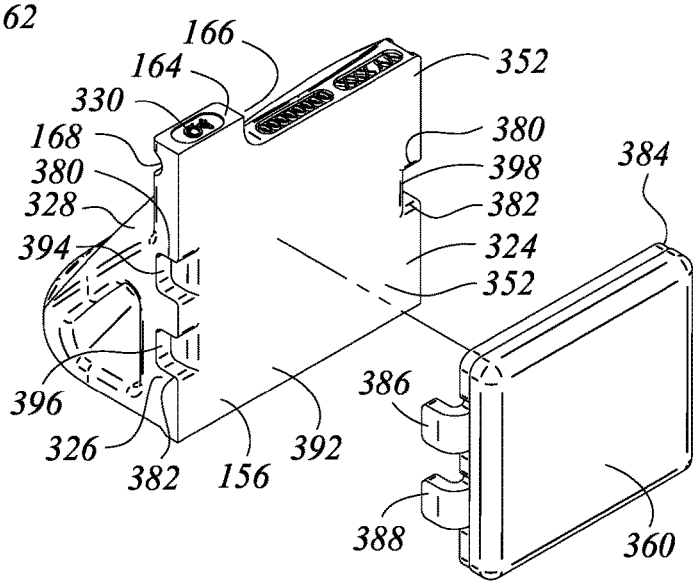
FIG. 10*d* is an exploded view of the assembly of FIG. 10*c* with the wear pad out.
Figure 11A:
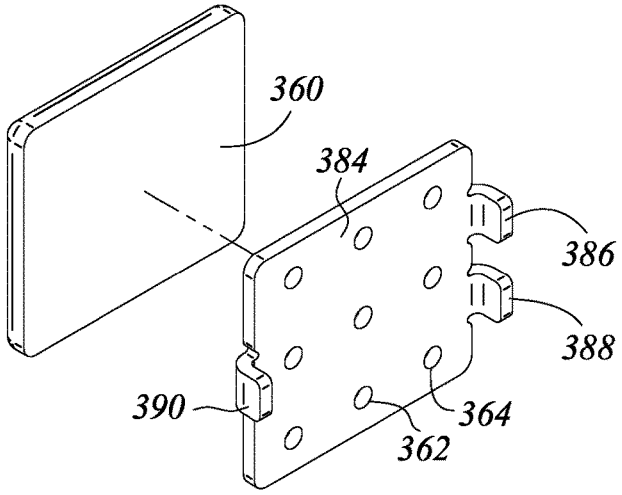
FIG. 11*a* is an exploded isometric view of a wear pad assembly of the damper wedge assembly of FIG. 10*a* from behind, above and to the left.
Figure 11B:
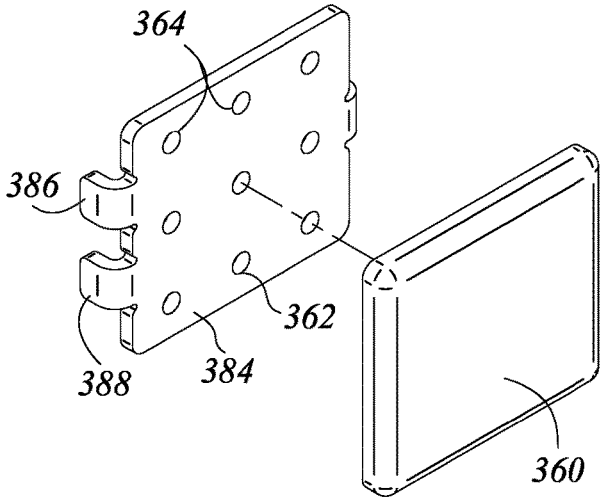
FIG. 11*b* is an opposite view to that of FIG. 11*a* from in front, above and to the left.
Figure 11C:
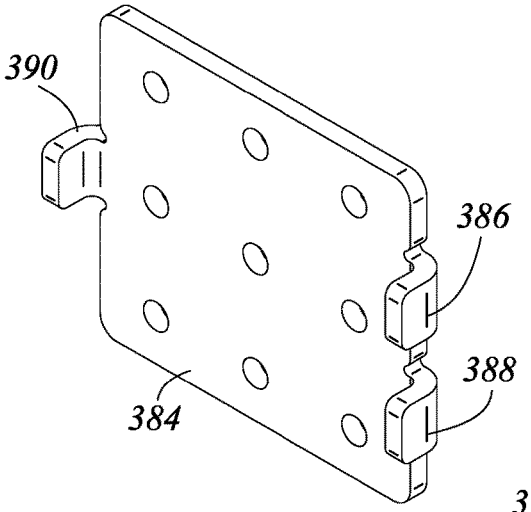
FIG. 11*c* is a rear elevation of the carrier plate of FIG. 11*a*.
Figure 11D:
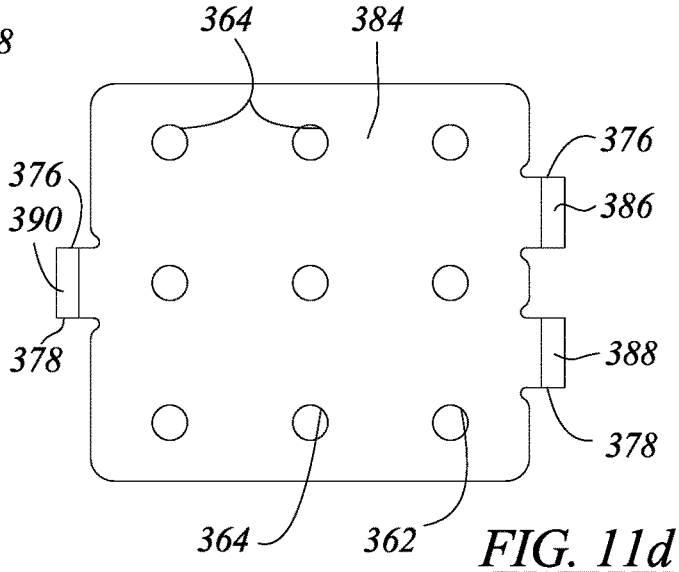
FIG. 11*d* is a rear isometric of the carrier plate of FIG. 11*c;*

Damper wedge assembly 320 has a body 322 and a replaceable friction pad assembly 310 that is removably mounted to the front of body 322. Body 322 may be, and as shown is, made from a relatively common material, such as a ductile iron, cast steel, or cast iron. In side view, it has a three-sided or generally triangular shape. A first face or portion or member 324, which extends vertically; a second face or member, or portion 326 that extends horizontally, and a third member or face or portion 328 that extends generally on a slope, and may be thought of as being the diagonal or hypotenuse member between member 324 and 326, the three parts thereby combining to form the three-sided shape as seen in side view in FIGS. 8*c* and 8*d*. Damper wedge body 322 also has a first end face or end wall 332 and a second end face of end wall 334. Here, the first end face 332 is the larger end face (i.e., FIG. 8*d*) and the second end face 334 is the smaller end face (FIG. 8*c*). Damper wedge body 322 has a primary angle, α, (alpha) seen in side view in FIG. 8*c*. In the embodiment illustrated, angle α is the same angle α as that of the matching, or corresponding, or associated surface of the sloped face 74 of the bolster pocket, be it 60 or 62. It is possible that the two planes of end faces 332 and 334, respectively, need not be exactly parallel, but it is convenient both for conceptual understanding and for manufacture that they be made the same. Angle α defines the primary angle of the bolster relative to the vertical plane when the damper wedge is seen in side view. Damper wedge body 322 also has a secondary damper angle, β (beta). The secondary angle of damper wedge body 322 is the same as the secondary angle β of the inclined surface of the bolster pocket, be it 60 or 62. It runs transversely, and defines the lateral bias of damper wedge 320 in the pocket. The true view of secondary angle β is seen by sighting along the back of damper wedge 320 in the inclined plane of primary damper angle α, as in FIG. 3*h*. Angle β is the angle of the tangent plane at the point of contact, identified as the Working Point, WP, discussed above, relative to the perpendicular to end walls or end faces 332, 334 in the plane of angle α. Again, it may be possible for angle β to be slightly different from that of the corresponding or associated bolster pocket, but for ease of conceptual understanding and ease of manufacture, they may be taken as being the same.

Given secondary angle β, end wall or end face 332 is larger than end wall or end face 334, and damper wedge body 322 is asymmetric as viewed from behind or from above. Damper wedge body 322 also has a grip or hold, or lifting member, or retainer 330 that extends upwardly from first portion or first member 324, and whose form and purpose is as described below.

Damper wedge body 322 may be made as a solid casting. Alternatively, damper wedge body 322 may be hollow, as shown. That is, body 322 has an internal cavity 340 bounded by items 324, 326, 328, 332 and 334. Internal cavity 340 may be, and as illustrated is, divided into two sub-compartments or chambers 336, 338 by a gusset, or partition, or web 350. Web 350 may have a central opening or hole 346. Each of end faces 332 and 334 may have a triangular, or generally triangular opening, 342, 344 respectively.

Looking at these items, the front face member, or first member 324 is planar, or generally planar, and has a rectangular or generally rectangular periphery. First member 324 has the form of a plate or wall 352 that extends from side to side laterally between end walls 332, 334, and up and down between the forward margin of second member 326 and the forward and upward margin of third member 328. Wall 352 may have a set of engagement fitting accommodations 354 into which seat members of a set of engagement fittings 356 by which friction pad assembly 310 is mounted to damper wedge body 322.

Friction pad assembly 310 includes a structural member that may be a plate or frame or spider, however named, indicated as a carrier plate, or simply a "carrier", 358. As noted above carrier 358 could also be termed an intermediate member, or an intermediate medium, or an adapter, or a coupling, or a retainer, that permits mating of the friction element to the damper wedge body. Whatever its name may be, carrier 358 can be disengaged from damper wedge body 322 to permit replacement of the friction element. A friction member, or friction element, or fiction pad or wear pad 360, however it may be named, is mounted to carrier 358. As before, wear pad 360 may be, and in the example shown is, a non-metallic friction pad made of a friction material which may be understood to be analogous to a brake lining or clutch lining material. Wear pad 360 may be, and in this instance is, a non-metallic friction pad. It has a non-metallic wear surface, that, in use, slides upward and downward in friction contact against side frame column wear plate 92. Wear pad 360 is shaped to conform to, i.e., seat within the outline of, carrier 358 and also of plate or wall 352. As shown, this shape is generally square or rectangular.

Wear pad 360 may typically be bonded or molded in place, or held in place, in the same way brake linings are mounted to brake shoes. For example, carrier plate 358 may have, and in the example shown does have, an array of locking features, or anchor fittings, or sockets, or holds, identified as penetrations 362. The penetrations may be holes 364. Those holes may be through holes. On fabrication, the non-metallic material of which friction wear pad 360 is made extends into holes 364 and provides a geometric mechanical interlinking of the wear pad material and the supporting substrate defined by the spider, i.e., carrier plate 358, that prevents the one from moving relative to the other. The material filling the penetrations can be identified as an array of protrusions, or bosses, or studs, or anchor, or plugs, however they may be called, and identified as a foot (or feet) 366, whether individually or collectively. Feet 366 can also be thought of as shear anchors that provide a mechanical obstruction to translation of pad 360 relative to carrier plate 358 in the y-z plane in the event that any other form of bonding should be insufficient. That is, given the normal forces applied in normal use acting to press the face of wear pad 360 against the wear plate 92 of side frame column 36, even if lining bonding should loosen, the capture of feet 366 in holes 364 will discourage migration of wear pad 360 away from its intended position between body 322 and wear plate 92.

The front surface of carrier plate 358 defines a datum surface. Carrier plate 358 could be formed on a radius in either the y or z directions, or both y and z directions to form a compound surface as the datum. However, in the embodiment illustrated the front surface of plate 358 is flat such that the datum surface is planar. In the usual course of installation and operation the planar surface will tend to be parallel to the planar surface of column side frame wear plate 92, assuming even surface wear of friction wear pad 360. Wear pad 360 has a vertical height $h_{360}$ (in the z-direction) and a transverse width $w_{360}$ (in the y-direction). In this form, excluding the shear anchors, i.e., feet 366, whose relatively small amounts of material that fill holes 364, all of, or substantially all of, the non-metallic friction material of which wear pad 360 is made stands forwardly of the datum surface and is potentially available to be used in the wear life of the part. The non-metallic friction material that fills holes 364 stops flush with, or shy of, the rear surface of plate 358, so the rearward surface of plate 358 sits cleanly against the forward face of first member 324 of damper body 322.

As noted, the carrier, i.e., carrier plate 358, has a set of engagement fittings 356 that engage the corresponding seats defined by accommodations 354. The set of engagement fittings 356 may include first and second fittings 370, 372. Those fittings 370, 372 may have the form of tabs, or wings, or flanges, or fingers, however they may be termed, that are bent rearwardly away from flat plate portion 374 of carrier plate or wall 352 more generally. Fittings 370, 372 may be termed a moment couple reaction, or they may be termed shear force transmission members, or both. That is, respective upper and lower shoulders 376, 378 of fittings 370, 372 are positioned in opposition to respective upper and lower abutments 380, 382 of the retainers, or stops, or notches, or accommodations 354, formed in the side margins of forward plate or wall, i.e., member 324 of damper wedge body 322. Those shoulders 376, 378 and abutments 380, 382 are shear force transfer reaction interfaces, and, alternatively or additionally, moment couple reaction interfaces. That is, there may be dynamic loads placed on friction wear pad 360 that may tend to urge pad 360, (and accordingly also carrier plate 358 and damper wedge body 322) to want to rotate about the x-axis. When this occurs, the rotational moment couple is reacted at the respective shoulders 376, 378 as they bear against abutments 380, 382. Similarly, as bolster 24 moves up and down on main spring group 56 vertical friction forces on friction pad 360 are reacted through carrier plate 358 and accordingly, again, through the corresponding engagement of shoulders 376, 378 and abutments 380, 382, in the applicable direction, as may be. These forces may be substantial, and they are cyclic according to the vibration spectrum seen in dynamic perturbations of the truck as the railroad car travel along the tracks. The fingers, or wings, or flanges of carrier plate 358 that form fittings 370, 372 are mutually opposed, and are spaced to span the front wall defined by first member 324 from margin to margin, giving the largest moment arm separation for a given damper wedge size. Further, the wings or flanges, i.e., fittings 370, 372 have a low aspect ratio of reach (i.e., the rearward distance of the wing or flange, seen as $x_{370}$), to width (i.e., the arm width seen as $y_{370}$) such that a relatively robust section of metal is provided to resist both vertical shear and the corner bending moment about the y-axis. That ratio may be less than 1:2 and may be less than 1:3. As seen by comparing FIGS. 8*c* and 8*d*, given that one side of damper wedge body 322 is smaller than the other due to the beta angle, the small side may have a smaller accommodation, and the corresponding wing of carrier plate 358 may be smaller in the z-direction.

Although engagement fittings 370, 372 are shown as singular left-hand and right-hand fittings as in FIGS. 7*a*-7*d*, 8*a*-8*h* and 9*a*-9*d*, one or the other or both could be made of two or more smaller fingers 386, 388, of carrier plate 384 as seen in FIGS. 10*a*-10*d*, 11*a* and 11*b*. A seen, there need not be the same number of fingers on both sides. That is, on one side there are two fingers, 386, 388, and on the other side there is one finger 390, it being a single finger of larger width in the z-direction. In this case damper wedge body 392 has corresponding accommodations 394, 396, 398. Whether in respect of body 322 and carrier 358 or in respect of body 392 and carrier 384, it is convenient that they be formed as singular fingers as tabs that have been bent rearwardly from an originally flat plate. Carrier 384 is otherwise the same as carrier 358, and body 392 is otherwise the same as body 322.

It may also be that in some instances fitting 370 and 372 (or 386, 388) may be radiused at their roots in main portion, namely flat plate portion 374, and may be curved rearwardly as springs, with an interference fit in the mating notches or accommodations 354 so that, on installation, they are spring loaded by the deflection of the interference fit such that carrier 384 clips into place, and may be referred to as "a clip". To that end the lead-in edge of the rearward clips may be radiused or chamfered.

In the embodiment of FIGS. 12*a*-12*j*, there is a damper wedge assembly 420 such as may be used in place of damper wedge assembly 120 or 320. It is substantially the same as damper wedge assembly 320 except in respect of the front face of the damper and the mounting of the friction element and its carrier.

That is, damper wedge assembly 420 has a damper wedge body 422 that has a front face 424 that has an accommodation or seat 426 in the form of a cavity or socket 410. Socket 410 is inset into front face 424, or, equivalently expressed, has a raised peripheral wall, lip, set of lips, or peripheral rim 428 that define an engagement interface. The peripheral lip or peripheral rim need not be continuous, but could be a set or array of elements with spacing between them, but where the elements, taken as a whole, form co-operating elements of a barrier or rim. Damper wedge assembly 420 includes friction element 430 that has the form of a friction pad 432 that mate with a carrier 440. Carrier 440 is formed to fit within, i.e., to conform to the engagement interface of front face 424. In the embodiment illustrated, the socket of accommodation 426 is generally rectangular in shape with radiused corners, as viewed from in front. The rectangular footprint of the socket defined by accommodation 426 need not be rectangular. It could be a parallelogram, or some other polygonal form. The planform shape of the footprint will correspond to, and will accommodate, carrier 440 and also friction element 430, whatever footprint they may have or that may be common to them.

Carrier 440 can also be referred to as, and as shown has the general appearance of, a cup or tray. Carrier 440 can also be referred to as a retainer. As explained below, the embodiment shown can also be referred to as a compression fitting. Further still the embodiment shown can be referred to as a seat or a setting or a bezel. In the embodiment shown, carrier 440 can also be called an intermediate member, or an intermediate medium, or an adapter, or coupling, or mounting, between the friction element 430 and the body 422 of the damper wedge. It provides a first engagement interface between the friction element 430 and the mounting, and a second engagement interface between the mounting and the damper wedge body 422.

Friction element 430 can be a non-metallic friction member made of materials the same as, or similar to, brake linings. Friction element 430 is substantially planar. It has a first face, indicated as front face 434 that, in use, bear against the side frame column wear plate; and a second face, indicated as rear face 446. It also has side edges 442, 444, 446 and 448 that extend between front face 434 and rear face 436. The through thickness of friction element 430 is much deeper than the depth of the socket defined by accommodation 426. Rear face 436 may include a metallic plate insert. Side edges 442, 444, 446 and 448 may extend perpendicular to front face 434 and rear face 436. Alternatively, in one embodiment one or more of those edges, and in particular a pair of two mutually opposed edges may be formed on a slight draft angle $\alpha_{442}$, such that front face 434 is slightly narrower than the rear face 436. In a further alternative, at least one, and in particular two opposed edges may have a channel or detent formed therein. Such a detent may have the form of a groove.

Carrier 440 has a central portion surrounded by a set of gripping members that are arrayed about its periphery. Whether the central portion of carrier 440 is a continuous web such as web 438 in FIG. 12*f*, or a perforated web, or mesh or grille, as in perforated plate 412 of carrier 406 of FIG. 12*h*, or a mesh, or a framework, or a truss-like member of struts 414 and openings 416 in a surrounding window frame 418 as in carrier 408 of FIG. 12*i*, or merely a picture frame or peripheral setting or bezel 402 of carrier 400 of FIG. 12*j*, in all cases may be referred to generically as a spider 450. In the embodiment shown, spider 450 is substantially planar. Spider 450 is surrounded by a set of gripping members, identified as a set of fingers 460. Fingers 460 extend away from the plane of spider 450, and, as installed, extend forwardly of that plane. In the example shown, spider 450 has four sides or edges, and correspondingly has four fingers 452, 454, 456 and 458 along those respective edges. As understood, finger 452, 454, 456, 458 are arrayed around the periphery of spider 450, and, as such, spider 450 serves to maintain the position and spacing of those fingers. Although one finger is shown per side, there could be more than one finger, and the sides do not have to have the same number of fingers.

Figure 12A:
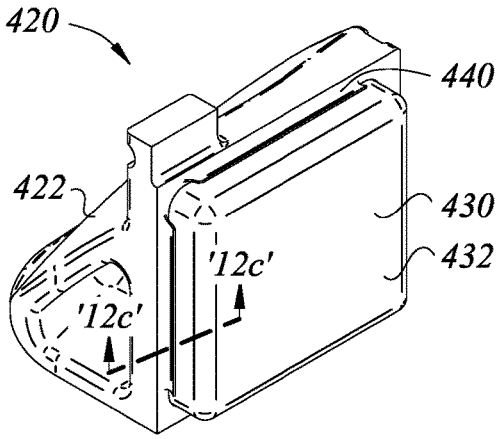
FIG. 12*a* is a front isometric view of an alternate damper wedge assembly to that of FIG. 7*a;*
Figure 12B:
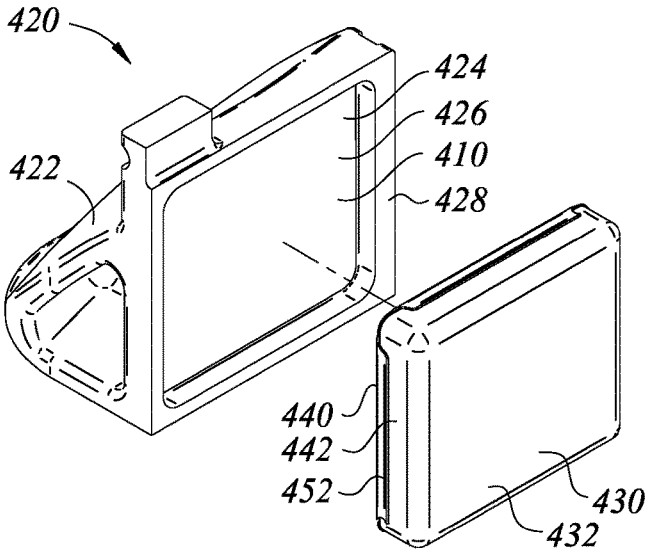
FIG. 12*b* is an exploded view of the alternate damper wedge assembly of FIG. 12*a;*
Figure 12C:
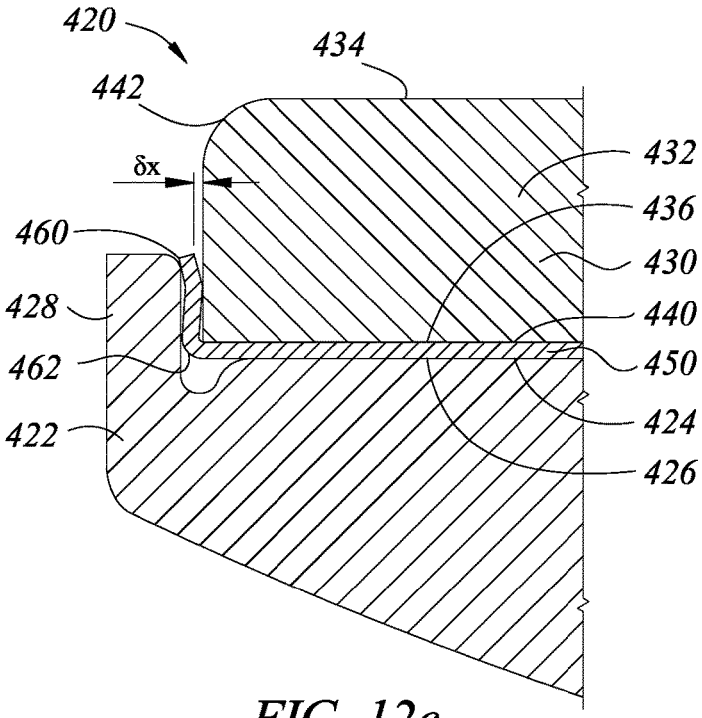
FIG. 12*c* is a partial sectional view on section '12*c*-12*c*' of FIG. 12*a;*
Figure 12D:
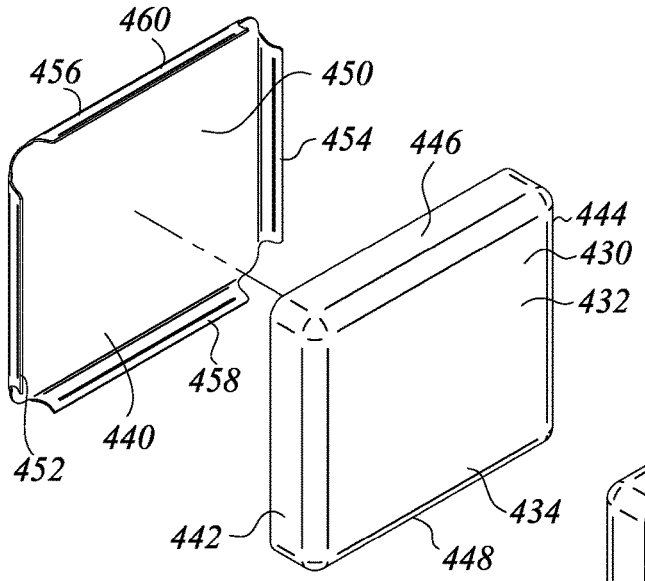
FIG. 12*d* is an exploded front isometric view of a friction pad and carrier assembly of the damper wedge assembly of FIG. 12*a;*
Figure 12E:
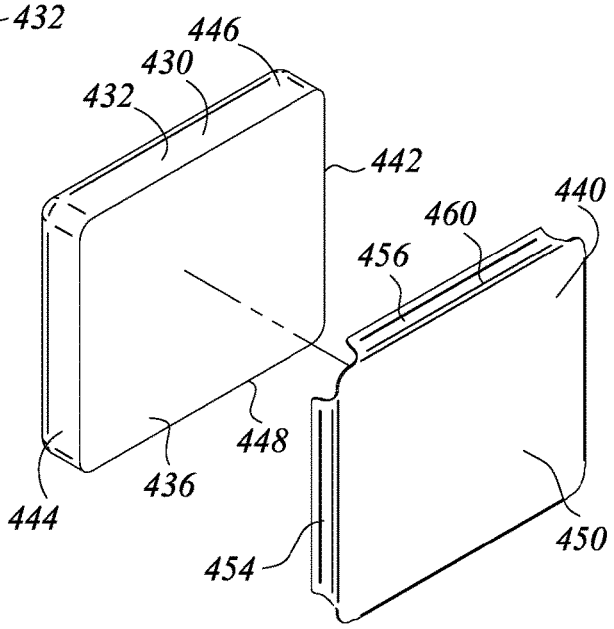
FIG. 12*e* is a rear exploded view of the friction pad and carrier assembly of FIG. 12*d;*
Figure 12F:
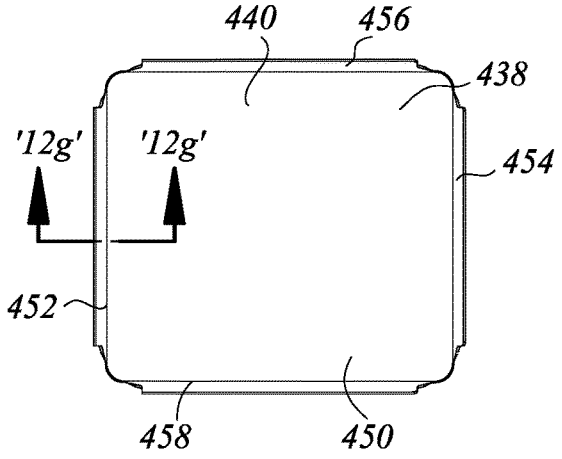
FIG. 12*f* is a front view of the friction pad and carrier assembly of FIG. 12*d;*
Figure 12G:
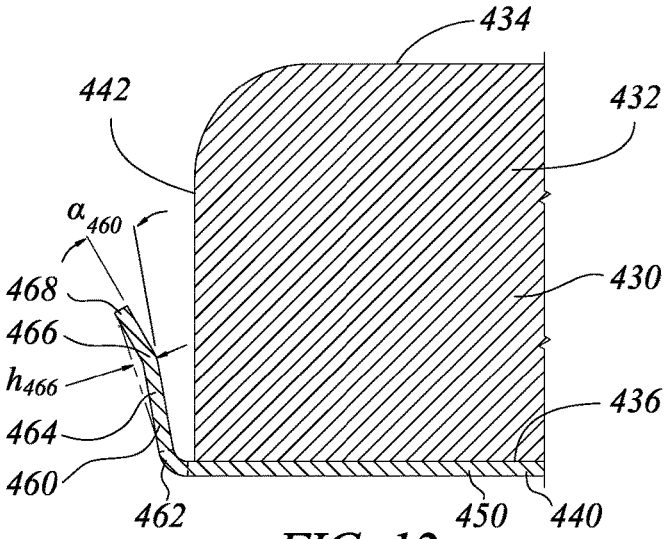
FIG. 12*g* is a partial sectional view of on section '12*g*-12*g*' of FIG. 12*f;*
Figure 12I:
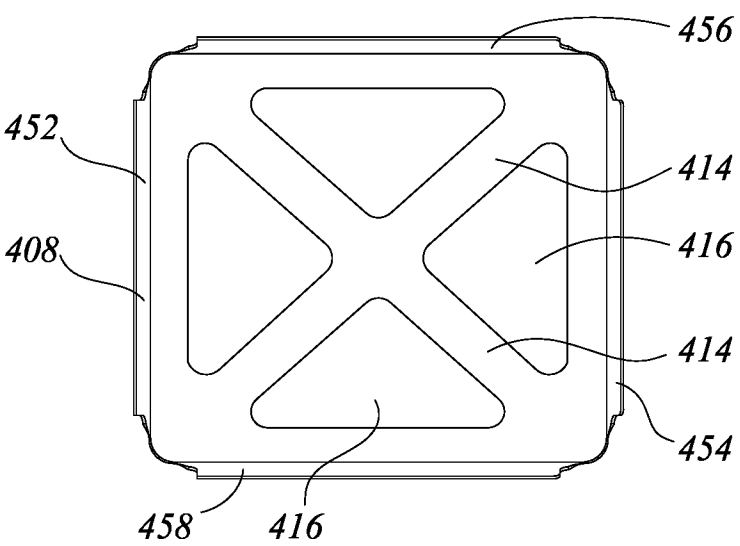
FIG. 12*i* is a front view of another alternate carrier to that of FIG. 12*f*.
Figure 12H:
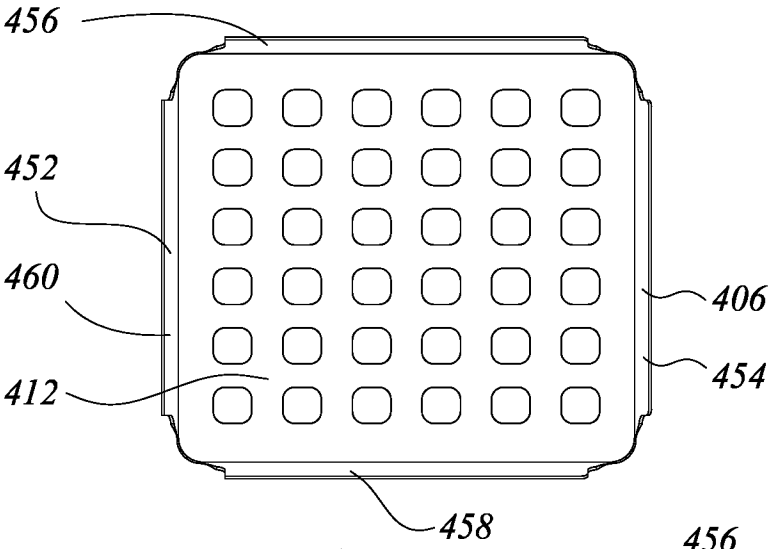
FIG. 12*h* is a front view of an alternate carrier to that of FIG. 12*f*.

An enlarged detail of the cross-section of finger 452 is shown in FIGS. 12*c* and 12*g*. In FIG. 12*g*, carrier 440 is shown with friction element 430 resting on it, prior to installation. In FIG. 12*c*, carrier 440 with friction element 430 in position is shown installed in the accommodation or seat 426 of friction damper wedge 420. For the purposes of understanding, the bend of finger 452 has been exaggerated so that the features can be seen more easily.

Note that finger 452 has a root 462, a first portion 464, an intermediate portion 466, and a second portion 468. Root 462 is the first end of FIG. 452, at which it is joined to spider 450. In the example shown root 462 is formed on a radius, such that finger 452 extends forward from spider 450. Finger 452 as shown a as generally gull-winged or dog-legged shape in which first portion 464 and second portion 468 are angled, or canted, relative to each other. First portion 464 and second portion 468 are joined by intermediate portion 466 that forms the knee, or elbow between first portion 464 and second portion 468. The outside of the curve of intermediate portion 466 can also be considered a fulcrum. First portion 464 is the proximate portion of finger 452, being closest to root 462. Second portion 468 is, contrastingly, the distal portion of finger 452 being most distant from root 462. The underside and tip of second portion 468 define a contact region, or engagement interface.

As friction element 430 and carrier 440 are installed the outside of finger 452 encounters the engagement interface of seat 426, in this example being the protruding member defined by the peripheral rim 428. In this way, rim 428 in some sense functions as a cam, and the distal portion, namely second portion 468 of finger 452 can be thought of as a cam follower. As the cam follower engages the cam, the cam follower deflects.

In the case of friction element 430 and seat 426, seat 426 is larger than the footprint, or space envelope of friction element 430, and if centered there is a clearance between them indicated as δx. As in the case of a four-sided shape, this clearance distance is typically half the difference in size between friction element 430 and seat 426. The through thickness of the material of carrier 440, and in particular of finger 452, is designated as $t_{452}$. That through thickness is less than the clearance distance between friction element 430 and seat 426. Accordingly, as carrier 440 is inserted within seat 426, finger 452 can lie in the clearance space. But as can also be seen, when undeflected, if a baseline is constructed from the outside tangent of root 462 and the inside of the tip of distal portion 468, and an (undeflected) altitude $h_{466}$ is constructed perpendicular to the base that intersects the tangent of the curve of the fulcrum of intermediate portion 466 parallel to the baseline. Altitude $h_{466}$ is greater than clearance [delta]x, such that, inescapably, introduction of carrier 440 into seat 426 will necessarily cause deflection of finger 452 and compression of altitude 466 at the cam follower defined by finger 452 engage the cam defined by peripheral rim 428. At some point the outside of the fulcrum defined by intermediate portion 466 encounters the side face of friction element 430, e.g., side edge 442, or such other as may be. That point of contact becomes an engagement interface of finger 452 with friction element 430. Similarly, the point or line of contact of second portion 468 with peripheral rim 428 forms another engagement interface. The contact at these engagement interfaces is a physical contact that, on installation requires a state of interference, i.e., an interference fit or a friction fit, first between friction element 430 and finger 452, and second between the land of peripheral rim 428 and finger 452. To the extent that altitude $h_{466}$ is compressed, finger 452 is a spring, the spring has been deflected, and acts as a peripheral compression fitting. The force of compression bears in the first instance against friction element 430, thereby tending to grasp it, to discourage it from disengaging, and thereby to hold it in place. In the second instance the force of compression required to deflect the spring bears against seat 426, again causing a tight interference fit that tends to discourage removal of carrier 440 (and also friction element 430) from seat 426. In use the action of the corner spring of the main spring group also forces friction element 430 against the side frame column wear plate, which, equivalently, force friction element 430 and carrier 440 into seat 426. As noted above, in an alternate embodiment the outside face of friction element 430 can be tapered such that removal of friction element 430 would require further deflection of the spring defined by finger 452, and so would make the fit tighter. In the further alternative in which a detent groove is formed in that outside edge face, the crown of the fulcrum seats in the detent groove, and, again, removal would necessitate greater deflection of the spring, and hence tightening of the fit.

Figure 12J:
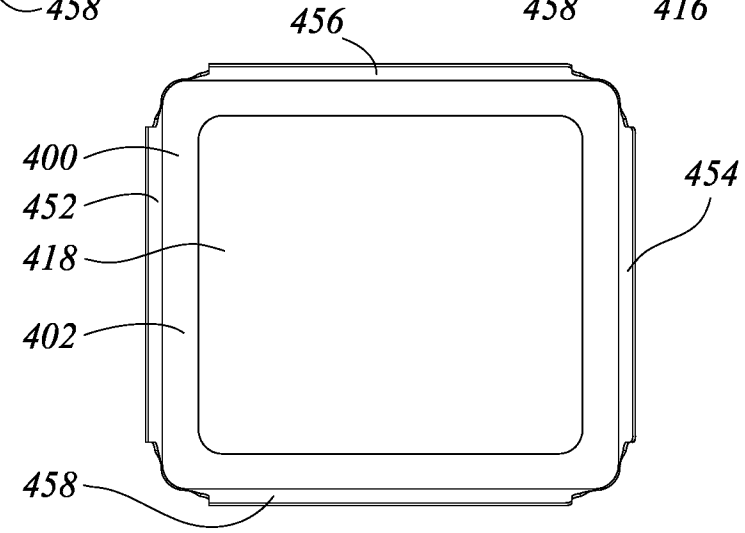
FIG. 12*j* is a front view of still another alternate carrier to that of FIG. 12*f.*
Figure 13B:
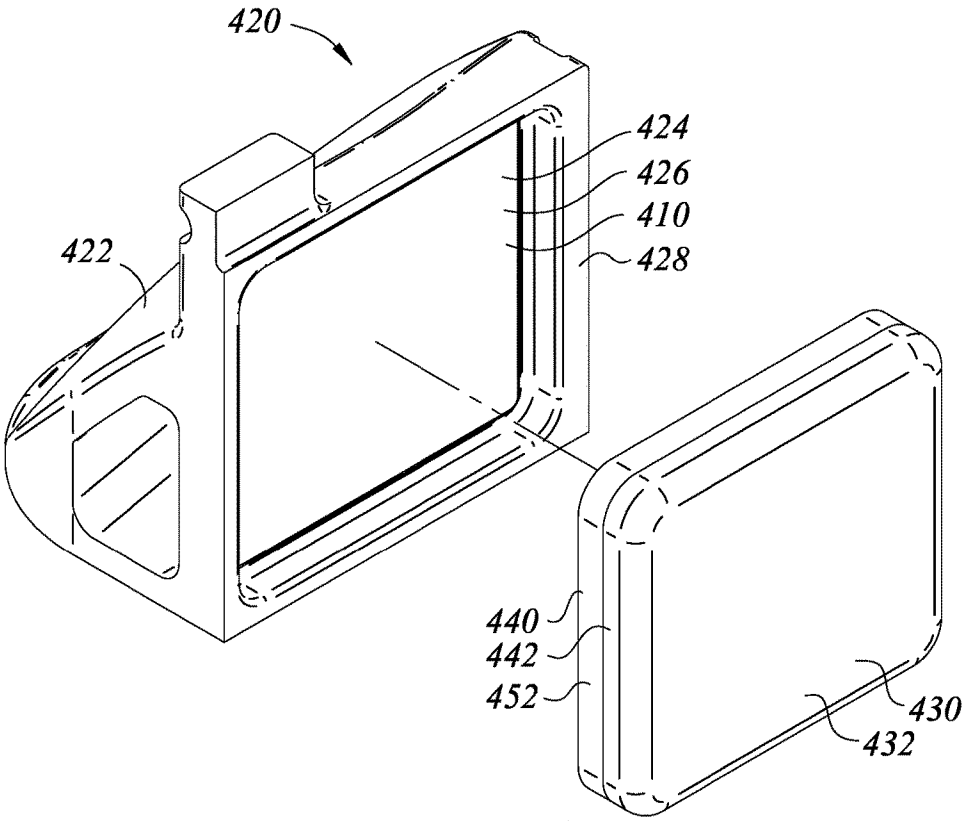
FIG. 13*b* is an exploded view of the alternate damper wedge assembly of FIG. 13*a;*
Figure 13A:
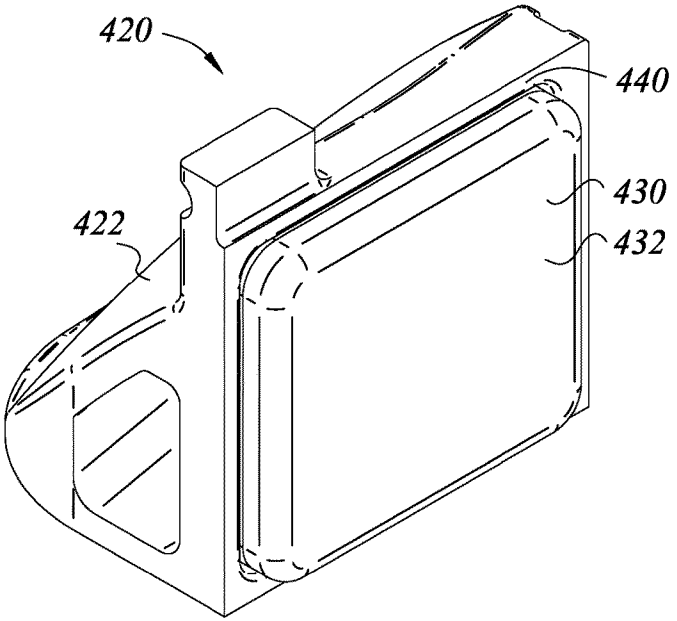
FIG. 13*a* is a front isometric view of an alternate damper wedge assembly to that of FIG. 13*a;*
Figure 13D:
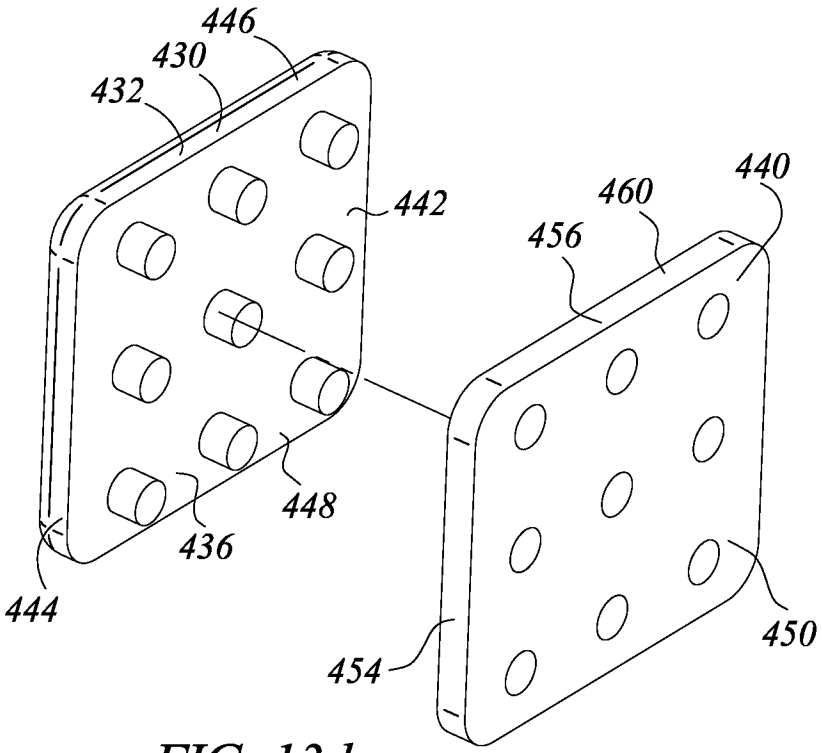
FIG. 13*d* is a rear exploded view of the assembly of FIG. 13*c;*
Figure 13C:
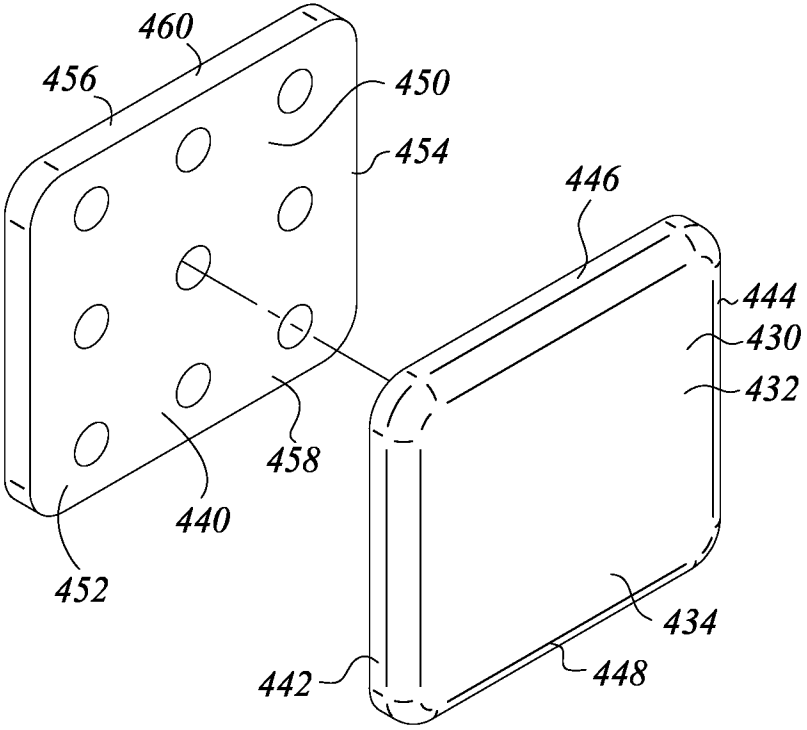
FIG. 13*c* is an exploded front isometric view of a friction pad and carrier assembly of the damper wedge assembly of FIG. 13*a;*

In damper wedge assembly 420, friction element 430 could be permanently secured to carrier 440, particularly when carrier 440 has the perforated form of carrier 408 of FIG. 12*j*. However, it need not be. In such circumstances, after the friction element is worn down, the carrier plate and the friction element can be removed and separated, and carrier 440 (or 408, etc., as may be) can be separated and carrier 440 can be re-used. In that regard, while carrier 440 is a retainer in use, it also functions as a parting plane that permits damper wedge body 422 to be separated from friction element 430, thereby extending the life of wedge body 422.

In FIGS. 13*a*-13*d*, there is a damper wedge assembly 470 that is an alternative to damper wedge assemblies 120, 320 or 420. It is substantially the same as damper wedge assembly 320 except in respect of the mounting of the friction element and its carrier. That is, as before damper wedge assembly 470 has a damper wedge body 422 that has a front face 424 that has an accommodation or seat 426 in the form of a cavity or socket 410. Socket 410 is inset into front face 424, or, equivalently expressed, has a raised peripheral wall, lip, set of lips, or peripheral rim 428 that define an engagement interface. The peripheral lip or peripheral rim need not be continuous, but could be a set or array of elements with spacing between them, but where the elements, taken as a whole, form co-operating elements of a barrier or rim. Damper wedge assembly 470 includes friction element 472 that has the form of a friction pad that mates with a carrier 480. Carrier 480 is formed to fit within, i.e., to conform to the engagement interface of socket 410 of front face 424. In the embodiment shown, the socket of accommodation 426 is generally rectangular in shape with radiused corners, as viewed from in front. The rectangular footprint of the socket 410 defined by accommodation 426 need not be rectangular. It could be a parallelogram, or some other polygonal form. The planform shape of the footprint will correspond to, and will accommodate, carrier 480 and also friction element 472, whatever footprint they may have or that may be common to them.

Carrier 480 can have the form of a plate 482. Plate 482 has an array of perforations identified as aperture 484. The perforations need not be of the same shape, or size. The perforations need not be equally shaped and need not be arranged in rows and columns. However, in the embodiment shown they are circular holes arranged in equally spaced rows and columns. Carrier 480 can also be referred to as a retainer. Carrier 440 can also be called an intermediate member, or an intermediate medium, or an adapter, between the friction element 472 and the body 422 of the damper wedge. It provides a first engagement interface between the friction element 472 and the mounting, and a second engagement interface between the mounting and the damper wedge body 422.

Friction element 472 can be a non-metallic friction member made of materials the same as, or similar to, brake linings. Friction element 472 is substantially planar. It has a first face, indicated as front face 474 that, in use, bear against the side frame column wear plate; and a second face, indicated as rear face 476. It also has side edges 492, 494, 496 and 498 that extend between front face 474 and rear face 476. The through thickness of friction element 472 is approximately the same depth, or a bit less deep than the depth of socket 410 defined by accommodation 426. That is, the friction lining material ends flush with, of slightly shy of the forward face of rim 428 such that the friction material will tend not to wear through before rim 428 is reached, giving a clear externally visual indicator that it is time to change the pad before it runs out of friction material. Rear face 476 may include a set of protrusions or studs identified as an array of bosses 490 that mate with apertures 484. In some instance bosses 490 may be formed by the act of casting the brake lining material through apertures 484. In each case the bosses are shaped to mate with the apertures, whatever the shape of the apertures my be. Side edges 492, 494, 496 and 498 may extend perpendicular to front face 434 and rear face 436. Alternatively, in one embodiment one or more of those edges, and in particular a pair of two mutually opposed edges may be formed on a slight draft angle such as $\alpha_{442}$, such that front face 434 is slightly narrower than the rear face 436.

In this example, carrier 480 fits snuggly within socket 410. Whether the central portion of carrier 480 is a perforated web, or mesh or grille, analogous to perforated plate 412 of carrier 406 of FIG. 12*h*, or a mesh, or a framework, or a truss-like member of struts 414 and openings 416 in a surrounding window frame 418 as in carrier 408 of FIG. 12*i*, in all cases may be referred to generically as a spider 450. In the embodiment shown it is substantially planar. Carrier 480 does not have fingers, but is merely a clean-sided plate that fits within the socket.

In damper wedge assembly 470, friction element 472 is intended to be fixedly secured to carrier 480. However, it need not be. Friction element 472 and carrier 480 are mechanically interlinked by the engagement of bosses 490 in apertures 484 In either case, after the friction element is worn down, the carrier plate and the friction element can be removed and separated by such means as may be suitable, and carrier 440 can be re-used. In that regard, while carrier 480 is a retainer in use, it also functions as a parting plane that permits damper wedge body 422 to be separated from friction element 472, thereby extending the life of wedge body 422.

Figure 14B:
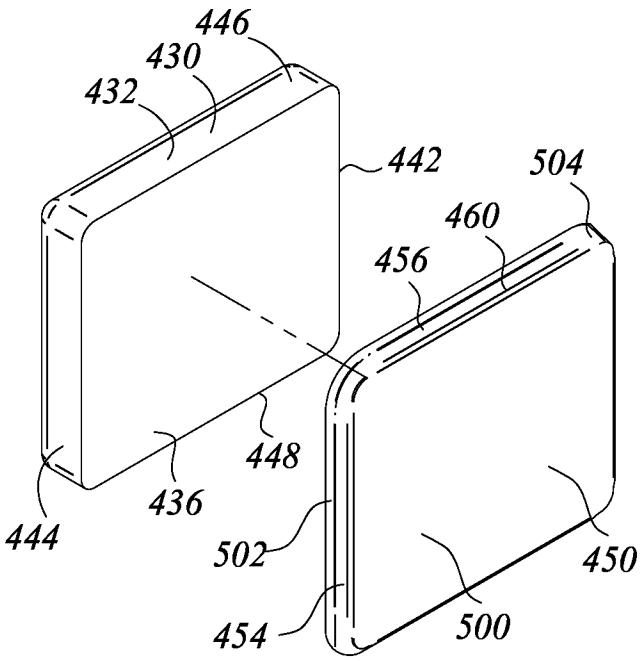
FIG. 14*b* is an opposite angle view of the assembly of FIG. 14*a.*
Figure 14A:
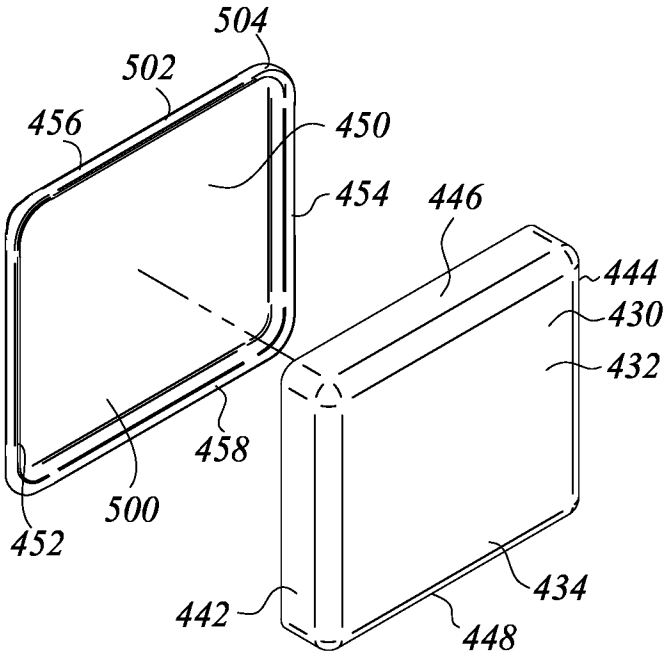
FIG. 14*a* is an alternate to the damper wedge assembly of FIG. 12*d*.

FIGS. 14*a* and 14*b* show an alternate carrier 500 to that of carrier 440 of FIGS. 12*d* and 12*e*. Except as indicated, carrier 500 may be understood to be the same as carrier 440, such that the description of carrier 440 is applicable also to describe carrier 500. Carrier 500 can also be referred to as, and in the embodiment illustrated has the general appearance of, a cup or tray. Carrier 500 can also be referred to as a retainer, and can also be referred to as a compression fitting, or as an intermediate member, or an intermediate medium, or an adapter, or coupling, or mounting, between the friction element 430 and the body 422 of the damper wedge. It provides a first engagement interface between the friction element 430 and the mounting, and a second engagement interface between the mounting and the damper wedge body 422.

Friction element 430 fits within the cup, or internal cavity, defined within carrier 500. The central portion of carrier 500 is surrounded by a gripping apparatus that extends continuously about its periphery. Spider 450 is surrounded by a set of gripping members, but rather than having a set of discrete fingers 460 it has a continuous peripheral wall 502 that includes corner portions 504. The cross-section of peripheral wall 502 along the sides of spider 450 may be taken as being the same as shown in FIGS. 12*c* and 12*g*. Carrier 500 is formed by drawing a blank in a pair of dies to form the peripheral flange.

Various embodiments of the invention have been described in detail. Since changes in and or additions to the above-described best mode may be made without departing from the nature, spirit or scope of the invention, the invention is not to be limited to those details but only by the appended claims.

We claim:

1. A friction pad assembly that engages a seat of a friction damper wedge body that mounts in a bolster pocket of a truck bolster of a railroad car truck, wherein said friction pad assembly comprises:

a retainer and a mating friction pad that engages said retainer;

said retainer having a first interface that engages said friction pad; and said retainer having a second interface that engages the seat of the friction damper wedge;

said retainer being releasable from the seat of the friction damper wedge body to permit replacement of said friction pad assembly;

said friction pad being releasable from said retainer; and when said friction pad is engaged with said retainer, and said retainer is engaged with the seat, said retainer is resiliently deflected by being engaged with said friction pad and with the seat.

2. The friction pad assembly of claim 1 wherein engagement of said friction pad with said retainer imposes a first friction fit; engagement of said retainer with said seat imposes a second interference fit; and mating said retainer with said seat tightens said first friction fit.

3. The friction pad assembly of claim 1 wherein mating engagement of said friction pad with said retainer imposes a spring pre-load on said retainer; and mating of said retainer with said seat increases said spring pre-load.

4. The friction pad assembly of claim 1 wherein said friction pad has a first characteristic dimension; said seat has a second characteristic dimension; there is a dimension delta that is the difference between said first and second characteristic dimensions; said retainer includes a spring, and said spring is deflected to conform to said first characteristic dimension and said second characteristic dimension, and, when so deflected, said spring acting to retain said friction pad in position relative to said seat.

5. The friction pad assembly of claim 1 in which the seat of the damper wedge defines a socket, and wherein said friction pad is sized to seat within said socket with a clearance, said retainer occupies said clearance; and, when said retainer is seated in said clearance said retainer is resiliently loaded between the seat of the damper wedge and said friction pad.

6. The friction pad assembly of claim 5 wherein said retainer has a spider and an array of fingers spaced around said spider, said fingers defining springs that are engaged when the friction pad is installed.

7. The friction pad assembly of claim 6 wherein said springs collectively define a compression spring that, on installation, works between, and against, the friction pad and the friction damper wedge body.

8. The friction pad assembly of claim 6 wherein said springs have a form of a dog-leg in which one part of the dog-leg bears against said friction pad and another part of the dog-leg engages the damper wedge body, and installation of said friction pad results in deflection of said dog-leg between the damper wedge body and said friction pad.

9. The friction pad assembly of claim 8 wherein said dog-leg has a fulcrum, and said fulcrum bears against said friction pad.

10. The friction pad assembly of claim 6 wherein said friction pad is four sided and at least one of said springs bears on each of said four sides.

11. A retainer operable to work between a friction pad and a seat of a friction damper wedge body that mounts in a bolster pocket of a truck bolster of a railroad car truck, wherein said retainer comprises:

a first interface at which said retainer engages the friction pad;

a second interface at which said retainer engages the seat of the friction damper wedge;

said retainer being releasable from the seat of the friction damper wedge to permit replacement of the friction pad;

the friction pad being releasable from said retainer; and when the friction pad is engaged with said retainer, and said retainer is engaged with said seat, said retainer is resiliently deflected by being engaged with the friction pad and with the seat.

12. The retainer of claim 11 wherein said retainer is sized such that when the friction pad is mounted in the retainer said first interface is in a friction fit with the friction pad.

13. The retainer of claim 11 wherein said retainer is sized such that when said retainer engages the seat of the friction damper wedge body, said second interface of said retainer is in a friction fit.

14. The retainer of claim 11 wherein said retainer is sized such that when the friction pad is engaged by said first interface, said retainer has a resilient spring loading.

15. The retainer of claim 11 wherein said retainer is sized such that when the seat of the damper wedge body is engaged by the second interface, said retainer is resiliently spring loaded by that engagement.

16. The retainer of claim 11 wherein said retainer is sized such that at least two of:

when the friction pad mounts to said retainer said first interface is in a first friction fit with the friction pad;

when said retainer engages the seat of the friction damper wedge body, said second interface of said retainer is in a second friction fit; and when the friction pad is engaged by said first interface, and the seat of the damper wedge body is engaged by the second interface, said retainer is resiliently spring loaded between the friction pad and the seat of the damper wedge body.

17. The retainer of claim 11 wherein said retainer has at least a first finger, said finger locates between the friction pad and the seat of the damper wedge body on installation; said first finger defines at least a portion of said first interface of said retainer at which said finger engages the friction pad; said first finger defines at least a portion of said second interface of said retainer at which said first finger engages the seat of the friction damper wedge; and, said first finger defines a spring that is deflected on installation.

18. The retainer of claim 11 wherein said retainer has a spider, and a set of fingers arrayed peripherally relative to said spider; said set of fingers defines at least a portion of said first interface, at which said set of fingers engages the friction pad; said set of fingers defines at least a portion of said second interface, at which said set of fingers engages the seat of the friction damper wedge; in use said set of fingers is resiliently spring loaded between the friction pad and the seat of the friction damper wedge.

19. The retainer of claim 18, in which the friction pad is a non-metallic friction lining that has a front face for engaging a friction wear plate of a side frame column of a railroad car truck side frame, a rear face for orientation facing the damper wedge, and side edges extending between the front and rear faces; in which the seat of the friction damper wedge body is a socket, the socket being sized to accommodate the friction pad; and wherein, on installation:

said spider of said retainer locates in the socket behind the rear face of the friction pad and is trapped between the rear face of the friction pad and the seat of the friction damper wedge body;

said set of fingers grasps respective ones of the side edges of the friction pad, said set of fingers being spring-loaded thereby;

said set of fingers fits within said socket, and is further spring-loaded thereby; and spring loading of said retainer between the friction pad and the socket discourages dislodgement of the friction pad from the socket.

20. A friction damper wedge assembly comprising the retainer of claim 11, the friction damper wedge, and the friction pad, wherein:

said friction pad is a non-metallic friction lining having a front face for engaging a friction wear plate of a side frame column of a railroad car truck side frame, a rear face for orientation facing the damper wedge, and side edges extending between said front and rear faces;

said seat of said friction damper wedge body is a socket, said socket being sized to accommodate said friction pad when said friction pad is mated to said retainer;

said retainer has a spider, and a set of fingers arrayed peripherally relative to said spider;

said spider defining a frame setting in which said friction pad locates;

said spider of said retainer locates in the socket behind the rear face of said friction pad and is trapped between the rear face of the friction pad and the seat of the friction damper wedge body;

said set of fingers extending forwardly away from said spider;

said set of fingers defines at least a portion of said first interface, at which said set of fingers engages said friction pad; said set of fingers defines at least a portion of said second interface, at which said set of fingers engages the seat of the friction damper wedge; in use said set of fingers is resiliently spring loaded between said friction pad and said seat of said friction damper wedge;

said set of fingers grasps respective ones of the side edges of said friction pad, said set of fingers being spring-loaded thereby;

said set of fingers fits within said socket, and is further spring-loaded thereby; and spring loading of said retainer between said friction pad and the socket discourages dislodgement of said friction pad from said socket.

* * * * *